US005661864A

United States Patent [19]

Valiant et al.

[11] Patent Number: 5,661,864

[45] Date of Patent: Sep. 2, 1997

[54] LAST FOR AN ARTICLE OF FOOTWEAR AND FOOTWEAR MADE THEREFROM

[75] Inventors: Gordon A. Valiant; Stephen Michael Vincent, both of Beaverton; Perry W. Auger, Tigard, all of Oreg.

[73] Assignee: Nike, Inc., Beaverton, Oreg.

[21] Appl. No.: 402,033

[22] Filed: Mar. 10, 1995

[51] Int. Cl.[6] ..... A43D 3/00; A43B 5/00

[52] U.S. Cl. ..... 12/133 R; 36/114; 12/146 L

[58] Field of Search ..... 12/133 R, 146 L, 12/135 R, 135 A, 139, 140, 141, 137; 36/114

[56] References Cited

U.S. PATENT DOCUMENTS

| | | | |
|---|---|---|---|
| 1,948,547 | 2/1934 | Topham | 12/146 L |
| 1,971,108 | 8/1934 | Karow | 12/133 R |
| 2,082,196 | 6/1937 | Worthington | 12/133 R |
| 2,309,775 | 2/1943 | Levitt | 12/133 R |
| 2,617,129 | 11/1952 | Petze | 12/133 R |
| 2,699,562 | 1/1955 | Murray . | |
| 2,716,294 | 8/1955 | Schwartz et al. | 12/133 |
| 3,496,584 | 2/1970 | Heath | 12/133 R |
| 3,543,316 | 12/1970 | Austin et al. | 12/133 |
| 3,696,456 | 10/1972 | Dunham et al. | 12/146 L |
| 4,306,361 | 12/1981 | Kaschura | 36/92 |
| 4,677,766 | 7/1987 | Gudas | 36/43 |
| 4,745,290 | 5/1988 | Frankel et al. | 12/146 L X |
| 5,231,723 | 8/1993 | White et al. | 12/133 R |
| 5,339,252 | 8/1994 | White et al. | 364/468 |

FOREIGN PATENT DOCUMENTS

| | | | |
|---|---|---|---|
| 149805 | 7/1900 | Germany | 12/133 R |
| 91/17677 | 11/1991 | WIPO | 12/146 L |
| 9319633 | 10/1993 | WIPO | 12/146 L |

OTHER PUBLICATIONS

"An Interactive Computer Graphics System for the Design of Molded and Orthopedic Shoe Lasts" Journal of Rehabilitation Research and Development, vol. 28, No. 4, 1991, pp. 39–46.

Historical Highlights of American Lastmaking and American Shoemaking—In Commemoration of the 50th Anniversary of Sterling Last Corportion 1932 –1982 (undated).

American Last Making, Karl C. Adrian, Shoe Trades Publishing Co., Aug. 9, 1991.

*Primary Examiner*—B. Dayoan

*Attorney, Agent, or Firm*—Banner & Witcoff, Ltd.

[57] ABSTRACT

An improved last, and article of footwear derived therefrom, for providing improved function, fit, and comfort for use in various athletic activities, and in particular for running. The last has dimensions defined by a plurality of cross-sectional contours extending from proximate a proximal end of the heel portion to proximate a distal end of the forefoot portion. The last dimensions are in accordance with or proportional to the plurality of cross-sectional contours shown in FIGS. 13–97. The last is characterized by a natural shape to the top of the cone or island and an enlarged toe box.

13 Claims, 98 Drawing Sheets

LAST DIMENSION CHART

MODEL SIZE: 7C
MODEL INSTEP: 9 in.

HEEL HEIGHT: 4/8 in.

MODEL SHORT HEEL: 12 7/16 in.

| SIZE | STICK (mm) | TOE SPRING (mm)) | BALL (in) - (mm) | WAIST (in) - (mm) |
|---|---|---|---|---|
| 4 C | 227.0 | 12 | 8 - 203.2 | 7 15/16 - 201.6 |
| 4.5 C | 231.3 | 12 | 8 1/8 - 206.4 | 8 1/16 - 204.8 |
| 5 C | 235.5 | 13 | 8 1/4 - 209.5 | 8 3/16 - 208.0 |
| 5.5 C | 239.7 | 13 | 8 3/8 - 212.7 | 8 5/16 - 211.1 |
| 6 C | 243.9 | 13 | 8 1/2 - 215.9 | 8 7/16 - 214.3 |
| 6.5 C | 248.2 | 14 | 8 5/8 - 219.1 | 8 9/16 - 217.5 |
| * 7 C | 252.4 | 14 | 8 3/4 - 222.3 | 8 11/16 - 220.7 |
| 7.5 C | 256.6 | 14 | 8 7/8 - 225.4 | 8 13/16 - 223.8 |
| 8 C | 260.9 | 14 | 9 - 228.6 | 8 15/16 - 227.0 |
| 8.5 C | 265.1 | 14 | 9 1/8 - 231.8 | 9 1/16 - 230.2 |
| 9 C | 269.3 | 15 | 9 1/4 - 235.0 | 9 3/16 - 233.4 |
| 9.5 C | 273.6 | 15 | 9 3/8 - 238.1 | 9 5/16 - 236.5 |
| 10 C | 277.8 | 15 | 9 1/2 - 241.3 | 9 7/16 - 239.7 |
| 10.5 C | 282.0 | 15 | 9 5/8 - 244.5 | 9 9/16 - 242.9 |
| 11 C | 286.2 | 15 | 9 3/4 - 247.7 | 9 11/16 - 246.1 |
| 11.5 C | 290.5 | 15 | 9 7/8 - 250.8 | 9 13/16 - 249.2 |
| 12 C | 294.7 | 16 | 10 - 254.0 | 9 15/16 - 252.4 |

FIG.10

LAST FOR AN ARTICLE OF FOOTWEAR AND FOOTWEAR MADE THEREFROM

TECHNICAL FIELD

The present invention is directed to a last for manufacturing an article of footwear, an article of footwear that is made therefrom and, in particular, to a last suitable for making articles of footwear specifically designed for a particular athletic activity, such as track, running, basketball, and the like.

BACKGROUND OF THE INVENTION

A last serves to substantially define the internal and external shape, as well as the overall geometry, of an article of footwear. Accordingly, the fit, function, and comfort of an article of footwear greatly depends upon the last from which it is derived. The last represents the footwear manufacturer's solution to the problem of finding a generic prescription for optimally accommodating the anatomical characteristics of a broad segment of the general public. The last is therefore an essential tool in the manufacture of an article of footwear and a well designed last is an extremely valuable commercial asset to a footwear manufacturer.

A last is the foot-shaped form or model over which an article of footwear is formed. A prior art last generally includes four main parts: the last block, a metal plate covering a portion or all of the sole area, a hinge in the middle of the last which allows the last to be divided for easy removal of the last from the shoe, and a thimble through the top and backpart of the last which allows a spindle to be inserted to hold the last during the shoemaking process.

Some of the common measurements which are taken into consideration when making a last are shown in FIGS. 1–4. As illustrated, the cone "c" for prior art last "L" is the upper portion extending from the ball portion to the top of the heel portion. The upper surface or top of the last is referred to as the cone island "ci". The last may also have an elevation of the toe tip that is measured from the tread point "tp" and a toe thickness "th" which defines the space given for the toes of the wearer of the footwear. The elevation of the toe tip is called toe spring "t". The ball or ball girth "b" of the last is the greatest dimension around the forefoot area of the last. The bottom of the last extends upwardly from the tread point "tp" to define the heel height "h". The short heel or short heel girth "sh" of the last is the dimension around a last passing through the instep and the heel feathering point. The instep or instep girth "i" is the dimension around the last passing through the instep point. Similarly, the waist or waist girth "w" is the smallest dimension around the last between the ball girth and the instep girth. As shown in FIG. 2, two common measurements for a last are the stick length "sl" and the bottom length "bl" which are taken by a measuring instrument called a stick. Further terms of art and measurements known to one of ordinary skill in the art are described in *American Lastmaking*, by Karl C. Adrian, published in 1991 by the Shoe Trades Publishing Company, of Arlington, Mass., the entire contents of which are hereby incorporated by reference.

Ideally, an article of footwear made on a last should guide the foot in a natural walking or running posture for optimum distribution of supportive and propulsive forces during each step. The article of footwear made on the last should also provide maximum comfort and freedom from excessive stress on the muscles, ligaments and tendons of the foot and leg. In prior art lasts, however, these objectives have not always been met. For example, the narrow cone shape present in many prior art lasts may produce an uncomfortable ankle region in the finished article of footwear. Further, the molding techniques and measurements utilized for making many lasts in the prior art generally do not take into consideration the curvature of the bottom of the foot, the first toe length and the weight which is borne by the finished article of footwear.

SUMMARY OF THE INVENTION

The preferred embodiment of the present invention provides a last for making an article of footwear. The last inchdes a forefoot portion, a cone portion rearward of the forefoot portion, and a heel portion rearward of the cone portion. The last has dimensions in accordance with or proportional to those of FIGS. 13–97. More particularly, the last dimensions are further defined by a plurality of cross-sectional contours extending from a proximal end of the heel portion to a distal end of the forefoot portion. The cross-sectional contours are taken along consecutive parallel planes to a reference X-Y plane defined as Z being equal to 0.0. The cross-sectional contours are derived from eighty-five cross sections taken through the last, a first cross section being located at or a short distance from the proximal end of the heel portion and an eighty-fifth cross section being located at or a short distance from the distal end of the forefoot portion, with the short distances being generally less than or equal to the spacing between adjacent cross sections, and each cross-sectional contour corresponding to each respective cross section through the last.

The present invention overcomes the disadvantages of the prior art by providing a last having a more natural shape cone area. This natural shape is complimentary to the ankle region of a wearer and thus produces a comfortable fit for the article of footwear. In addition, the present invention provides a widened toe box area in order to provide greater space for the first toe or hallux. Further, since the molds for developing the last of the present invention are taken in a weight bearing condition, the article of footwear thus produced better conforms to the foot during the weight bearing phase of walking and running.

The preferred embodiment of an article of footwear according to the present invention has a shape complimentary to that of the inventive last.

BRIEF DESCRIPTION OF THE DRAWINGS

The above description and other objects, advantages, and features of the present invention will be more fully understood and appreciated by reference to the specification and accompanying drawings, wherein:

FIG. 10 graphically shows the stick length, toe spring, ball, waist, heel height, and short heel measurements of the last of the present invention as graded for sizes 4 through 12;

DETAILED DESCRIPTION OF THE PREFERRED EMBODIMENTS

Figure 5:
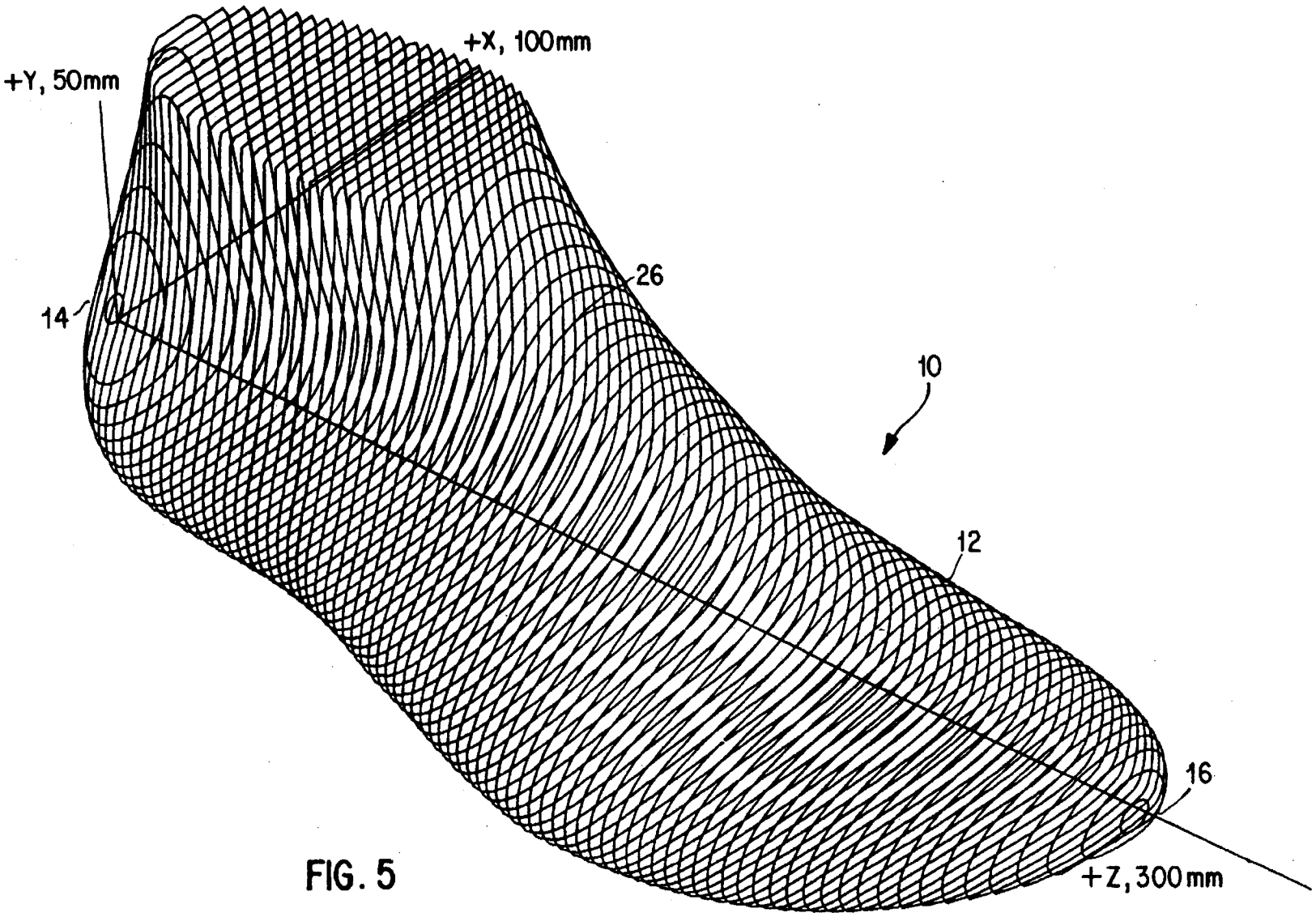
FIG. 5 is a perspective view of a computer generated three dimensional representation of a last according to the preferred embodiment of the present invention.
Figure 6:
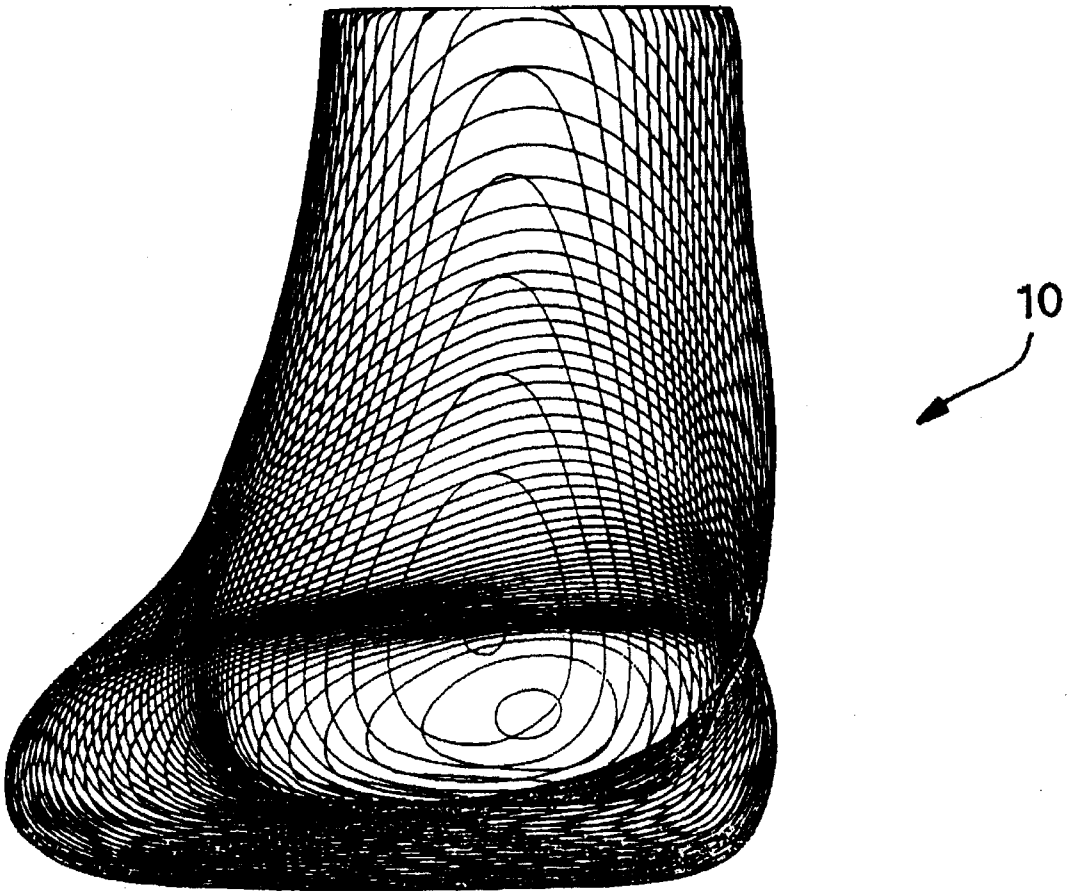
FIG. 6 is a rear view of the last representation of FIG. 5.
Figure 7:
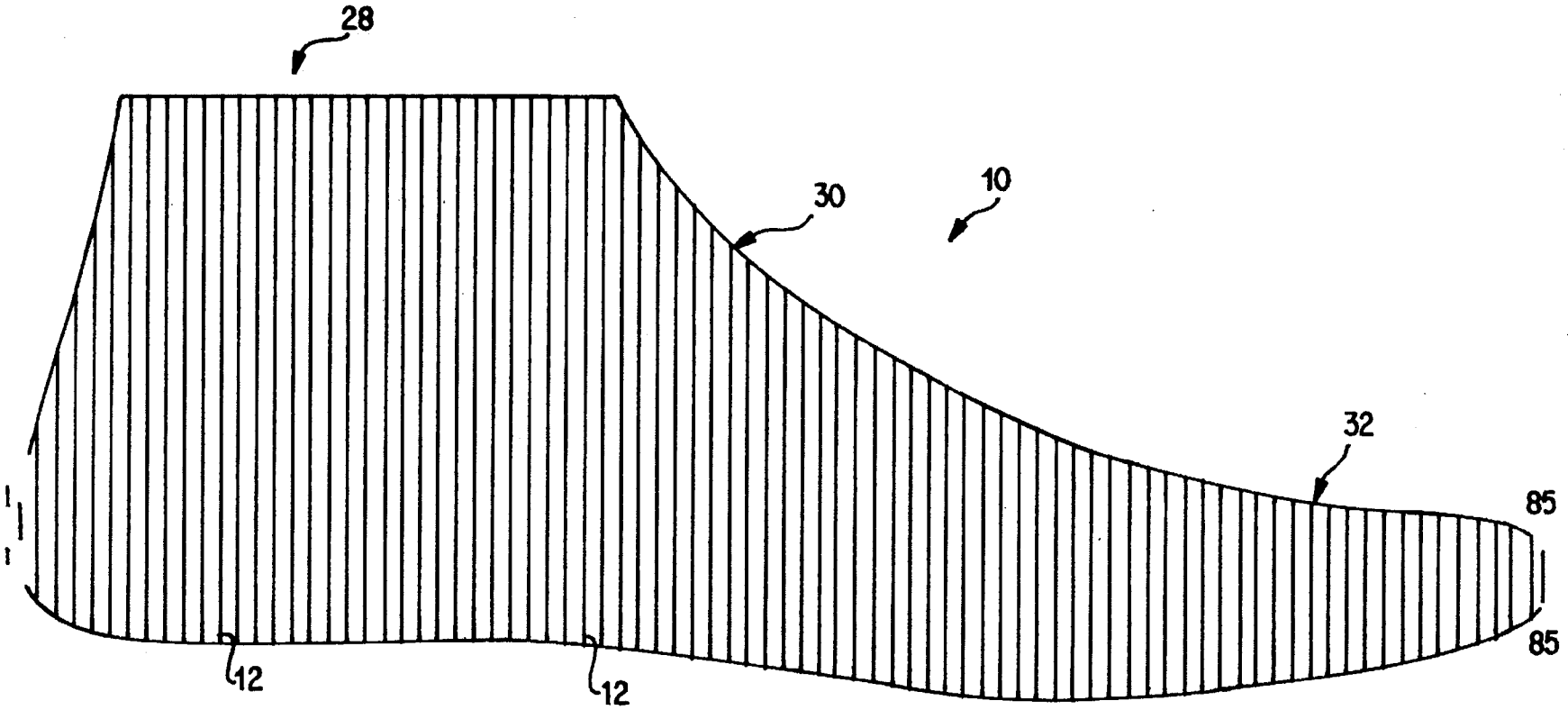
FIG. 7 is a side schematic of the last representation of FIG. 5 indicating the cross sections 1–85 taken therethrough.
Figure 8:
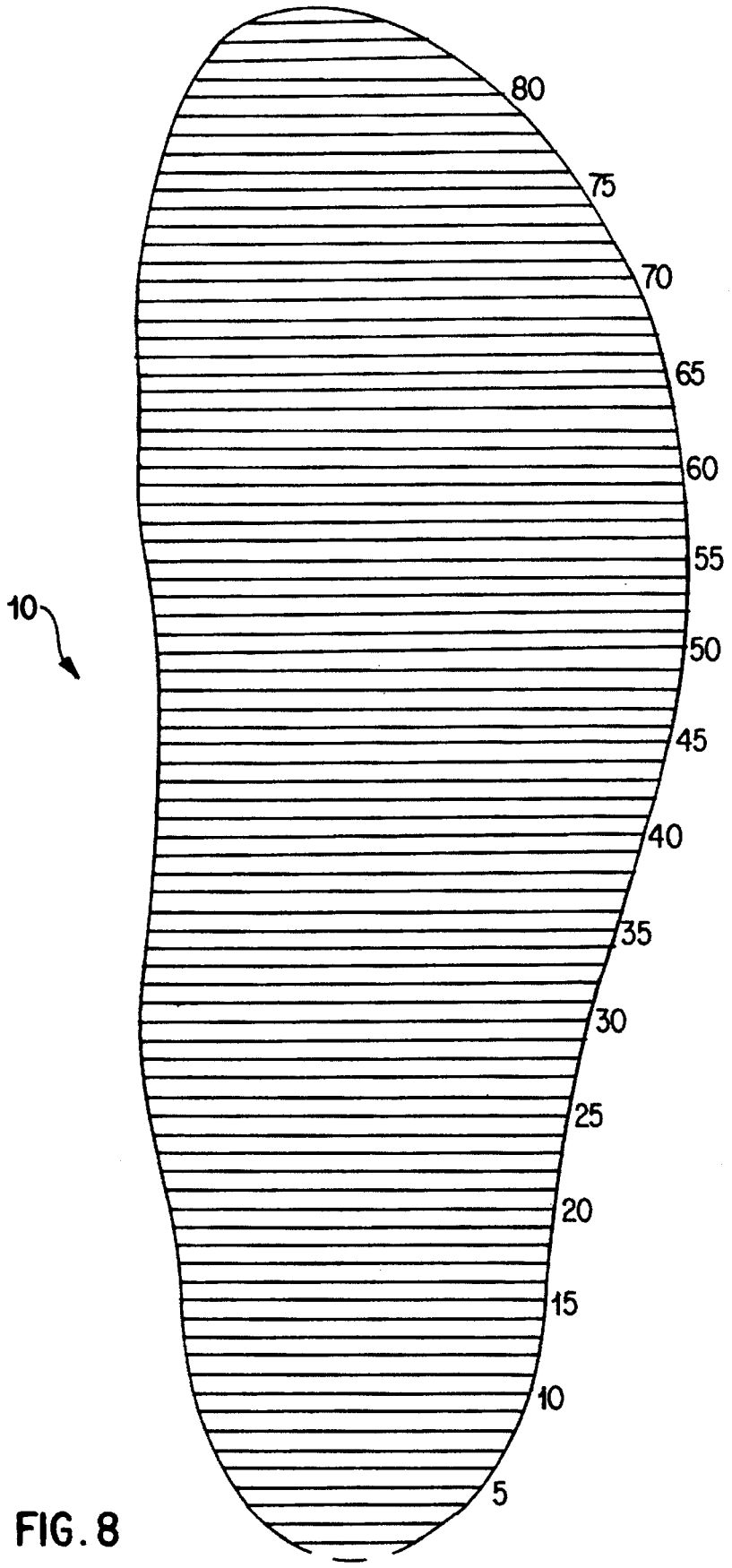
FIG. 8 is a bottom schematic of the last representation of FIG. 5 indicting the cross sections 1–85 taken therethrough.

The last 10 in accordance with the present invention is shown by the computer generated three dimensional representation of FIG. 5. This view is taken on the lateral side of last 10 looking downward at an angle of approximately 45 degrees relative to the respective orientations of the X, Y, and Z axes. Last 10 is preferably utilized in the manufacture of an article of footwear used for running. Referring also to FIGS. 6–8, a plurality of cross-sectional contours 12 are numbered as sections 1—1 to 85—85 and extend from proximate the rearmost portion or proximal end of the heel 14 to proximate the anteriormost portion or distal end of the toe 16. Proximate in accordance with the present invention implies a spaced interval of 0 mm to 3 mm. In a preferred embodiment, contours 12 are also evenly spaced at 3 mm intervals, derived from consecutive and parallel transverse planes corresponding to the X-Y plane. Thus, the first cross section is taken approximately 3 mm or less from the proximal end of the heel 14 and the last cross section is taken approximately 3 mm or less from the distal end of the toe 16. Cross-sectional contours 1—1 to 85—85 are graphically illustrated in FIGS. 13–97. Last 10 as shown is used for making articles of footwear for the fight foot. It is within the ordinary knowledge of one skilled in the art to reverse the orientation of the specified contours 1—1 to 85—85 in order to form a symmetric last for making articles of footwear for the left foot. Thus, it can be readily understood that the last of the present invention for the preferred model size shown is defined by the contours of FIGS. 13–97.

Figure 1:
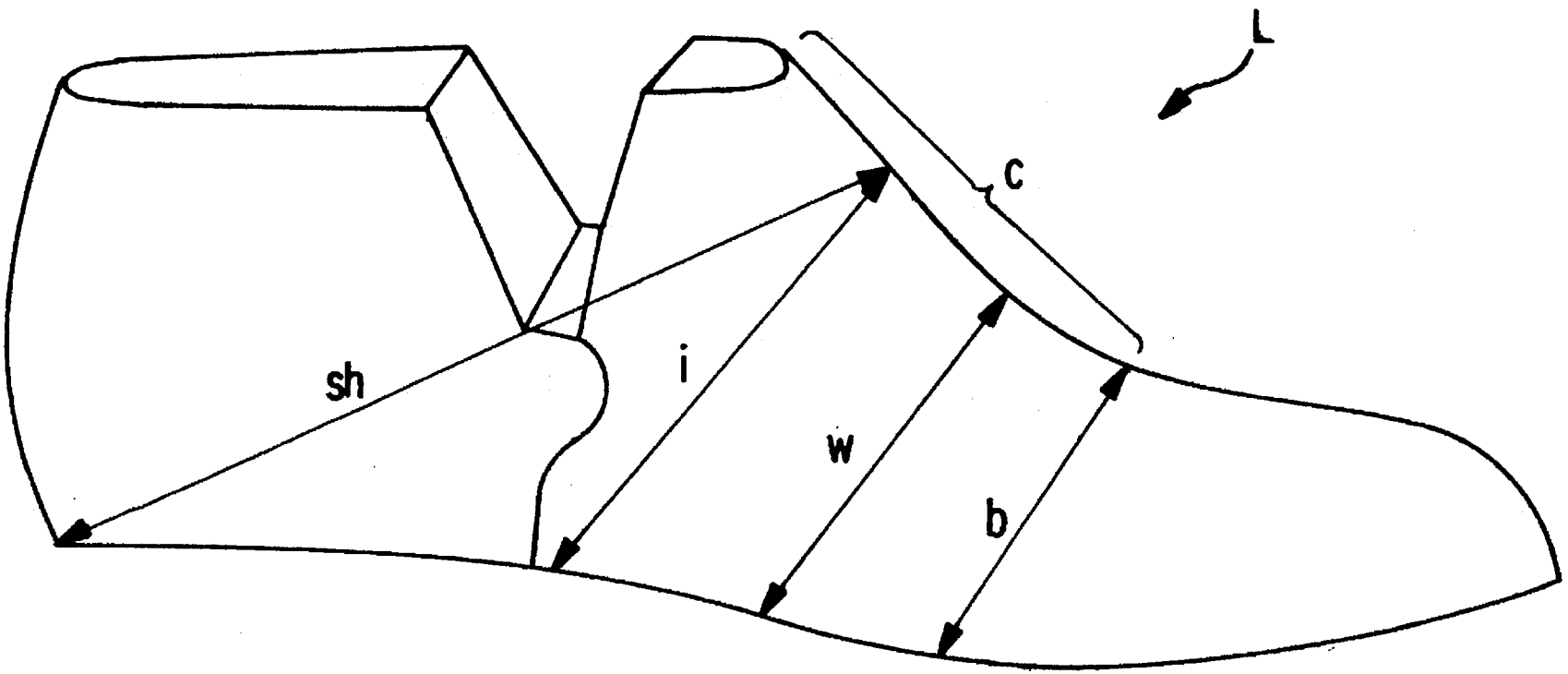
FIG. 1 PRIOR ART
FIG. 1 is a side view representation of a prior art last showing the approximate location of the short heel, instep, waist and ball last measurements.
Figure 2:
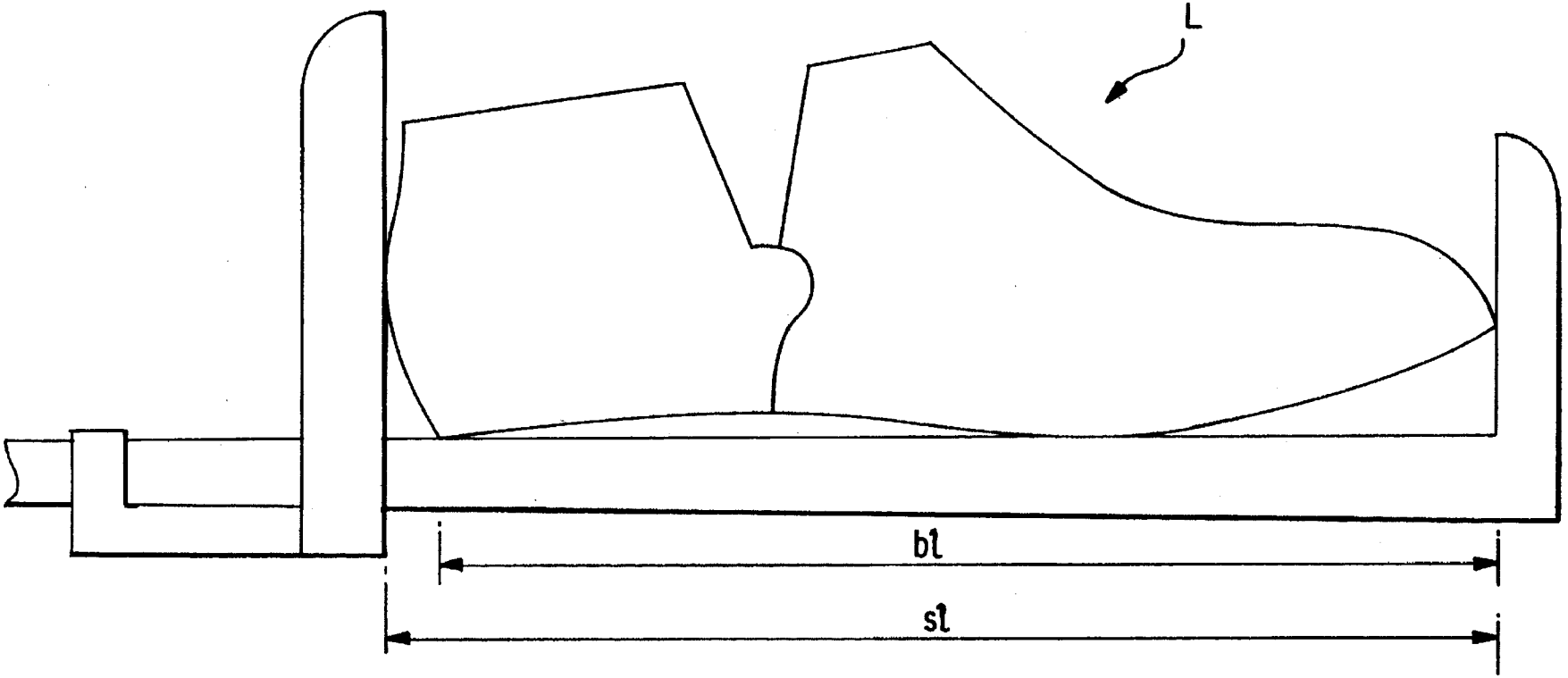
FIG. 2 PRIOR ART
FIG. 2 is a side view representation of a prior art last showing bottom length and stick length last measurements.
Figure 3:
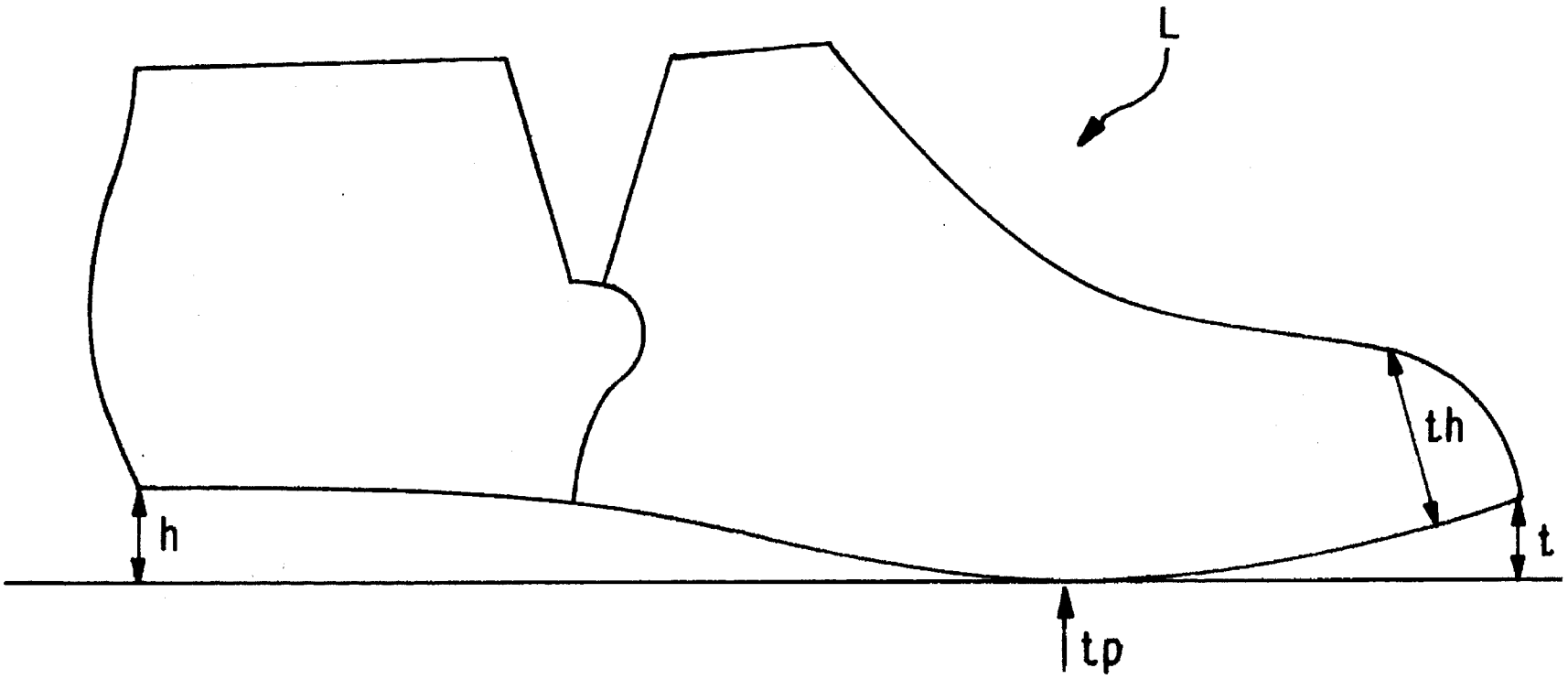
FIG. 3 PRIOR ART
FIG. 3 is a side view representation of a prior art last showing heel height, tread point, and toe spring last measurements.

FIGS. 7 and 8 illustrate the last 10 representation of FIG. 1 in side and bottom views, respectively, to more clearly show cross-sectional contours 12 extending from proximate the rearmost portion of the heel 14 to proximate the anteriormost portion of the toe 16 of the inventive last 10. The cross section lines 1—1 to 85—85 are evenly spaced at 3 mm intervals, in the preferred embodiment in order to provide sufficient contour definitions for forming last 10. Other spacing intervals could also be used, however, to derive the overall shape of last 10. Cross-sectional contours 12, and in particular, the parallel X-Y plane defined by cross section 1—1 preferably begins equal to or less than 3 mm anterior to a point which delimits the rearmost portion of the heel 14 of the last 10. Each succeeding parallel X-Y plane, defined by cross sections 2—2 through 85—85, is evenly spaced 3 mm apart, and extends consecutively to a position proximate the anteriormost portion of the toe 16 of the last 10.

Figure 13:
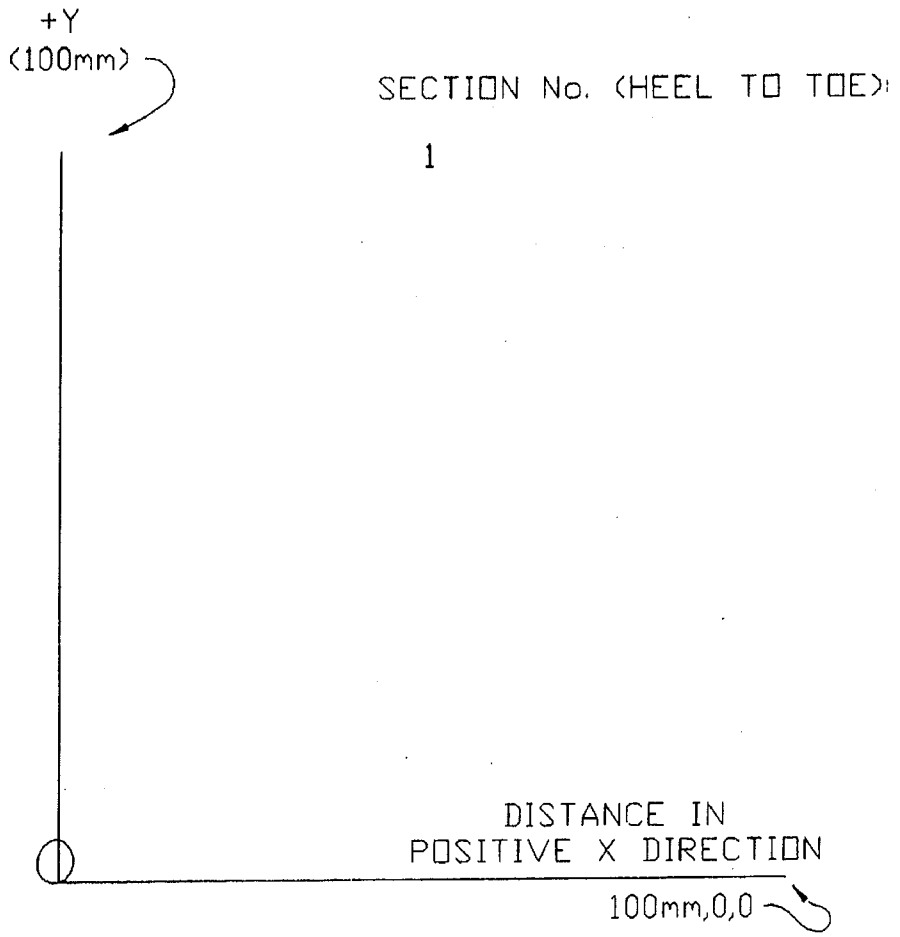
FIGS. 13–97 are cross sectional contours of the last shown in FIG. 5 as taken along parallel lines 1 to 85 as shown in FIGS. 7 and 8.
Figure 14:
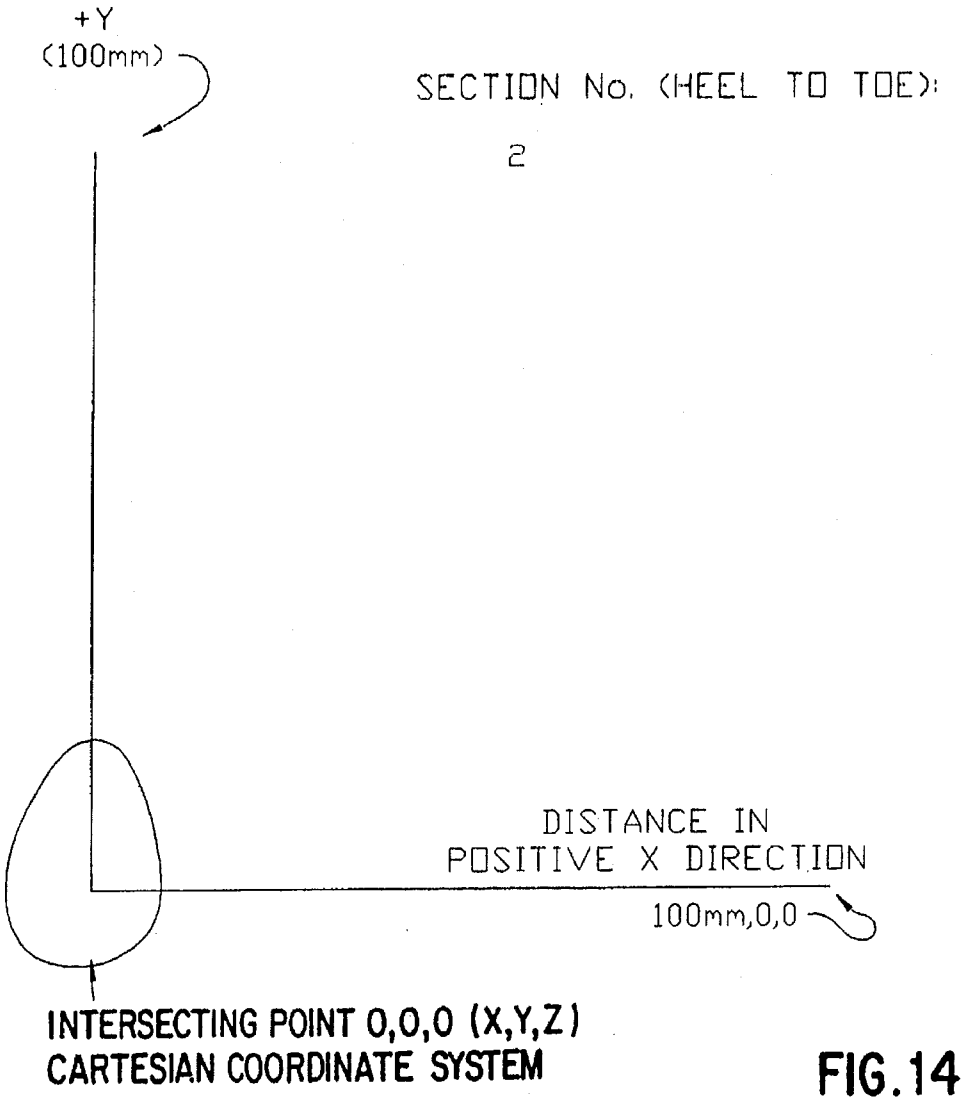
Figure 15:
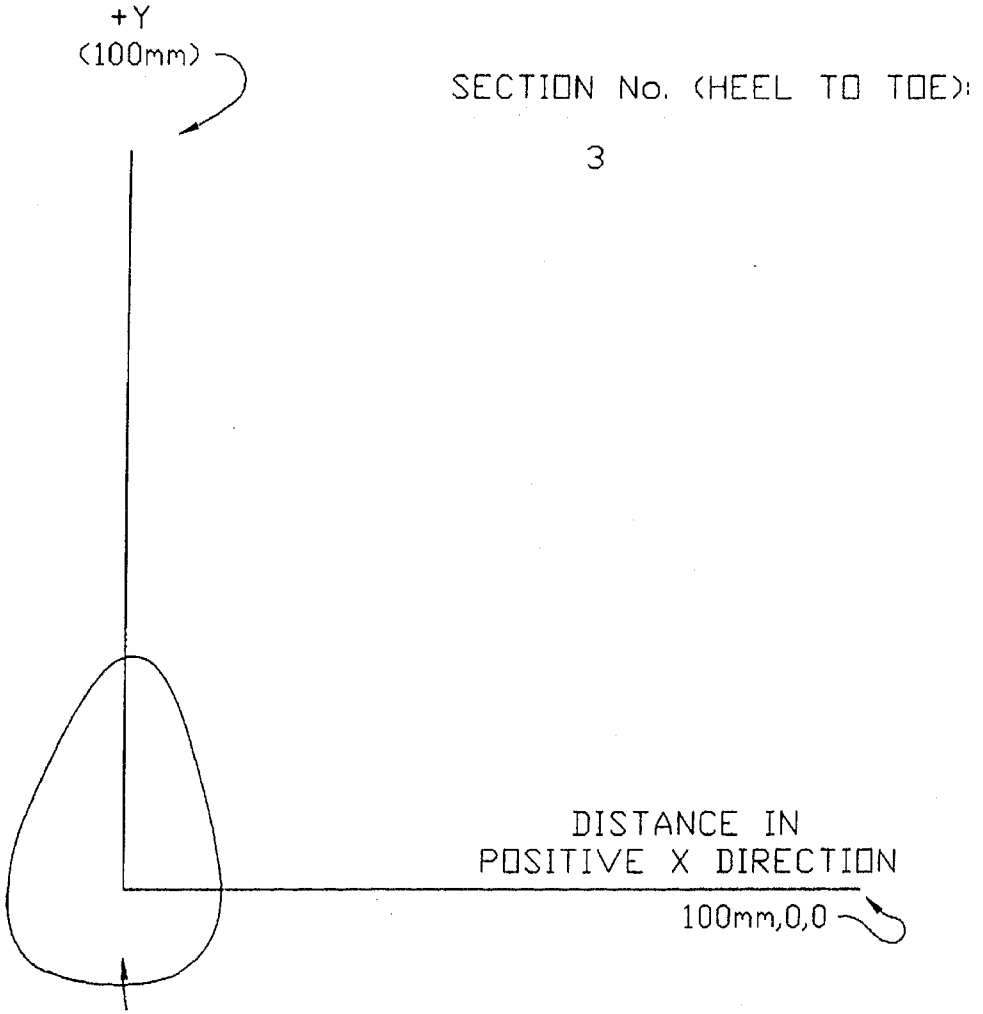
Figure 16:
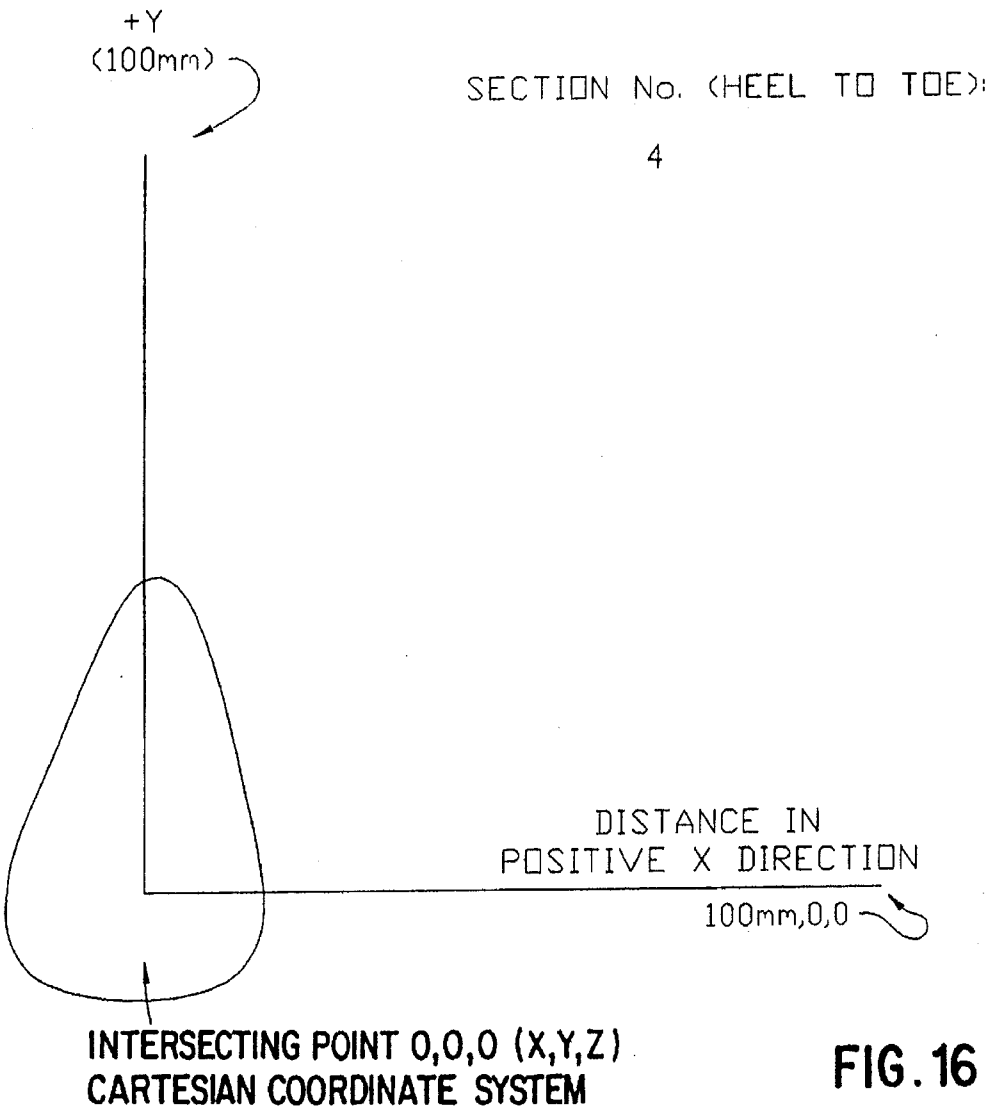
Figure 17:
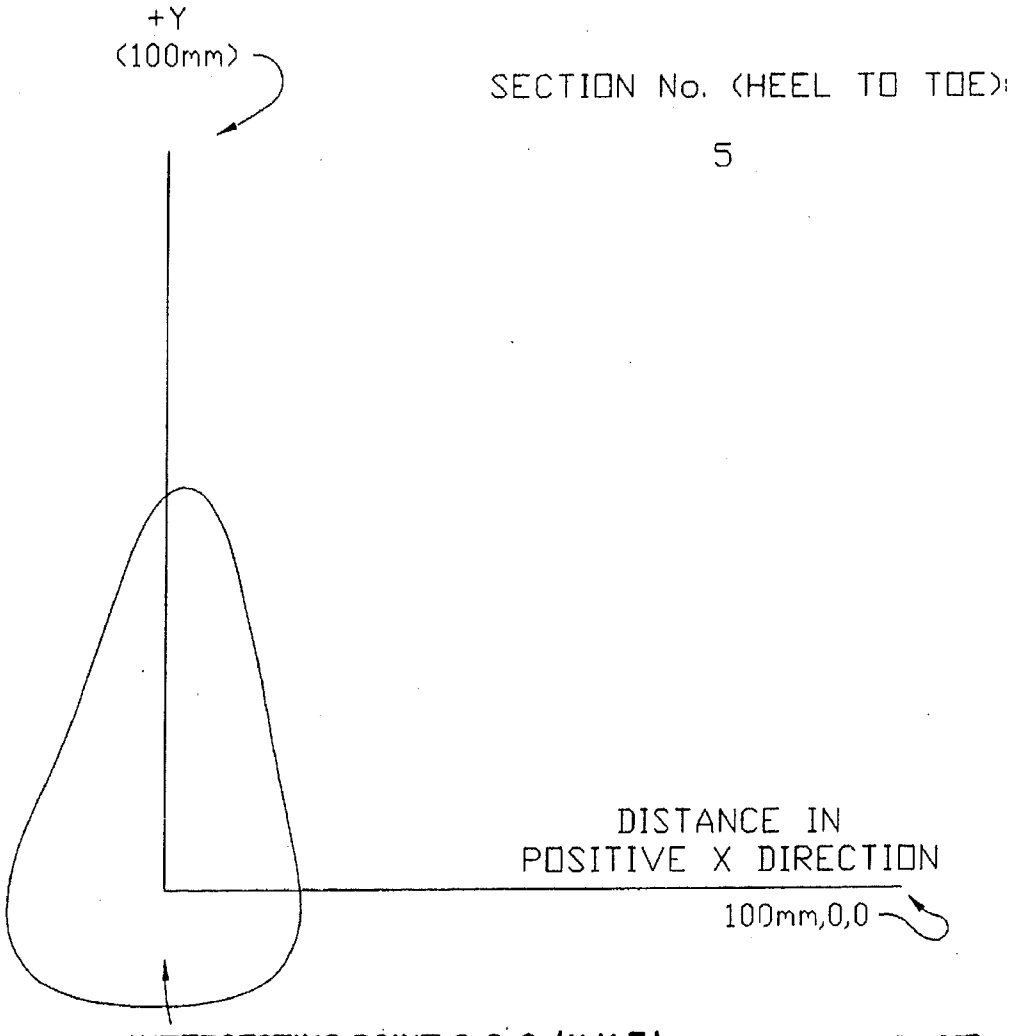
Figure 18:
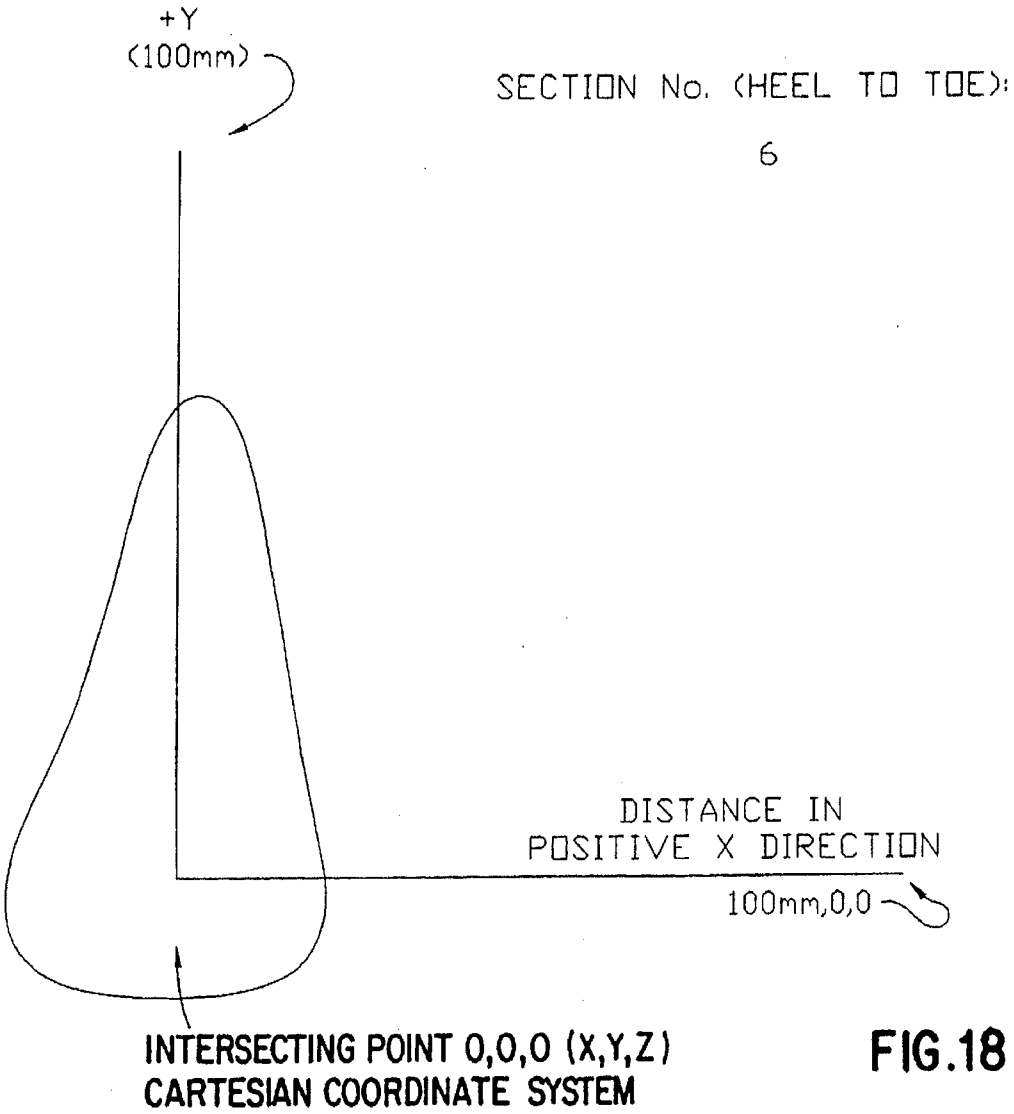
Figure 19:
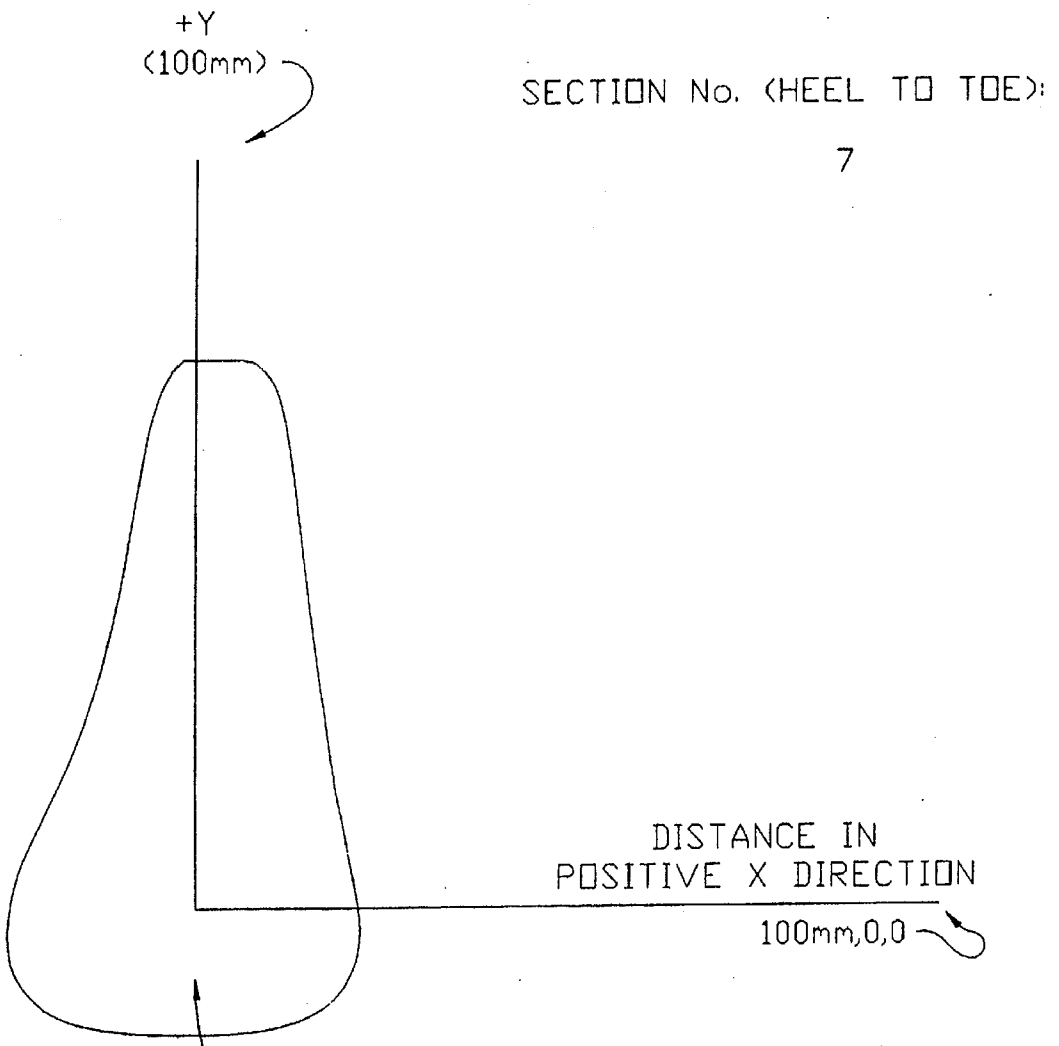
Figure 20:
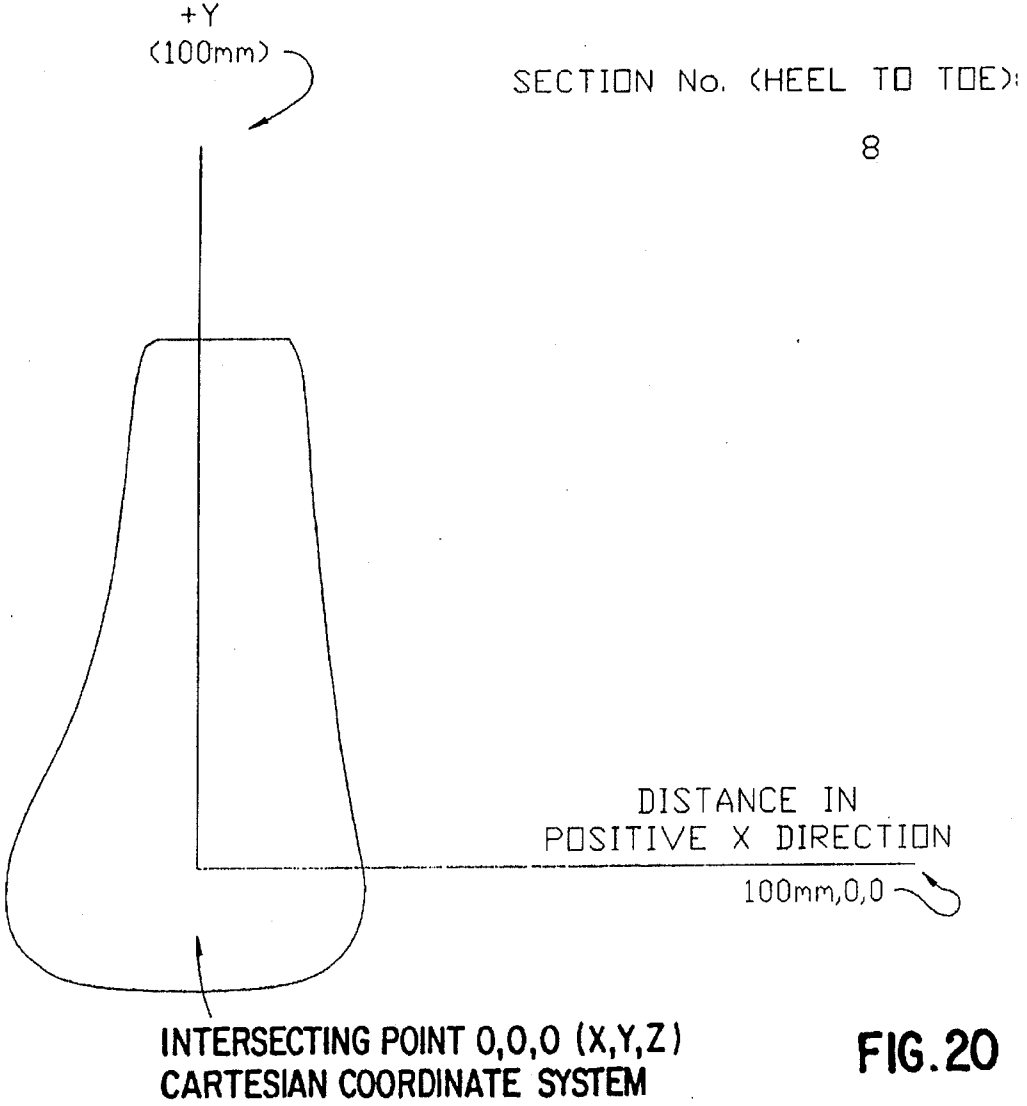
Figure 21:
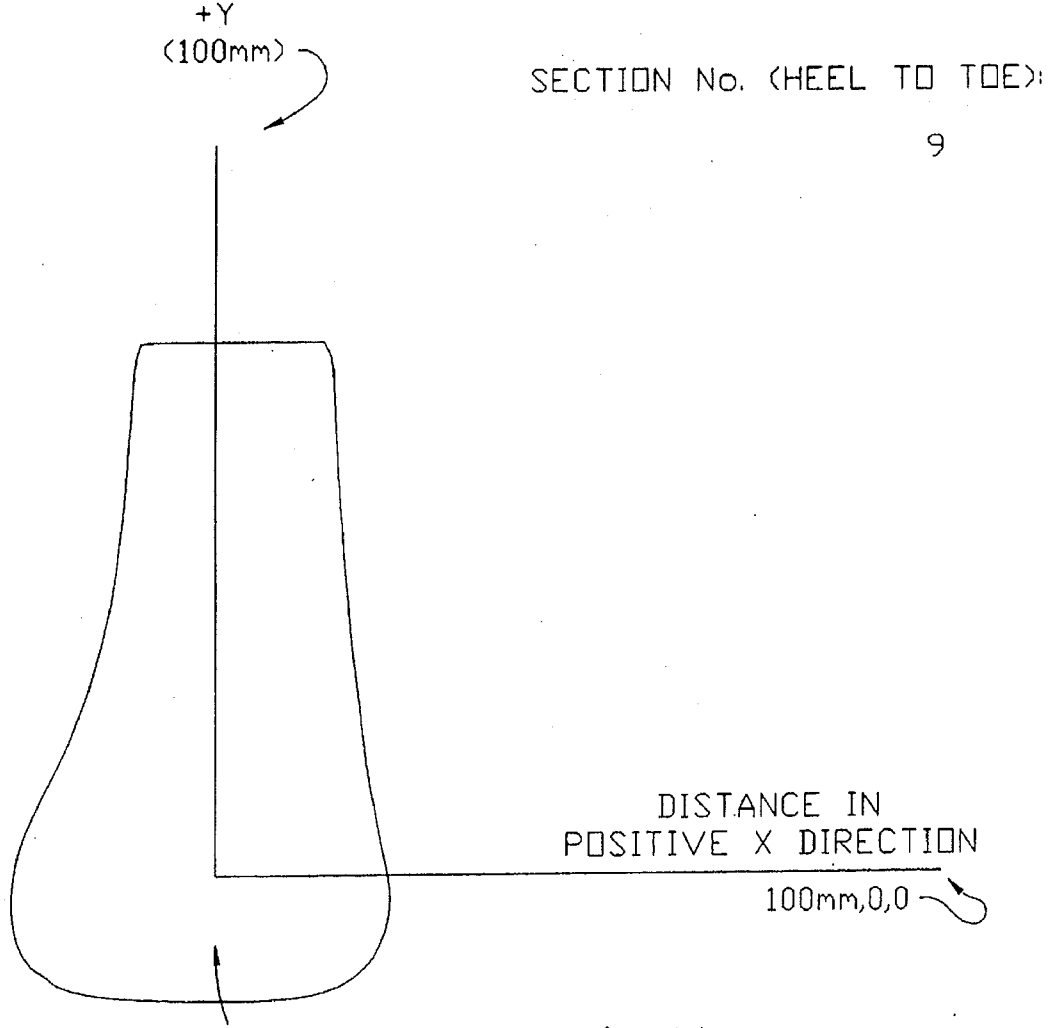
Figure 22:
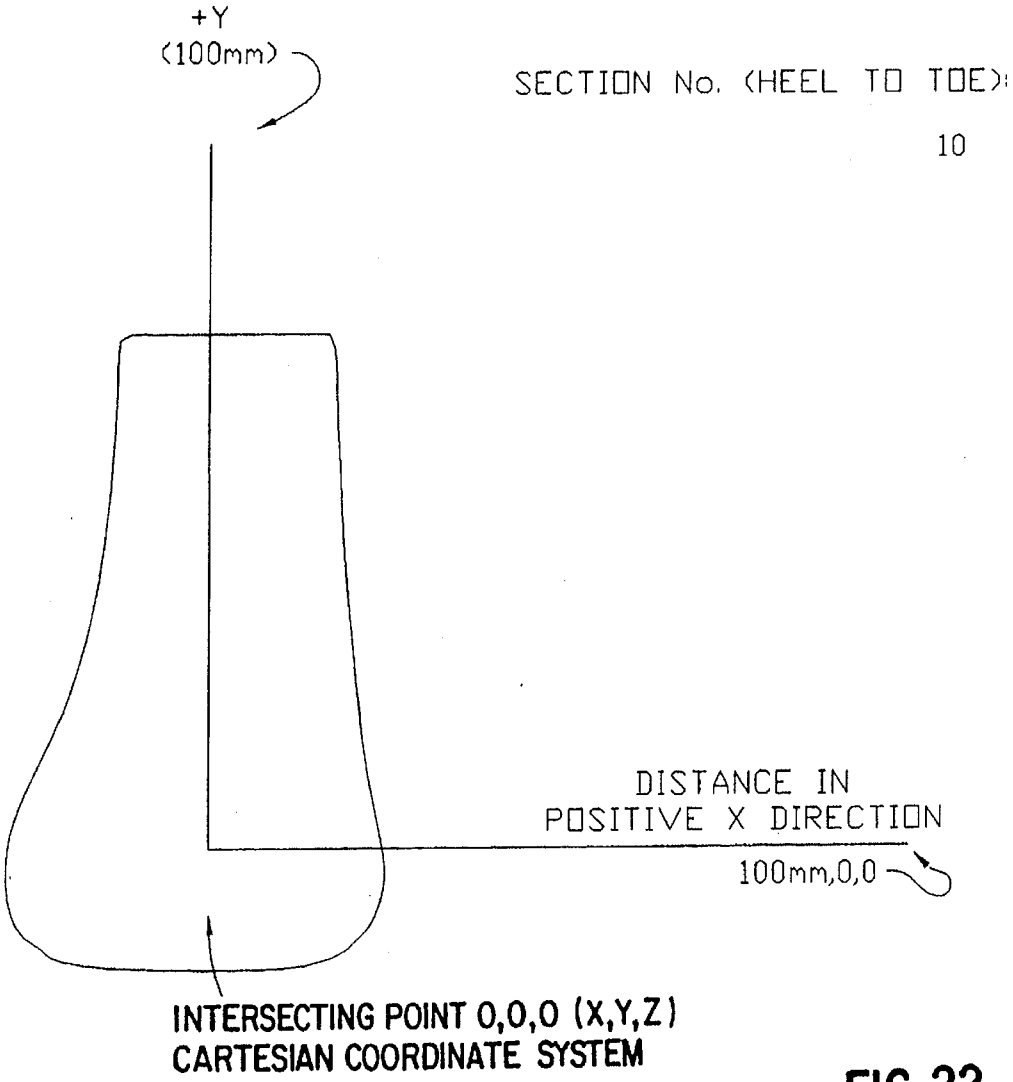
Figure 23:
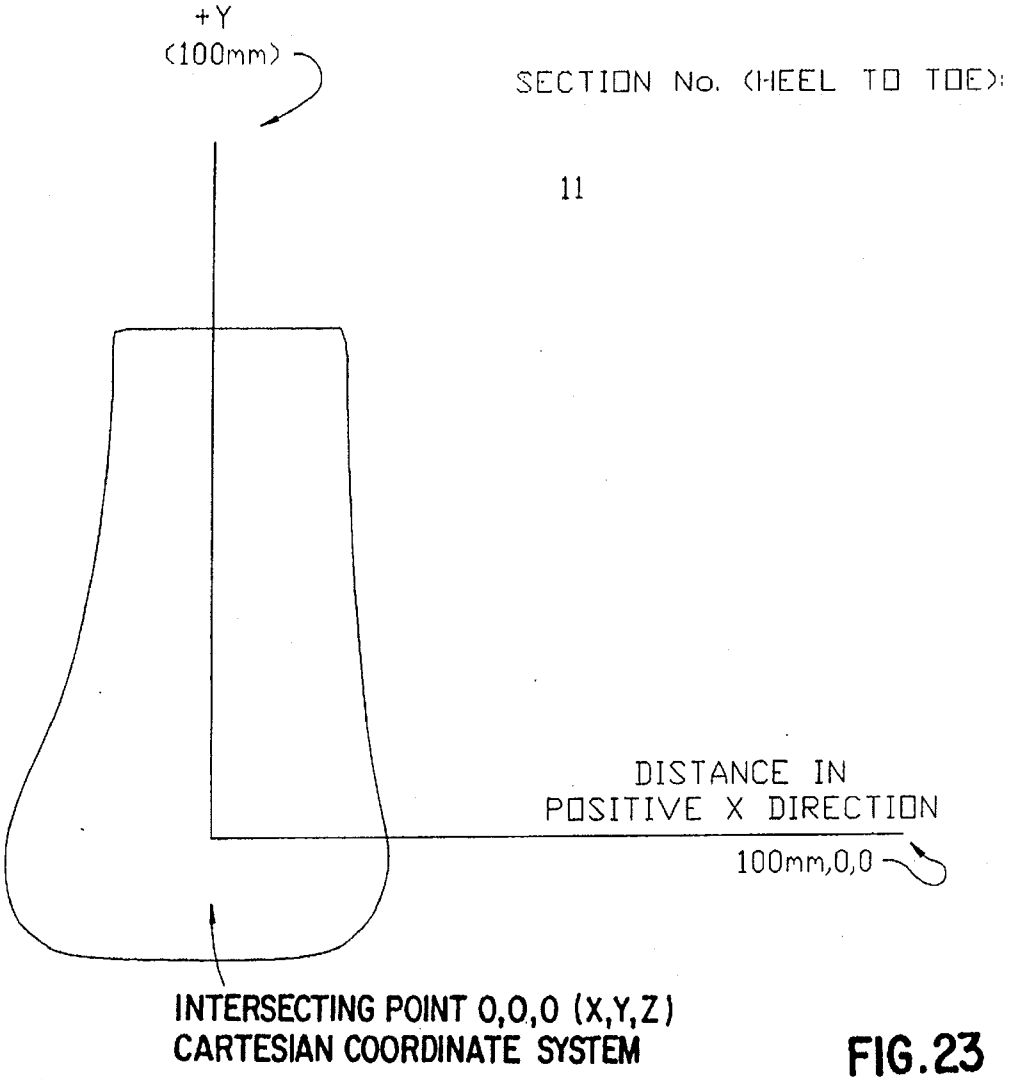
Figure 24:
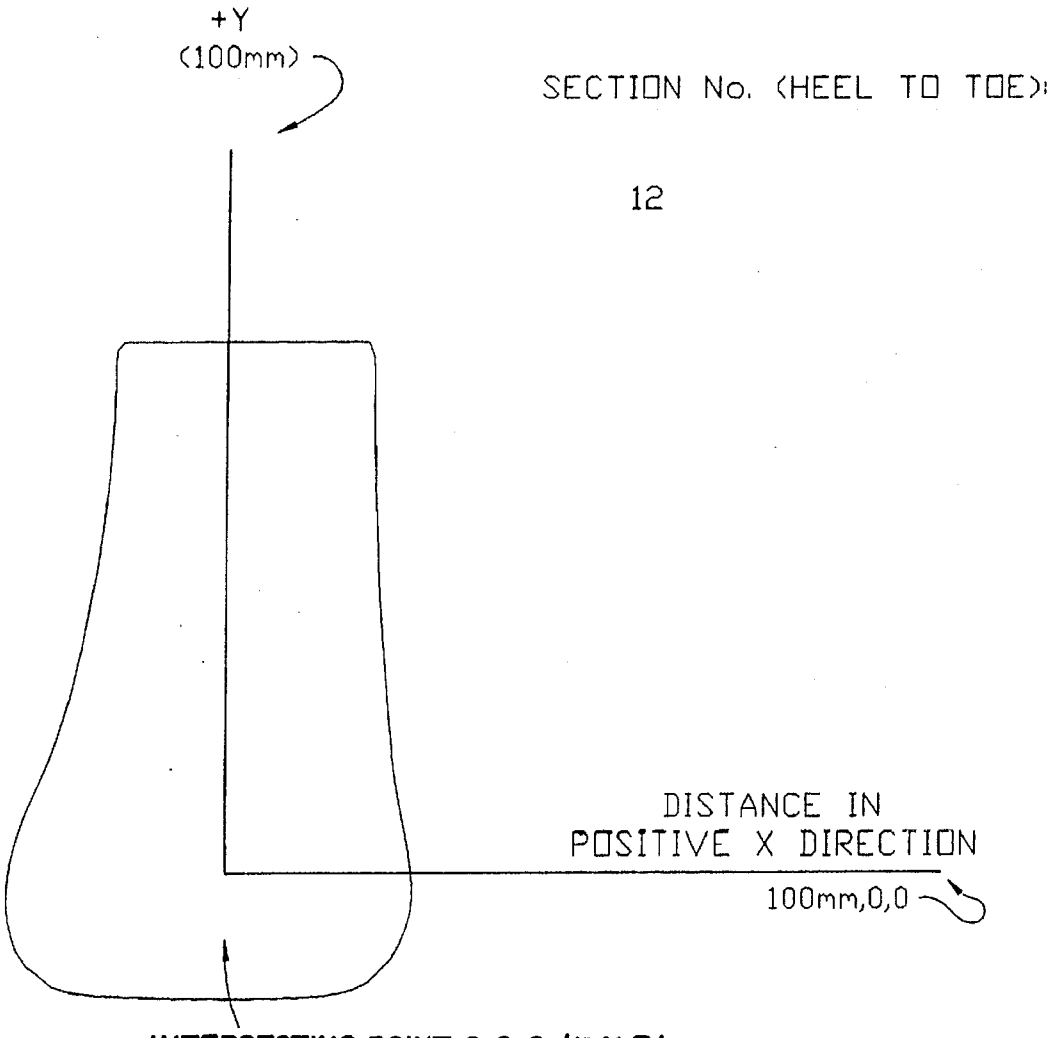
Figure 25:
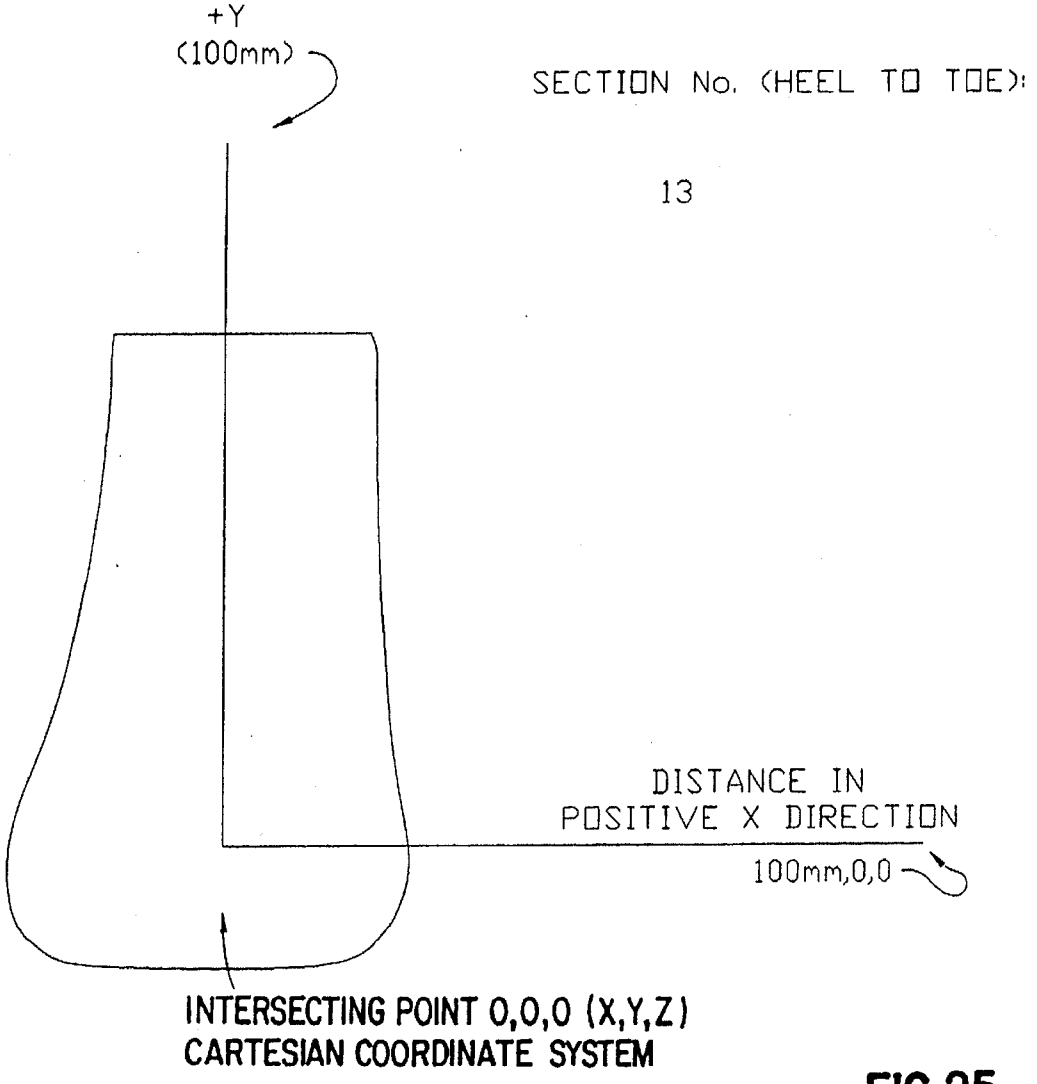
Figure 26:
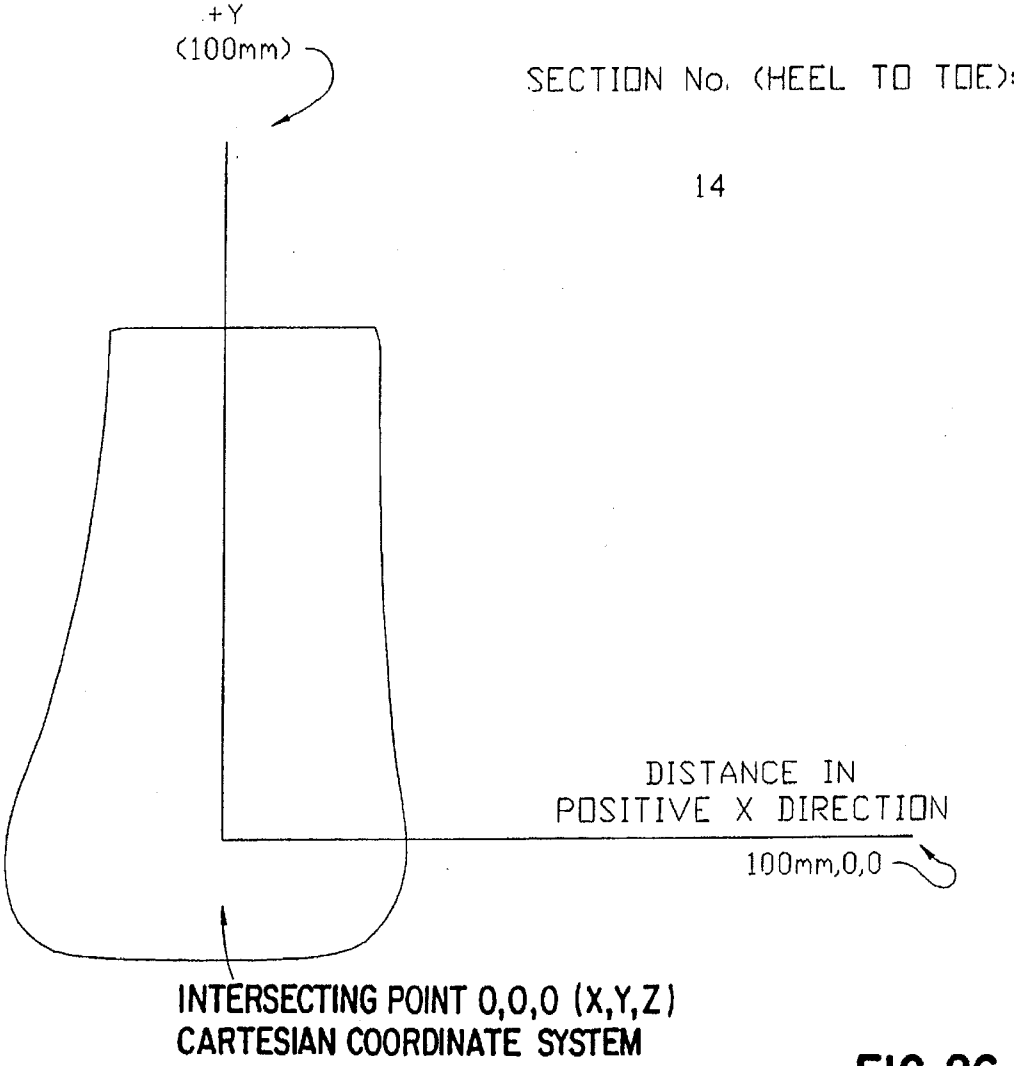
Figure 27:
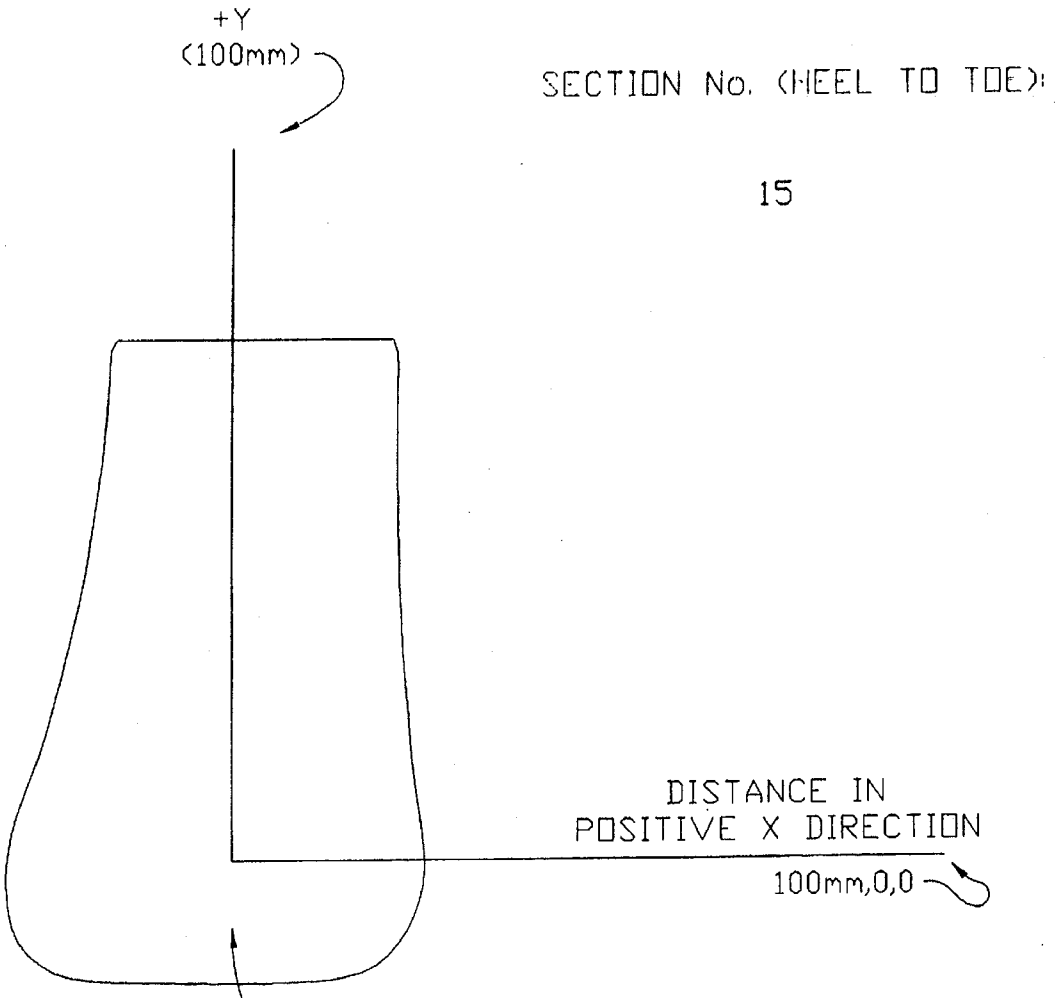
Figure 28:
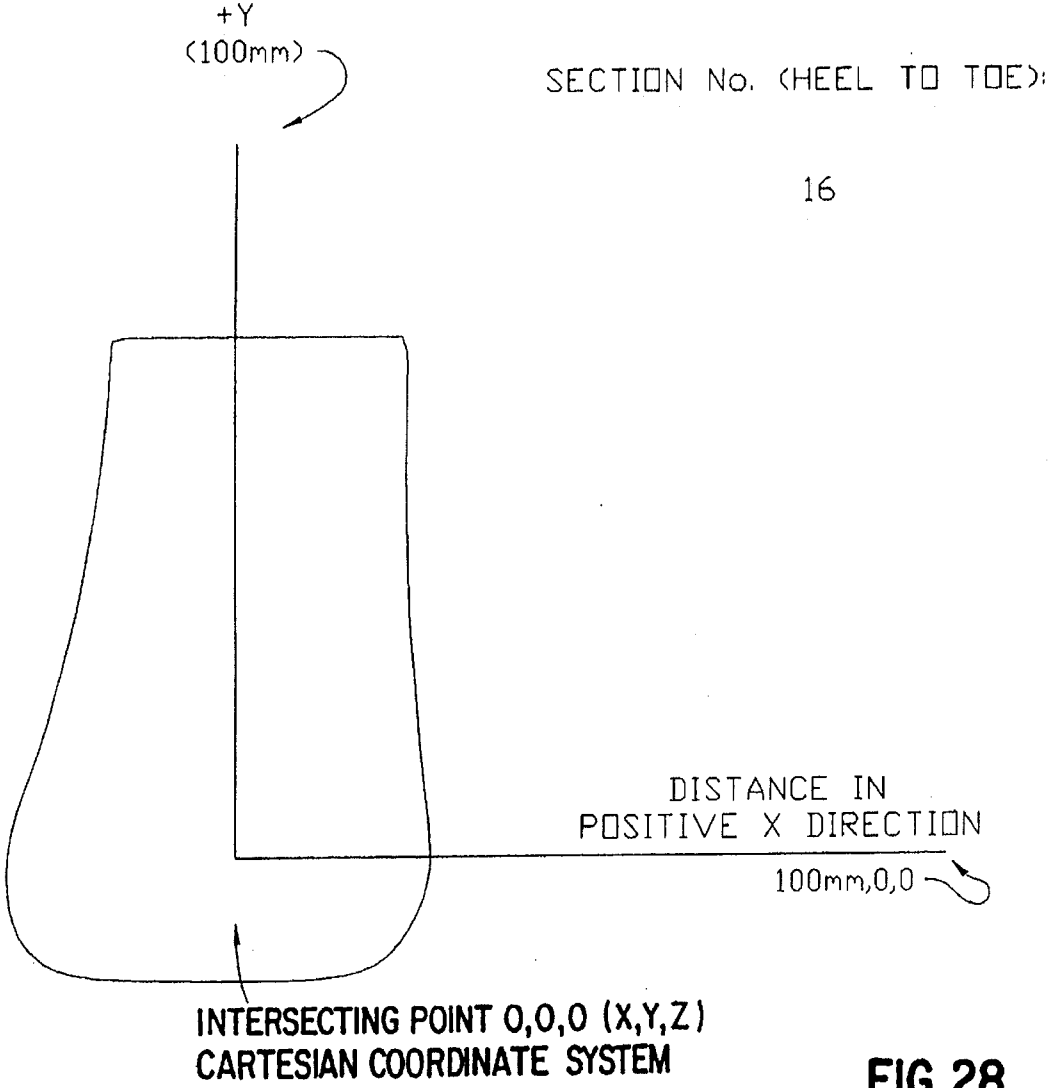
Figure 29:
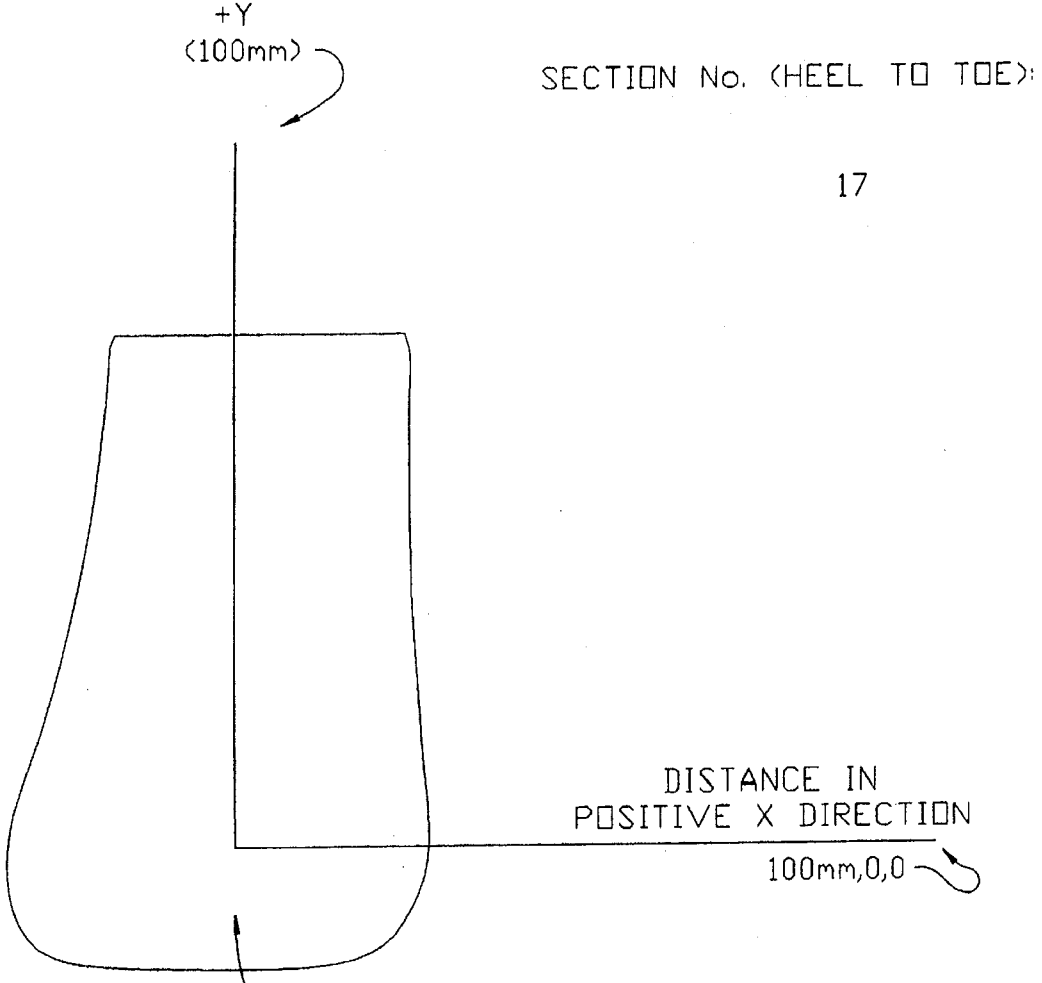
Figure 30:
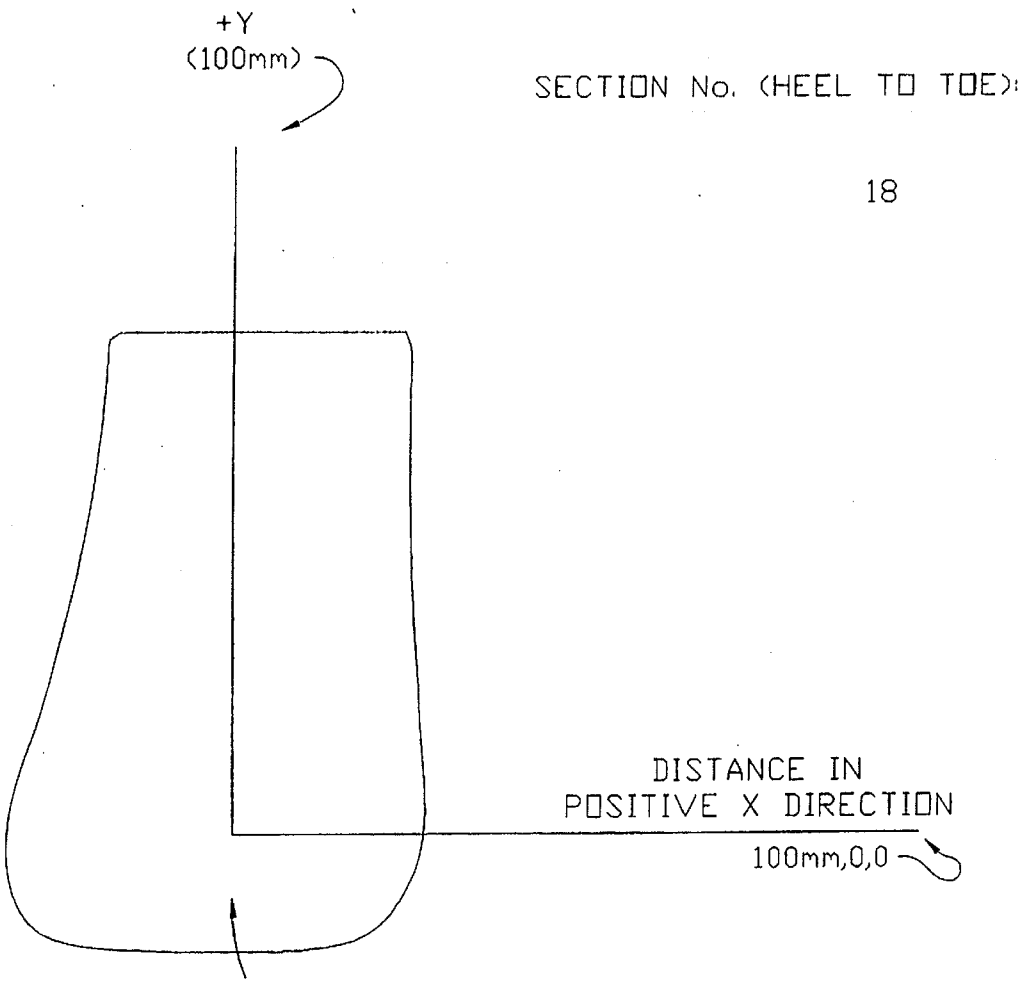
Figure 31:
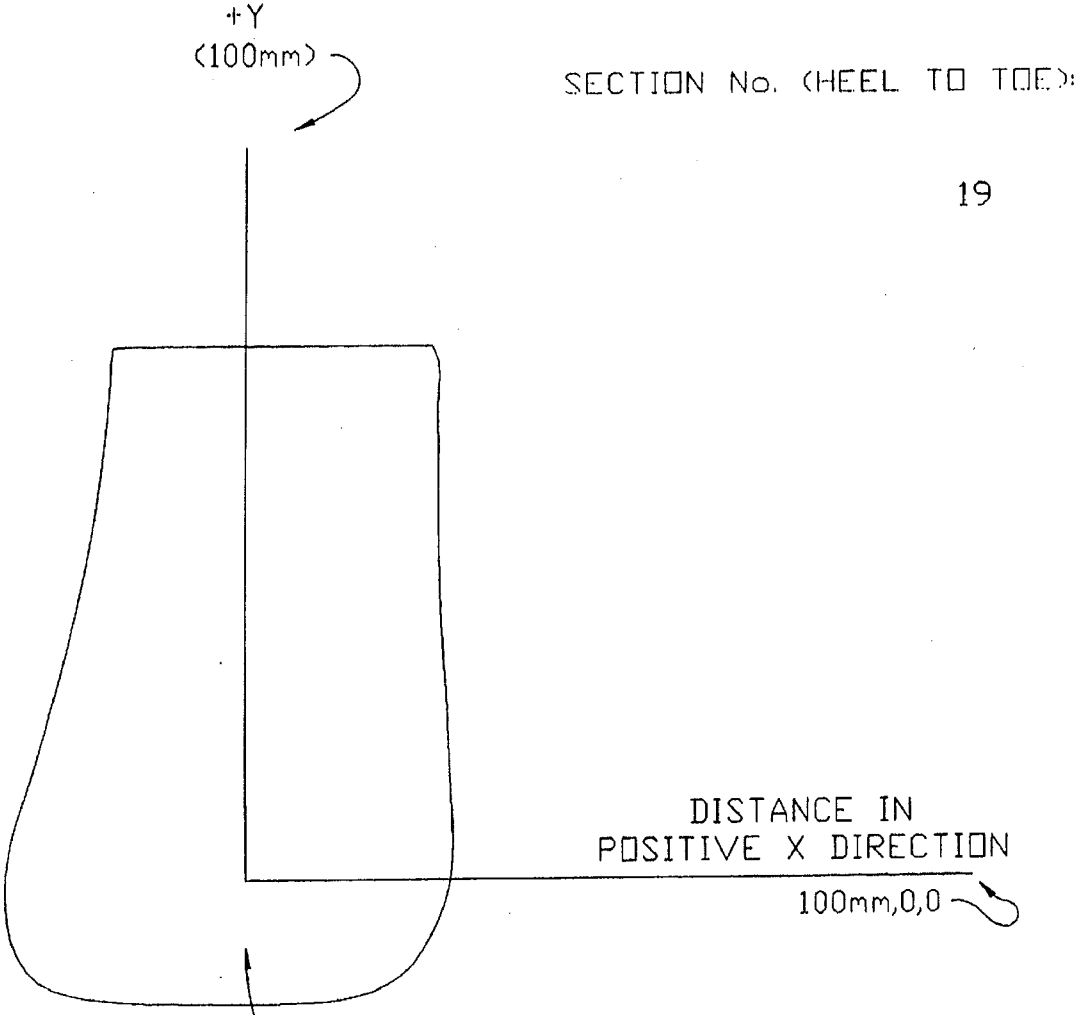
Figure 32:
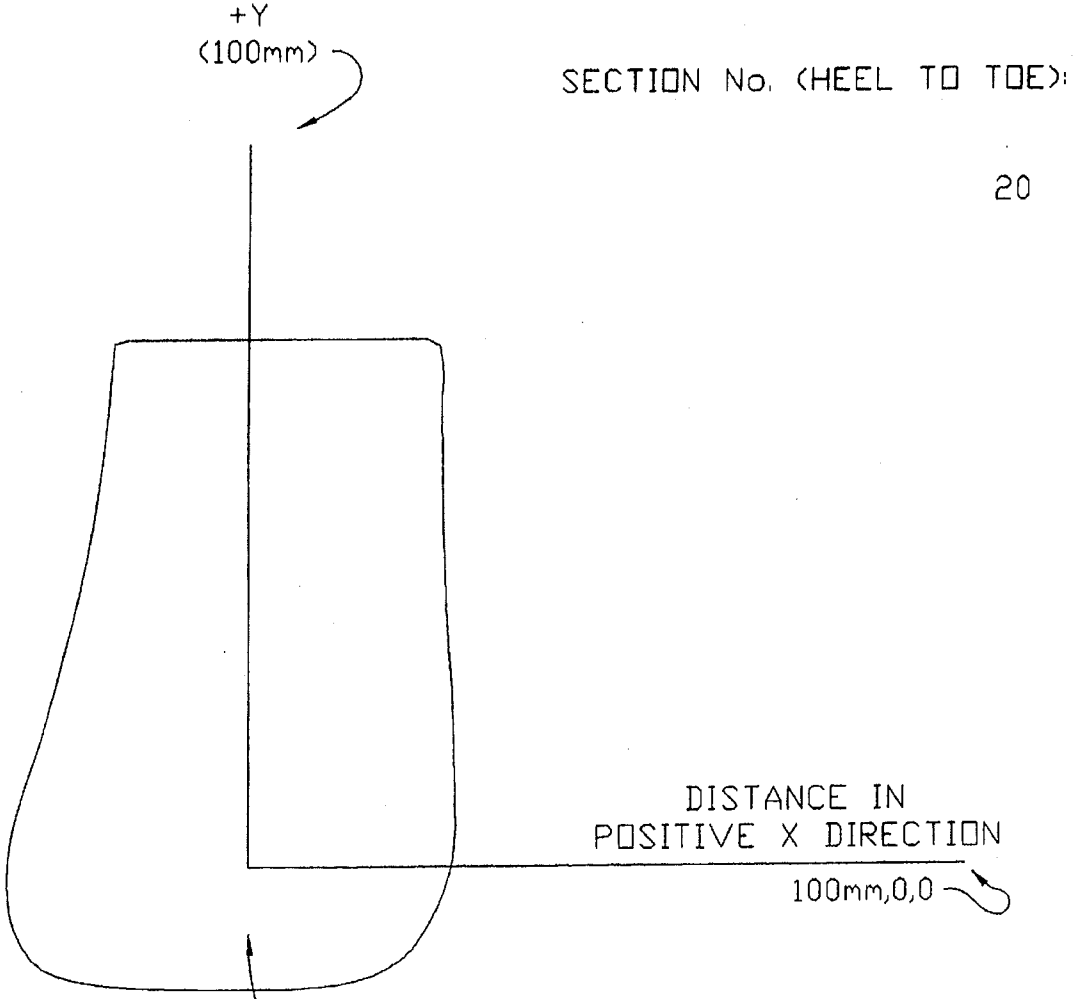
Figure 33:
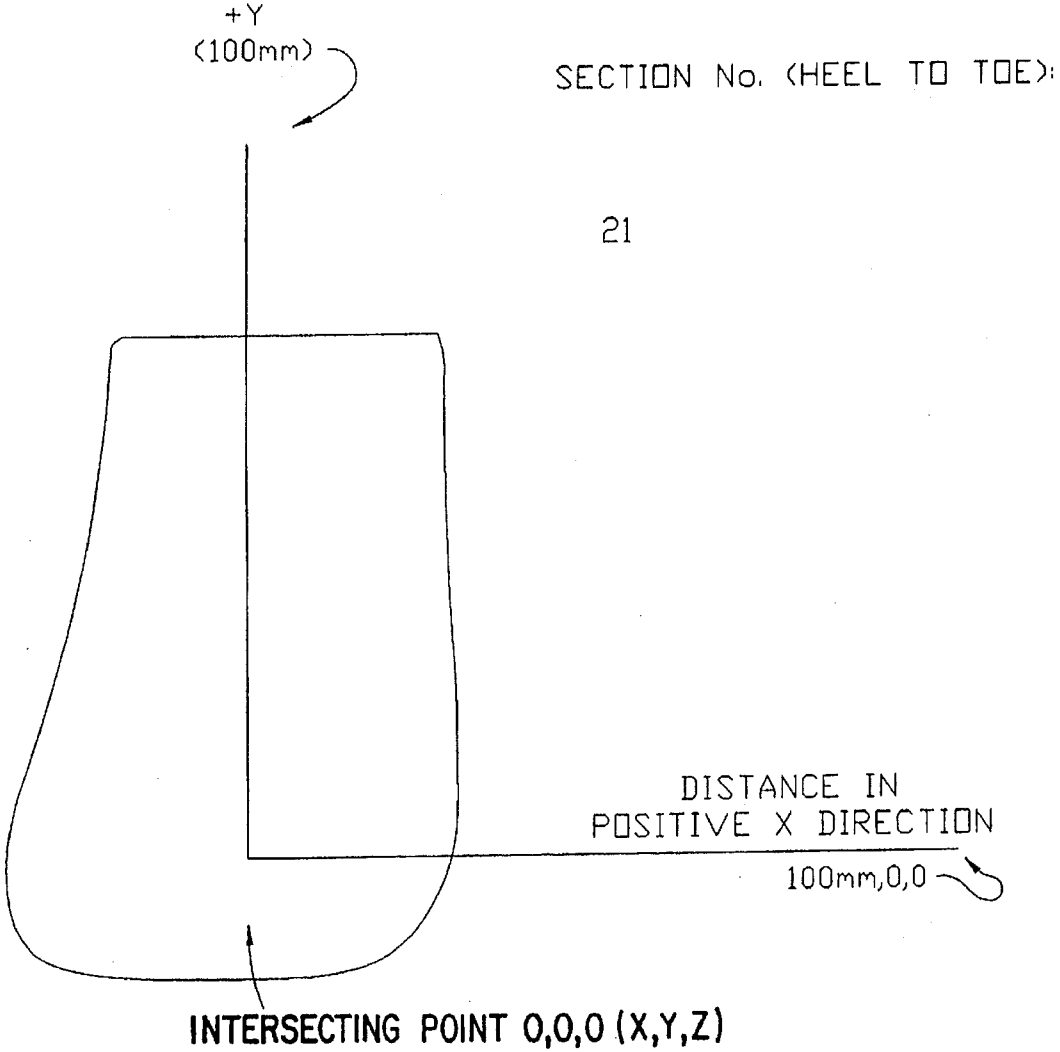
Figure 34:
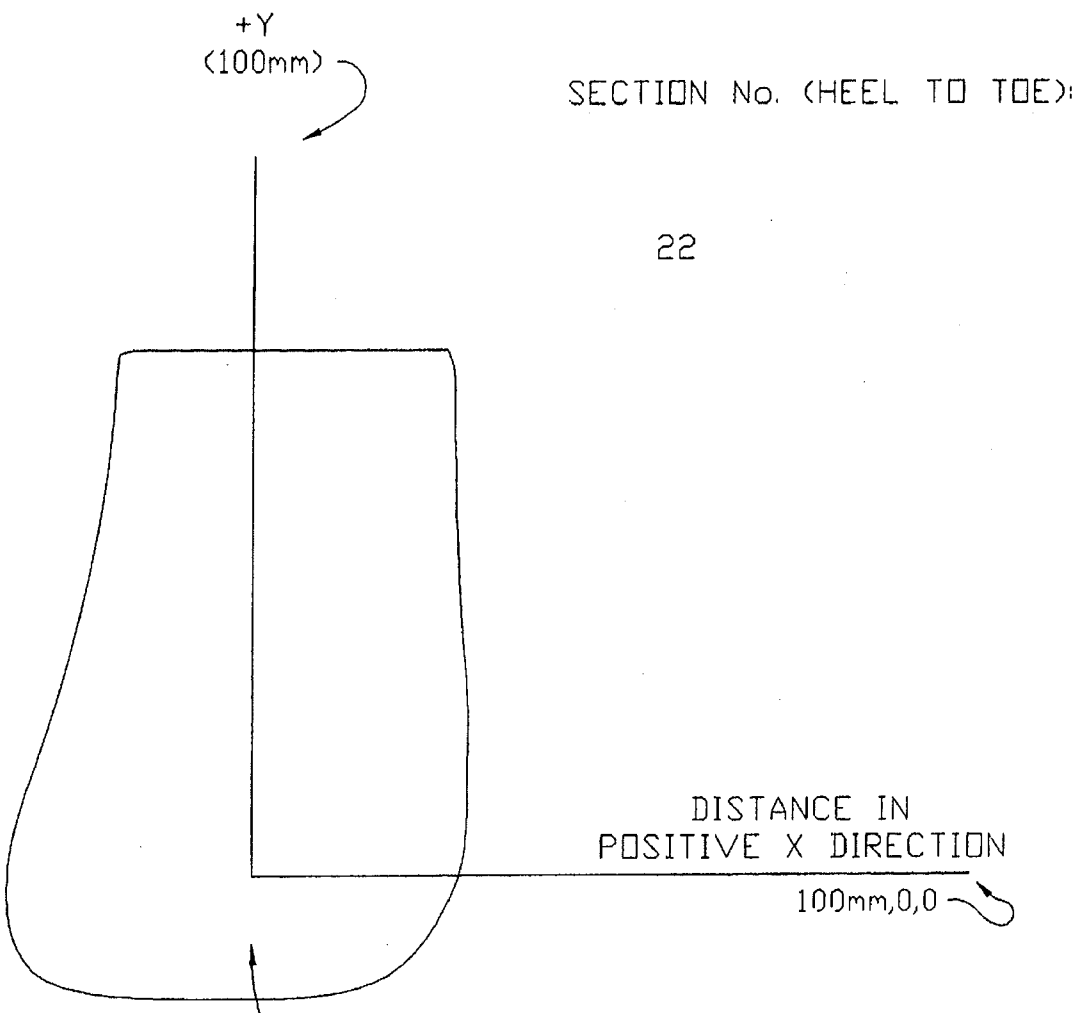
Figure 35:
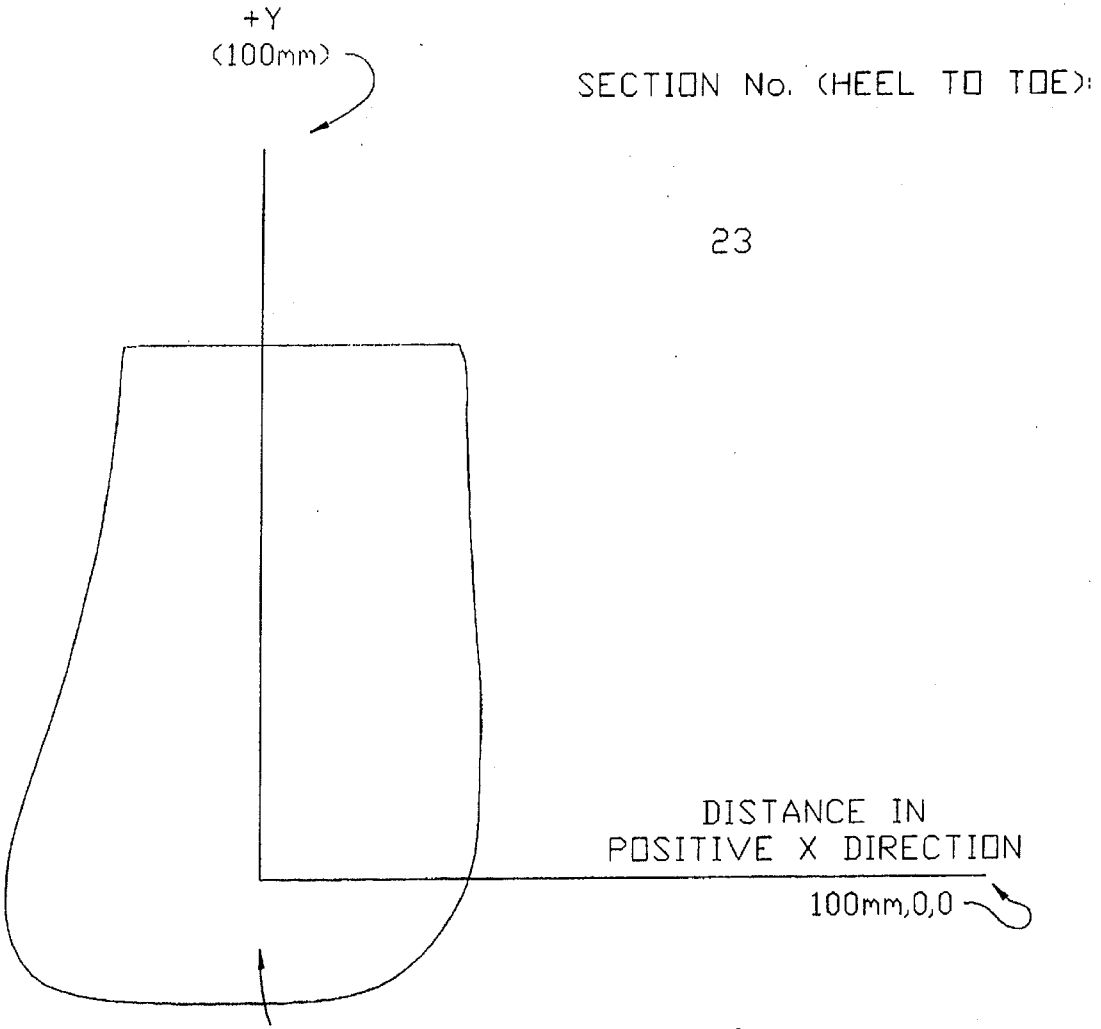
Figure 36:
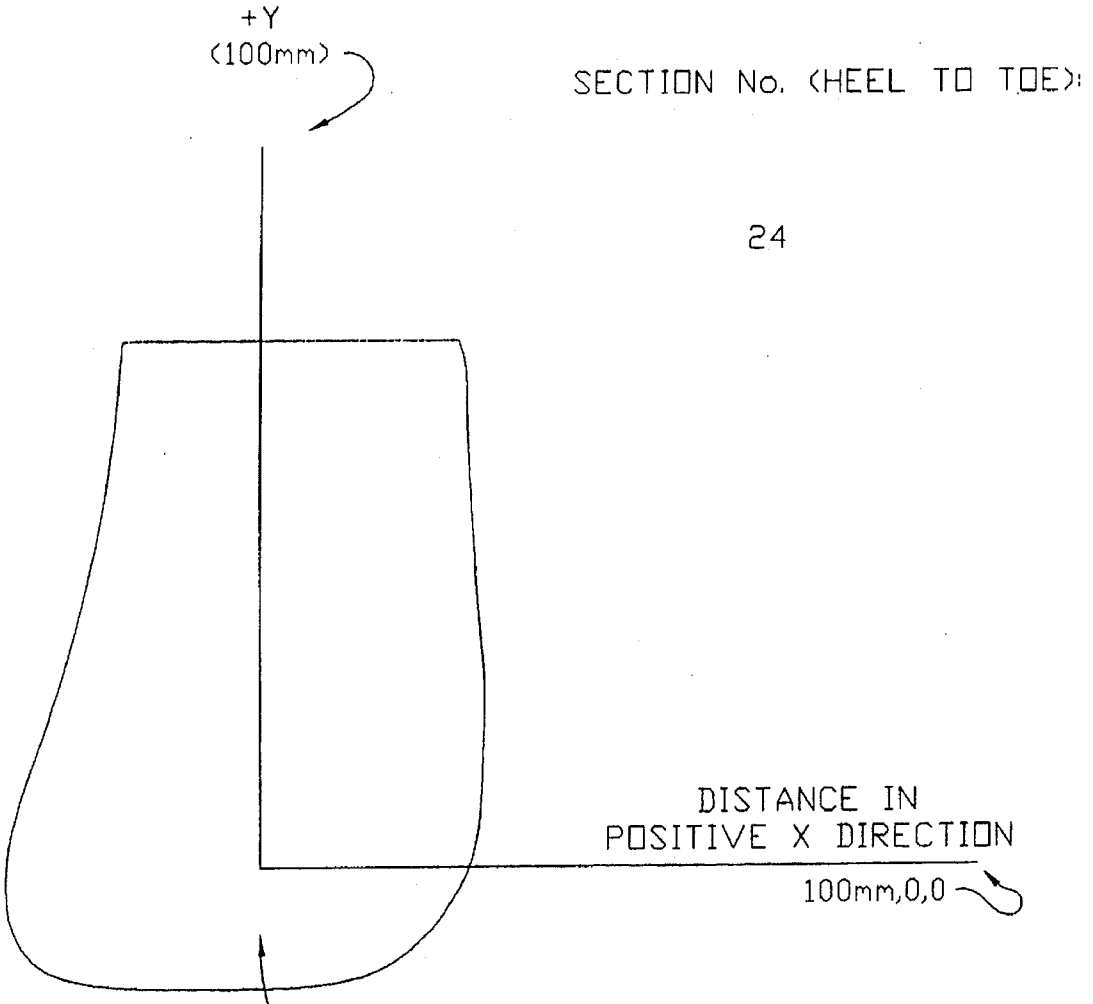
Figure 37:
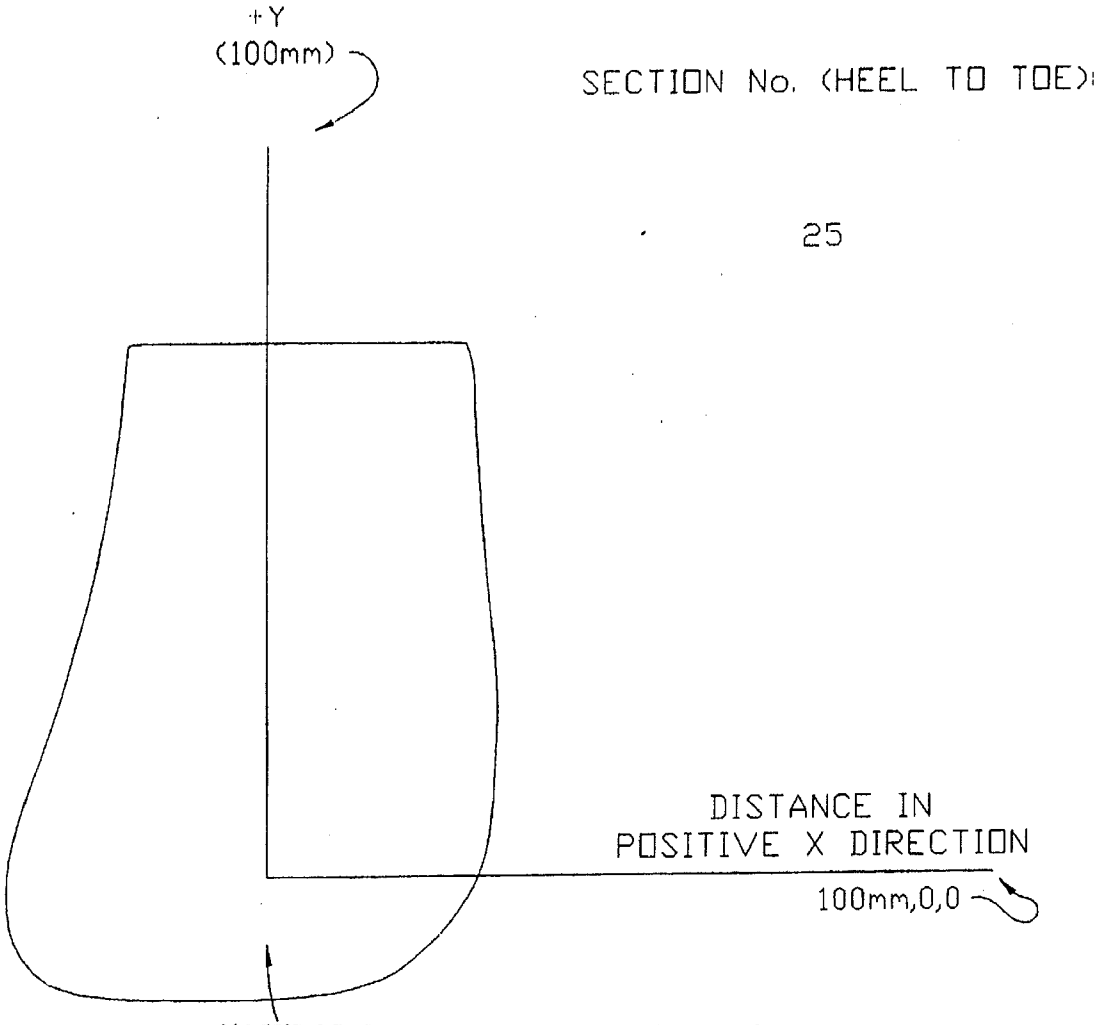
Figure 38:
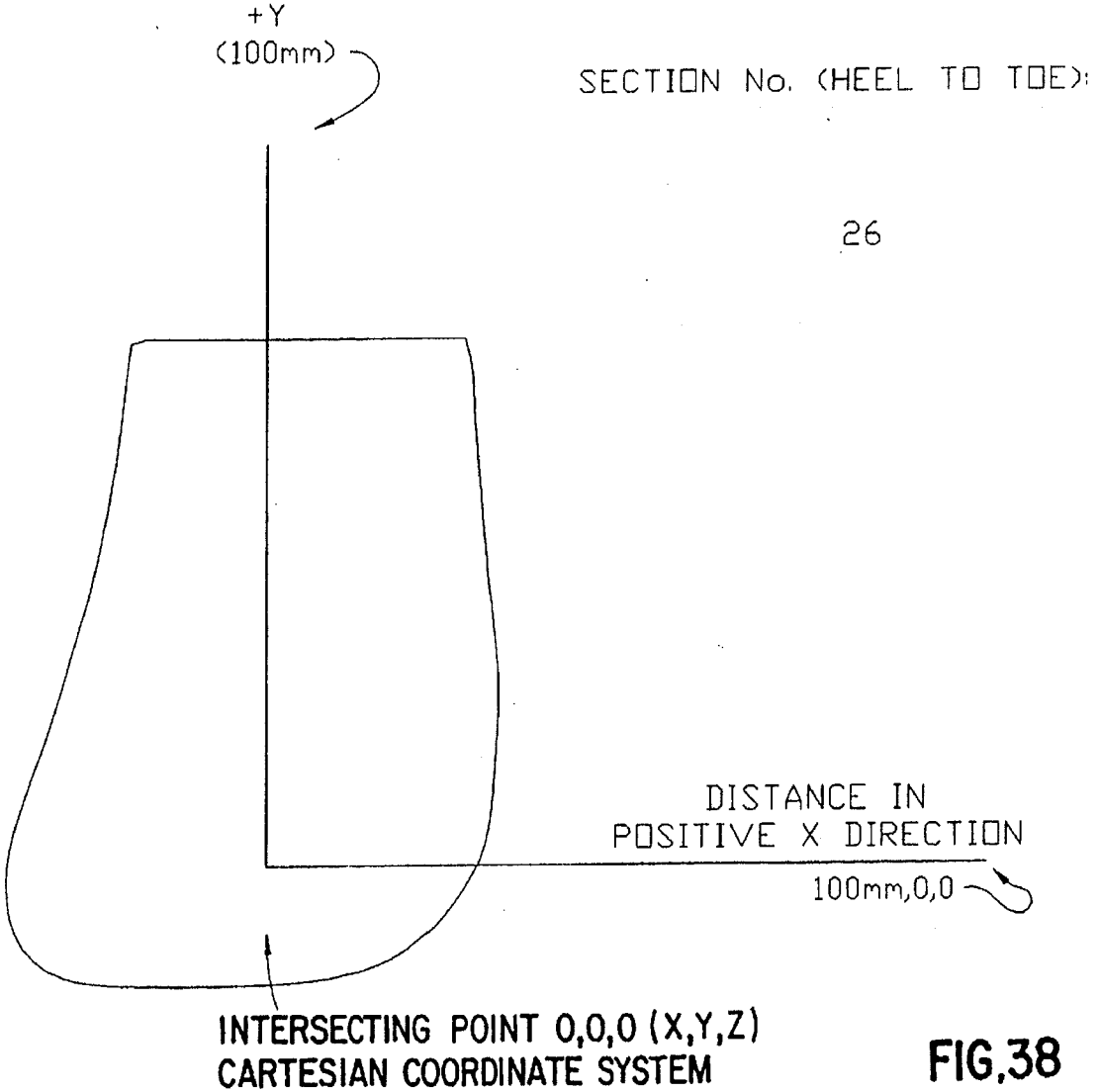
Figure 39:
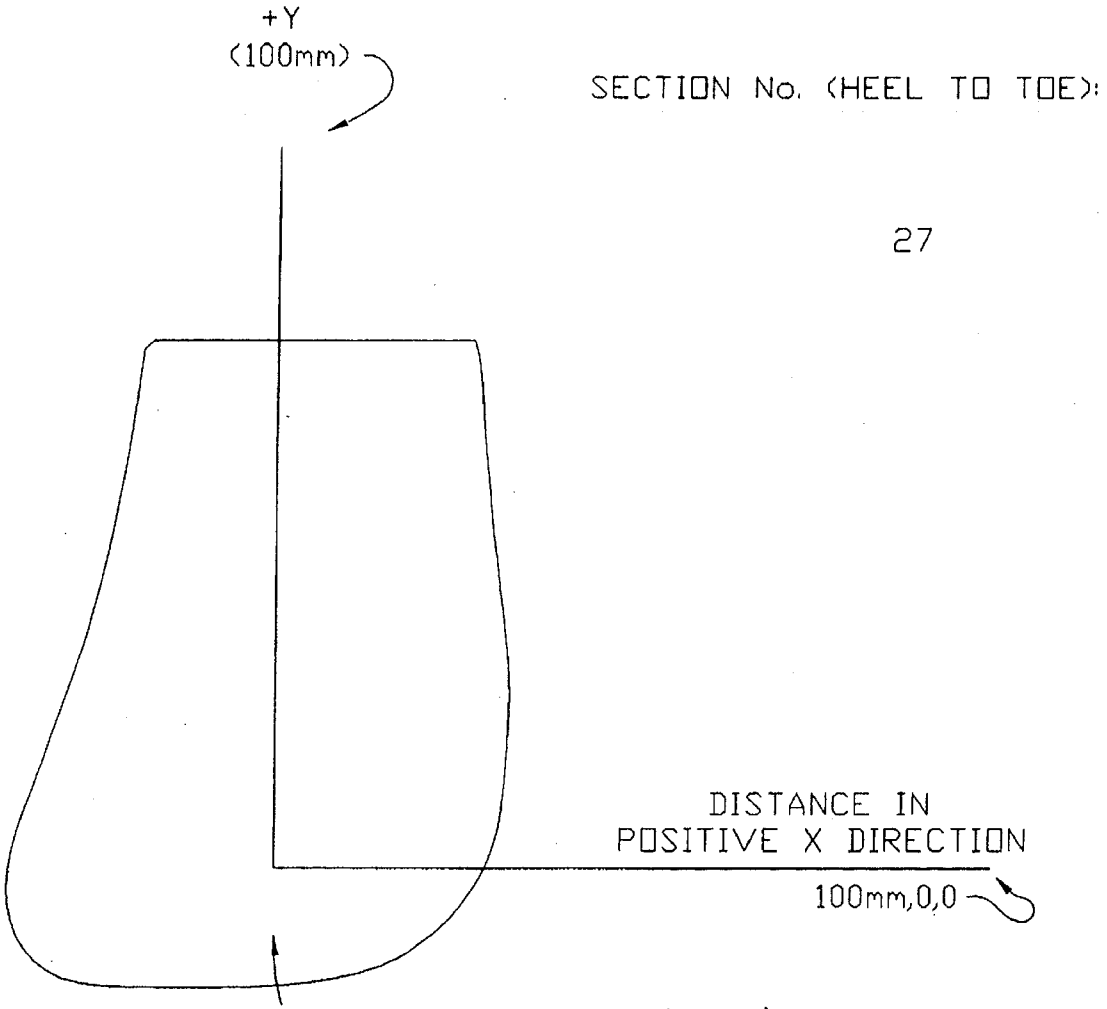
Figure 40:
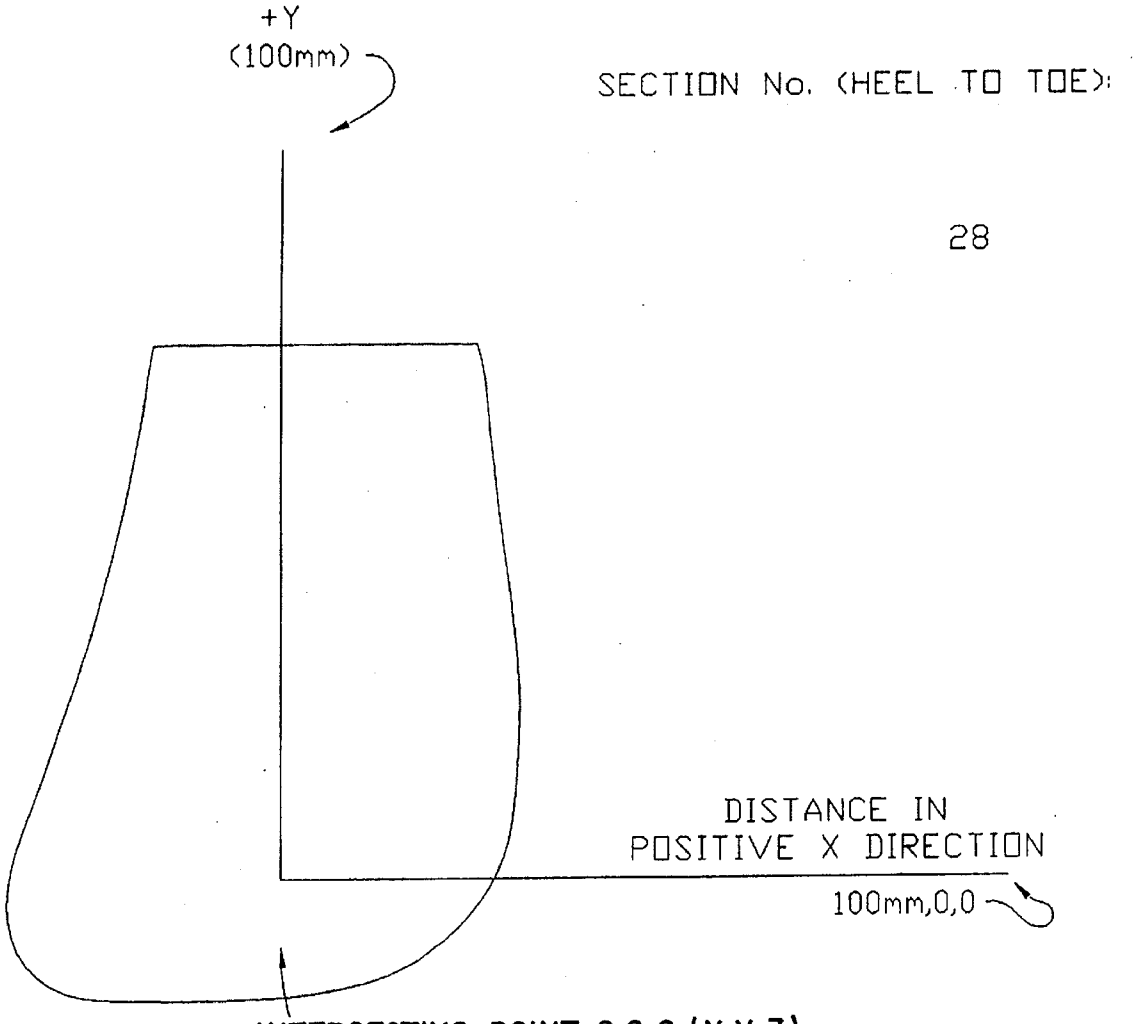
Figure 41:
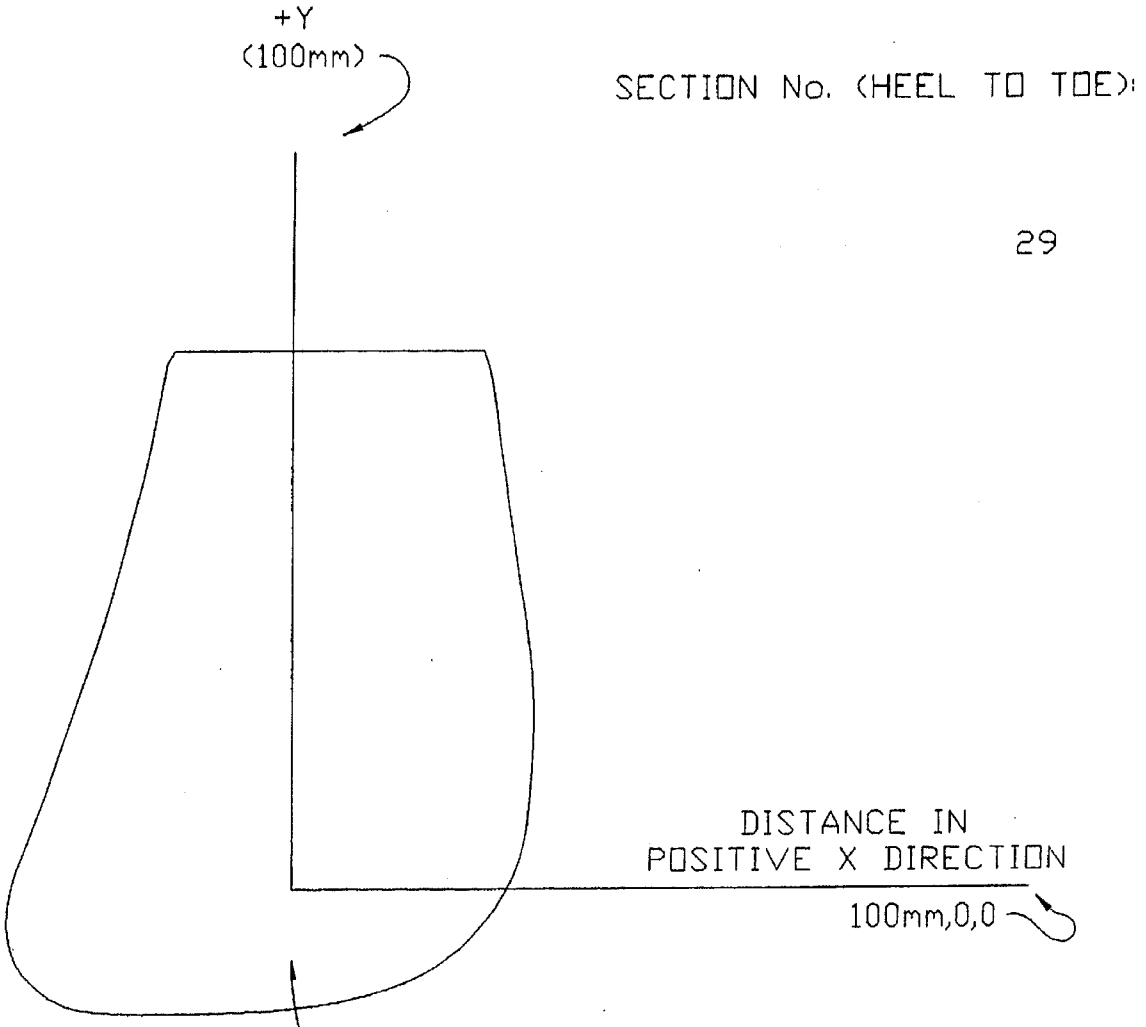
Figure 42:
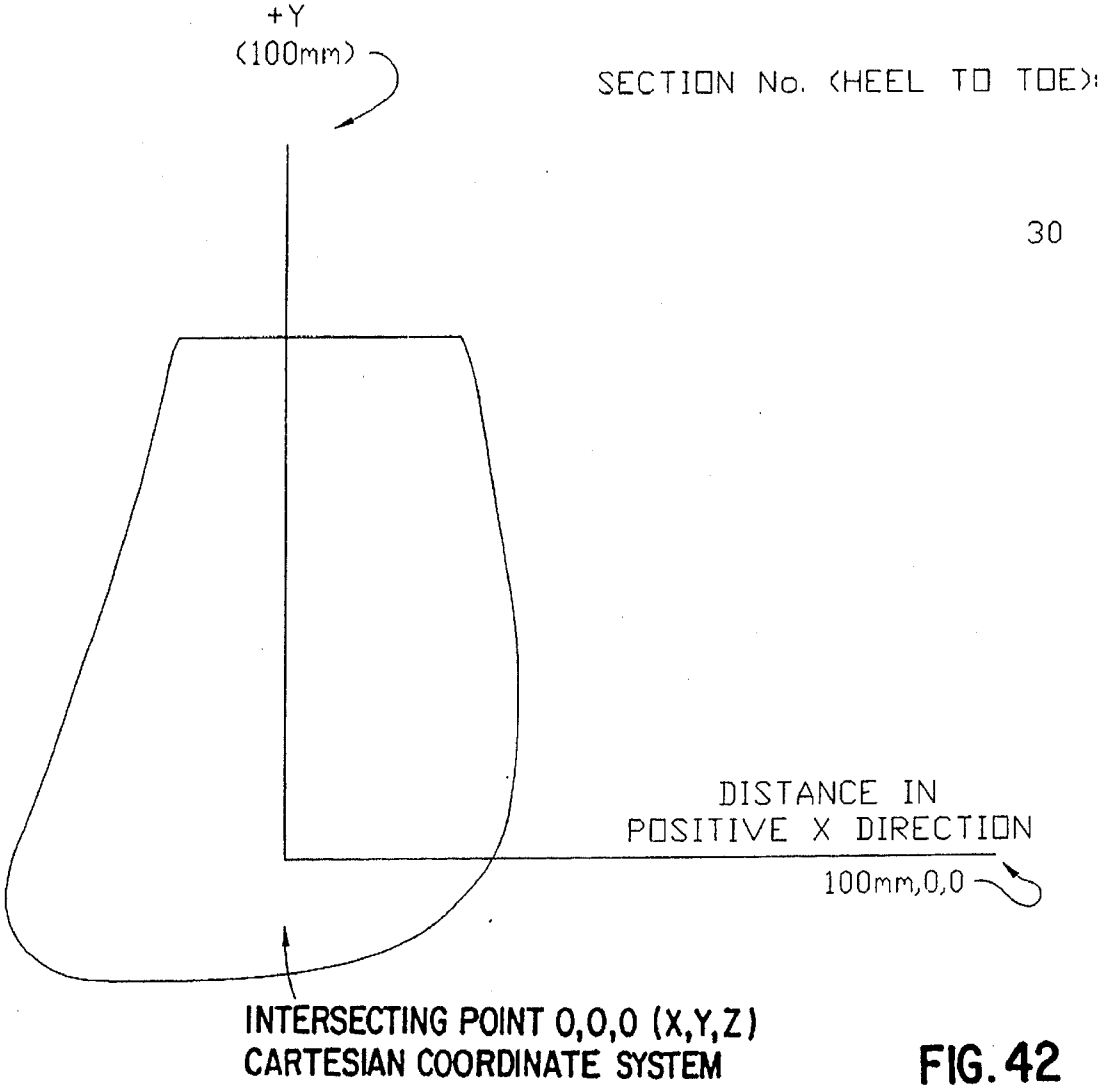
Figure 43:
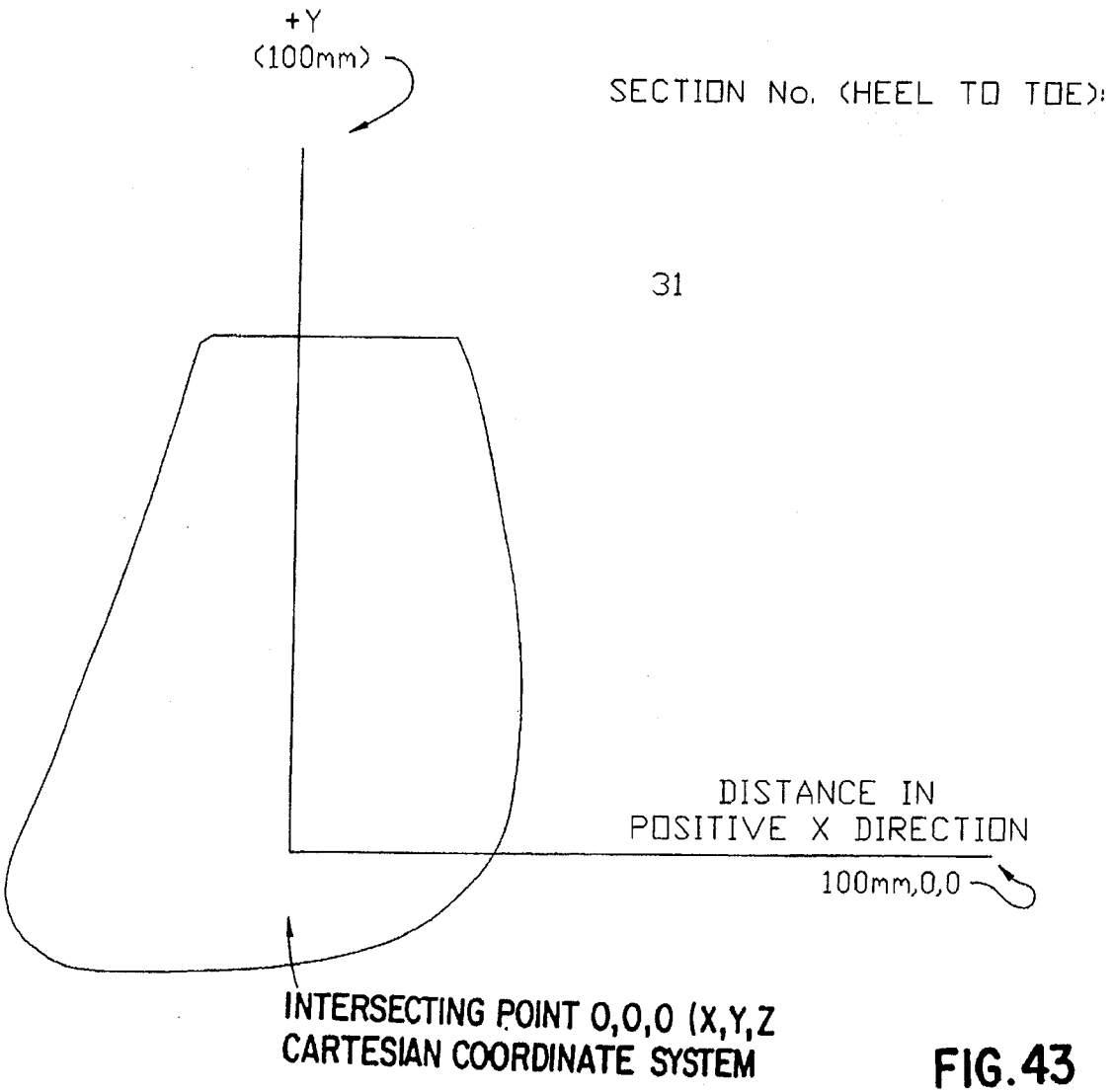
Figure 44:
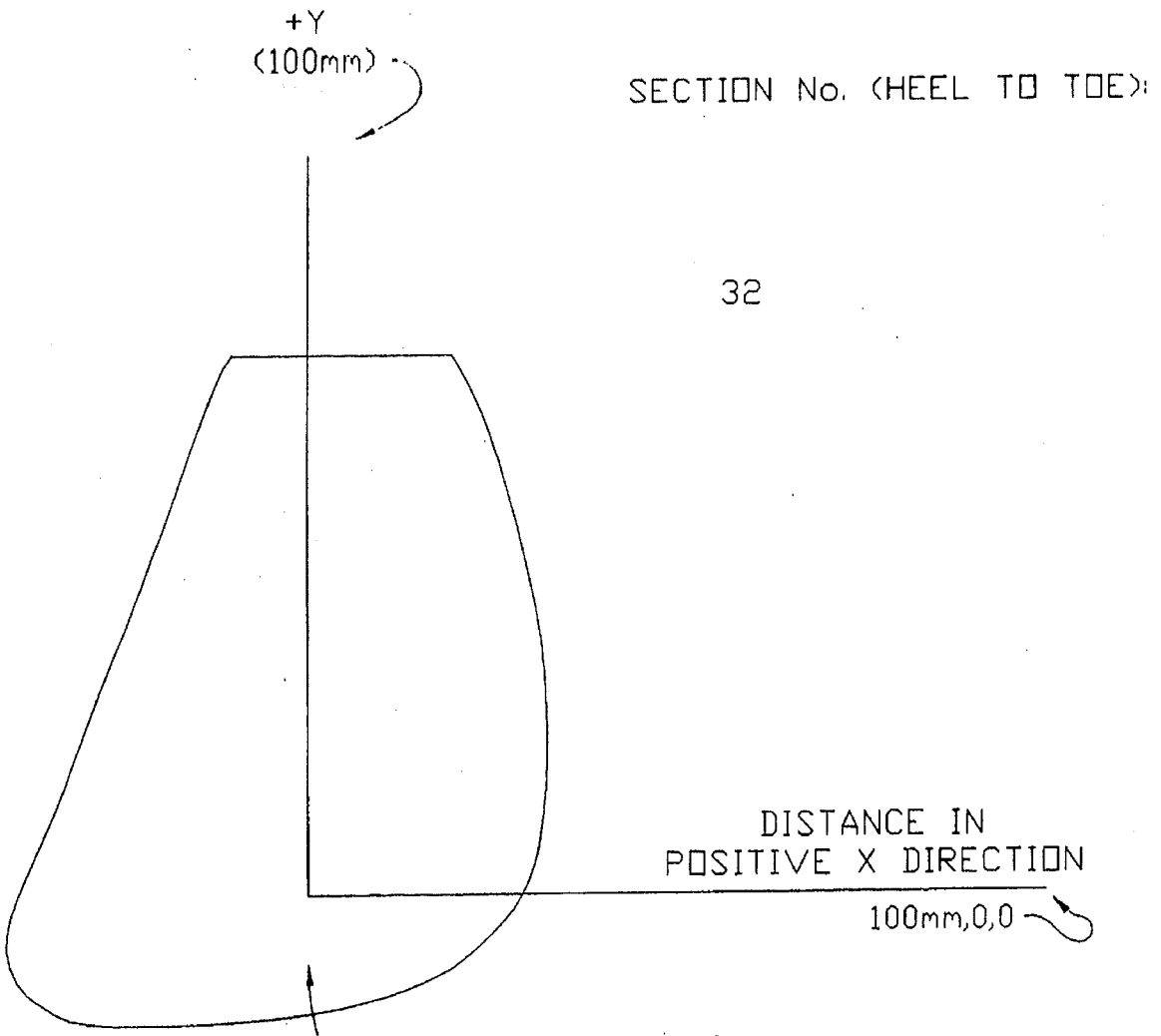
Figure 45:
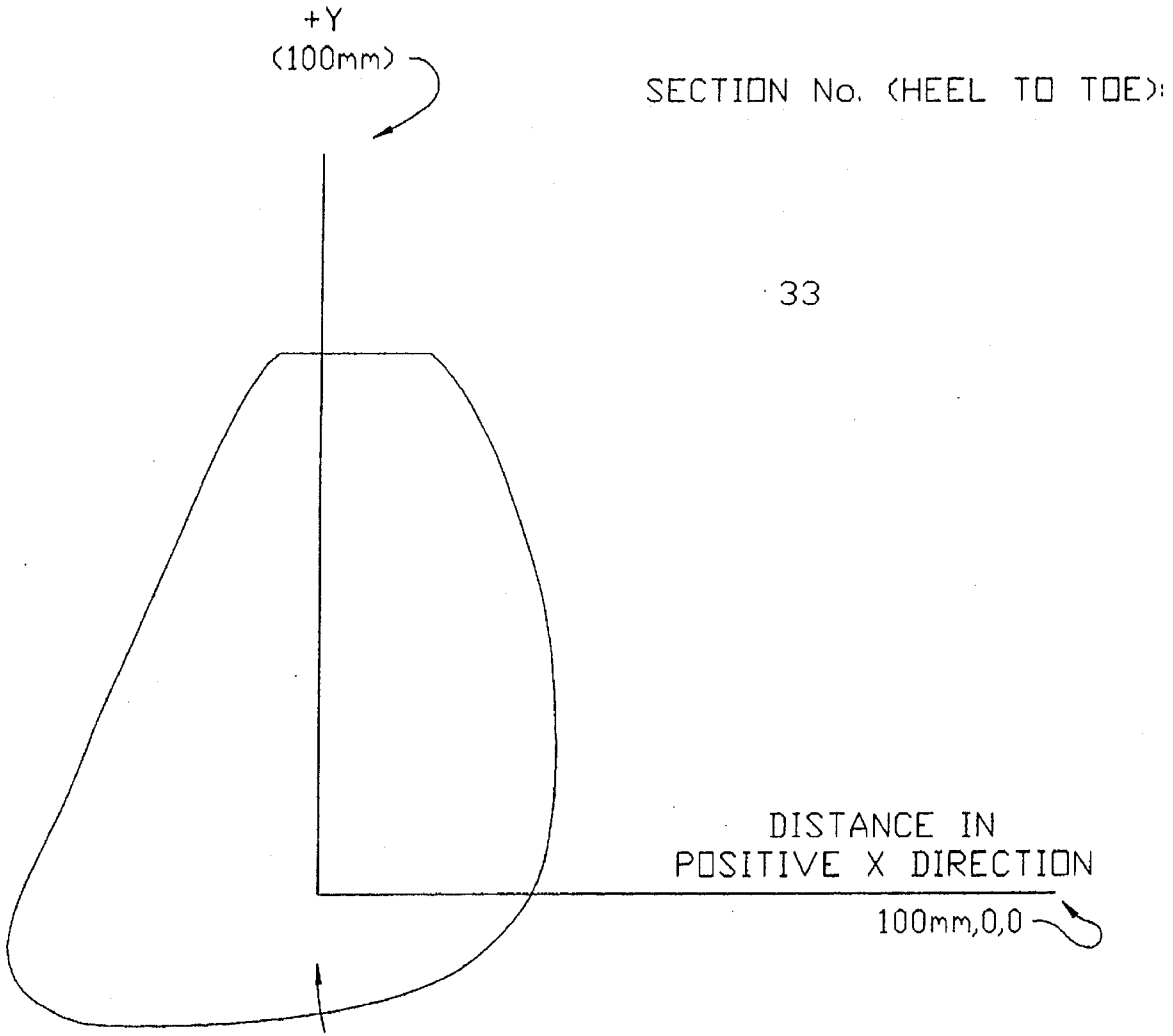
Figure 46:
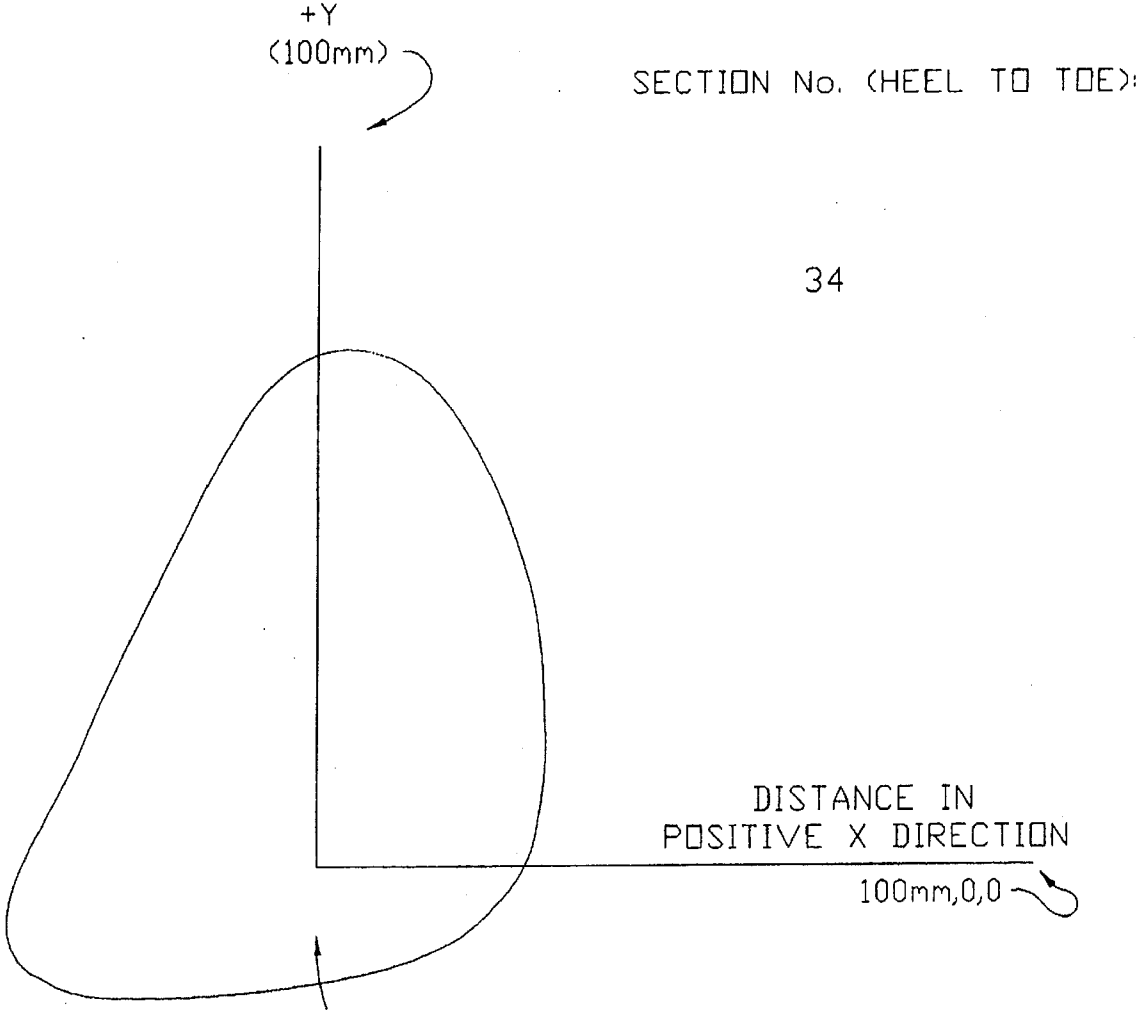
Figure 47:
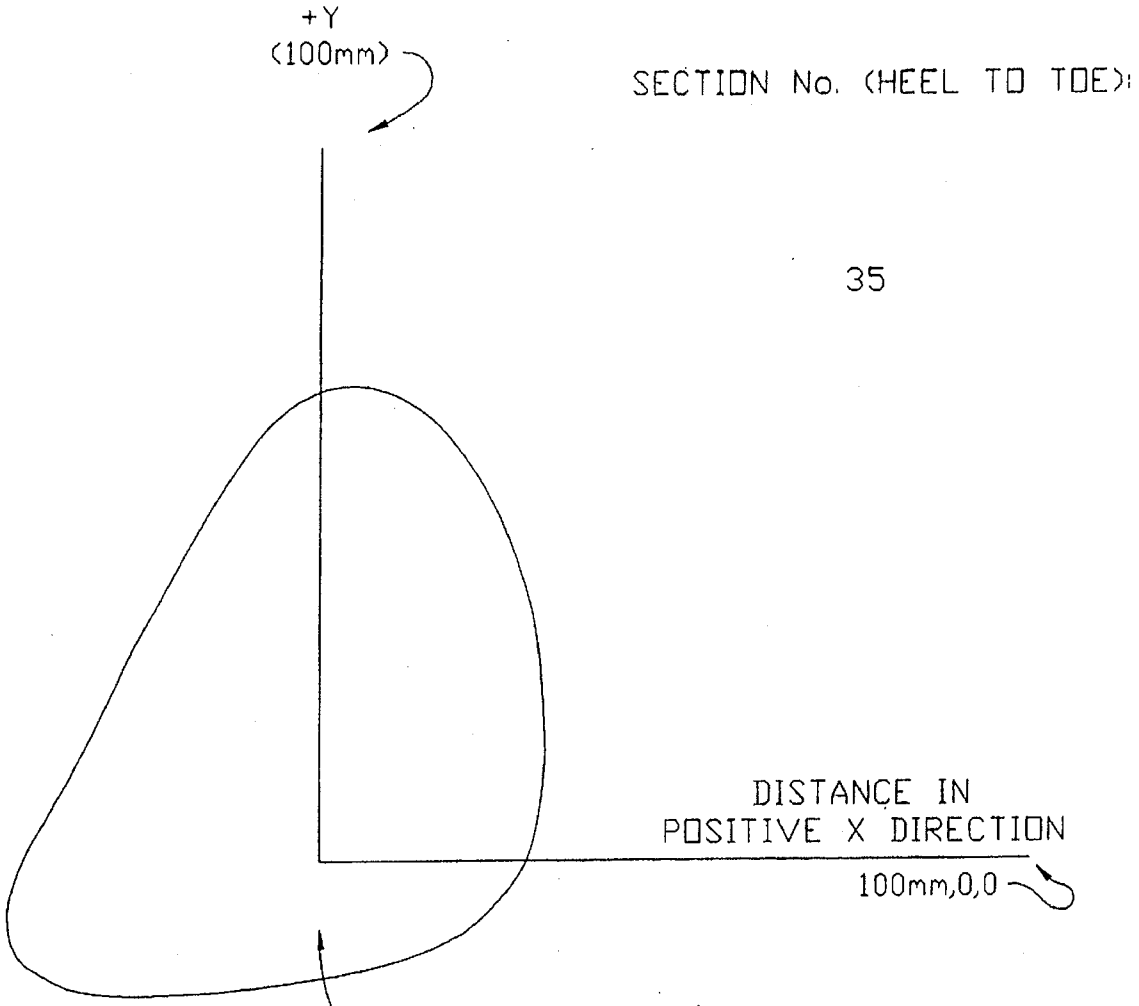
Figure 48:
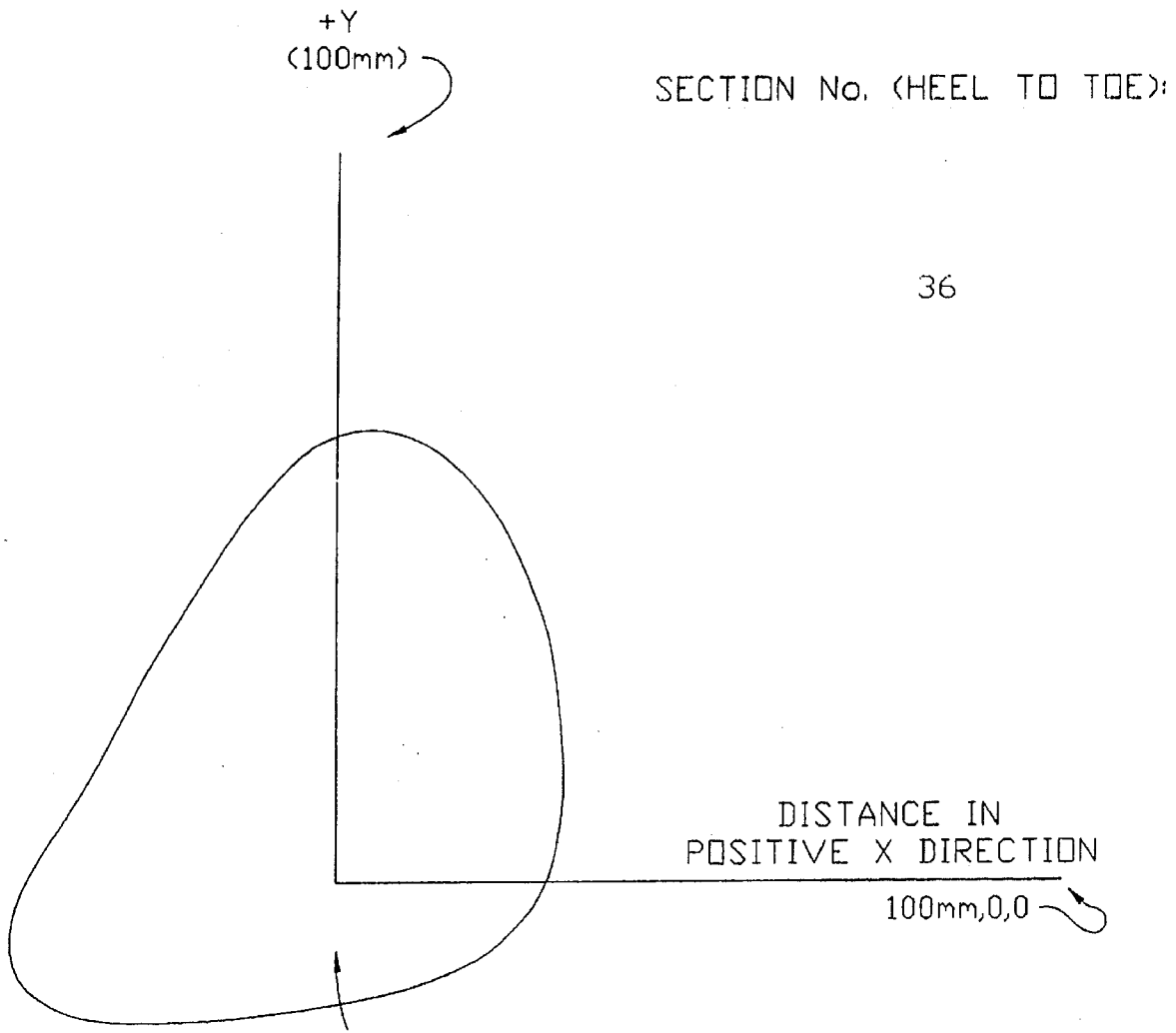
Figure 49:
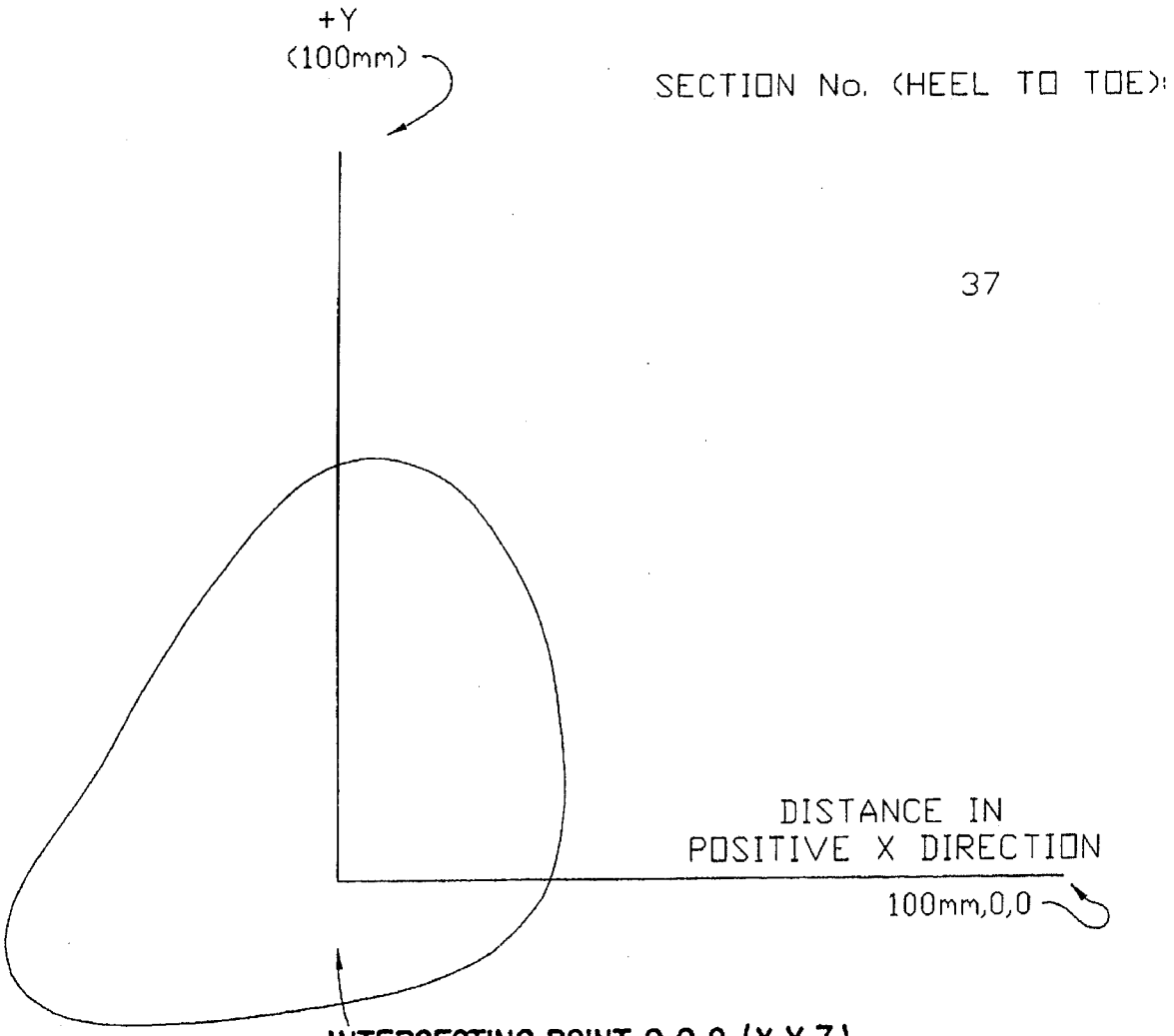
Figure 50:
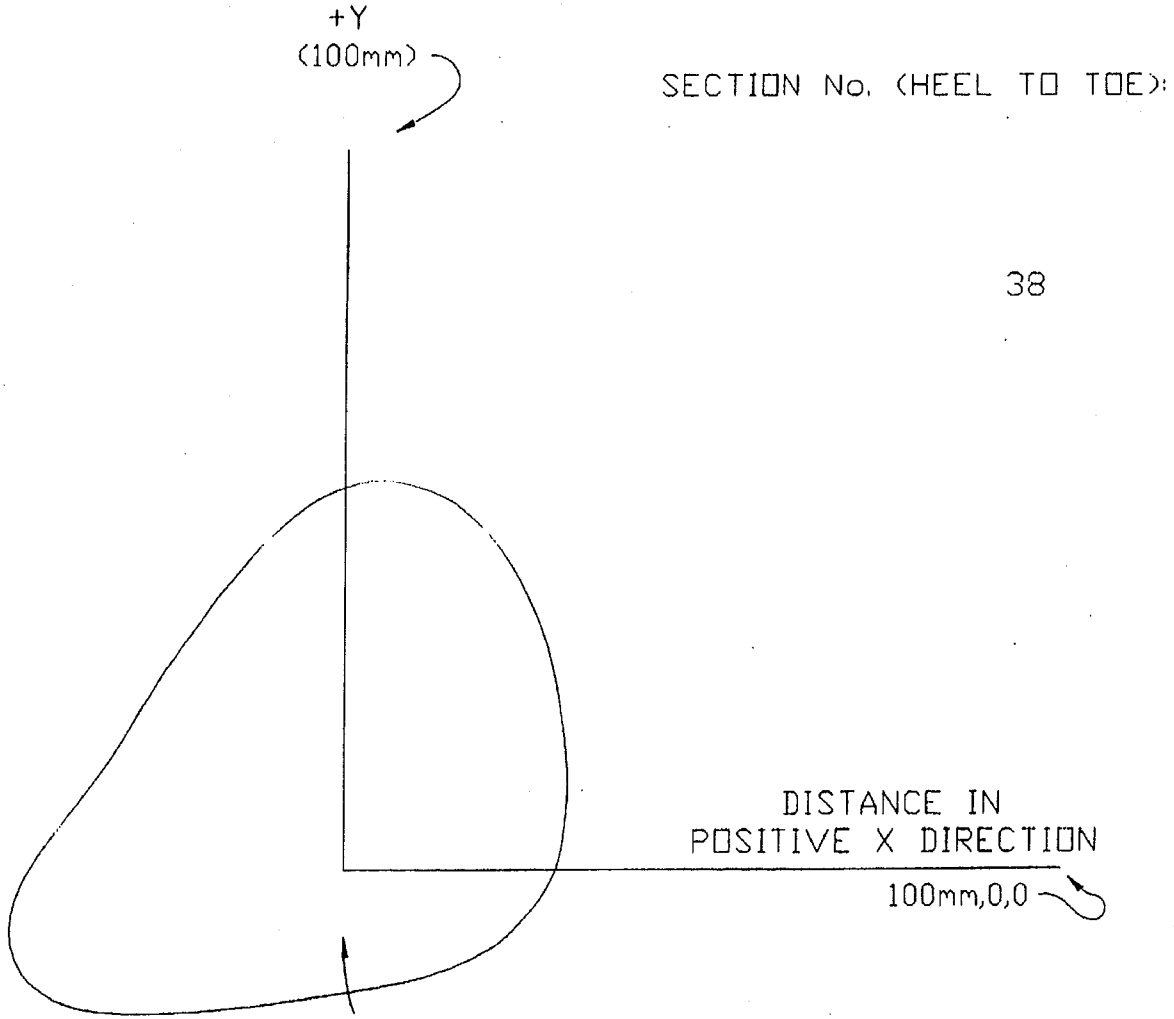
Figure 51:
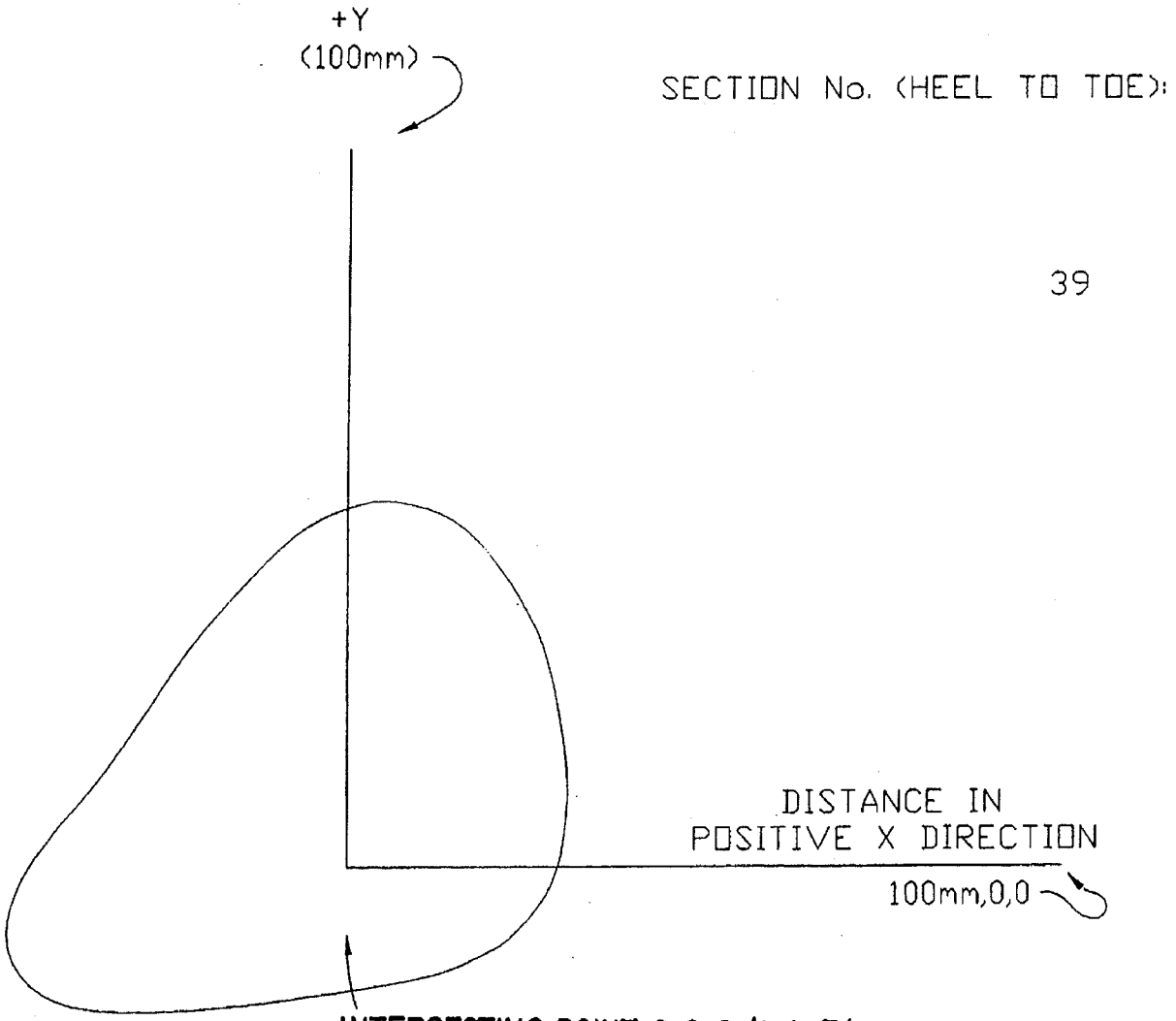
Figure 52:
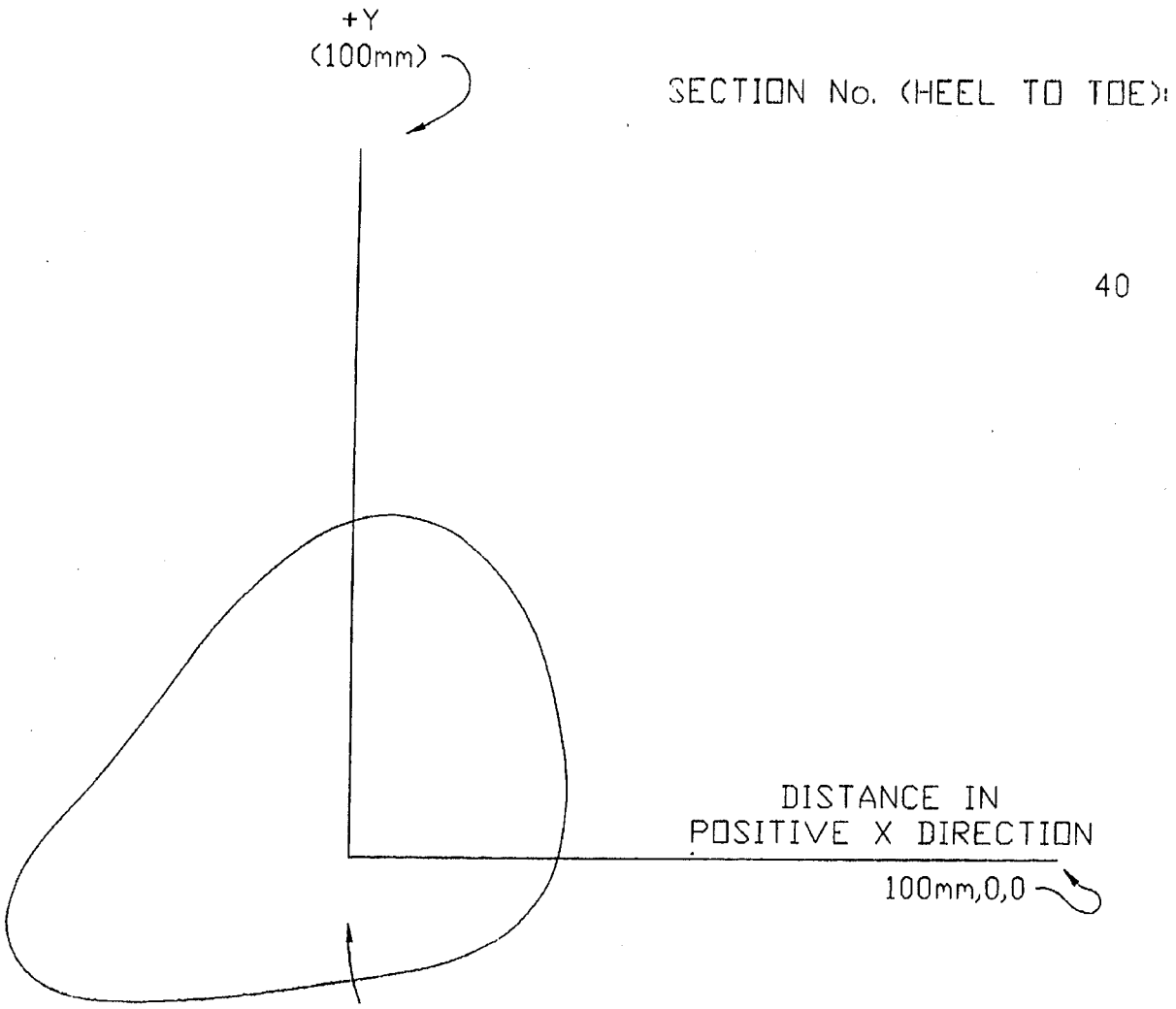
Figure 53:
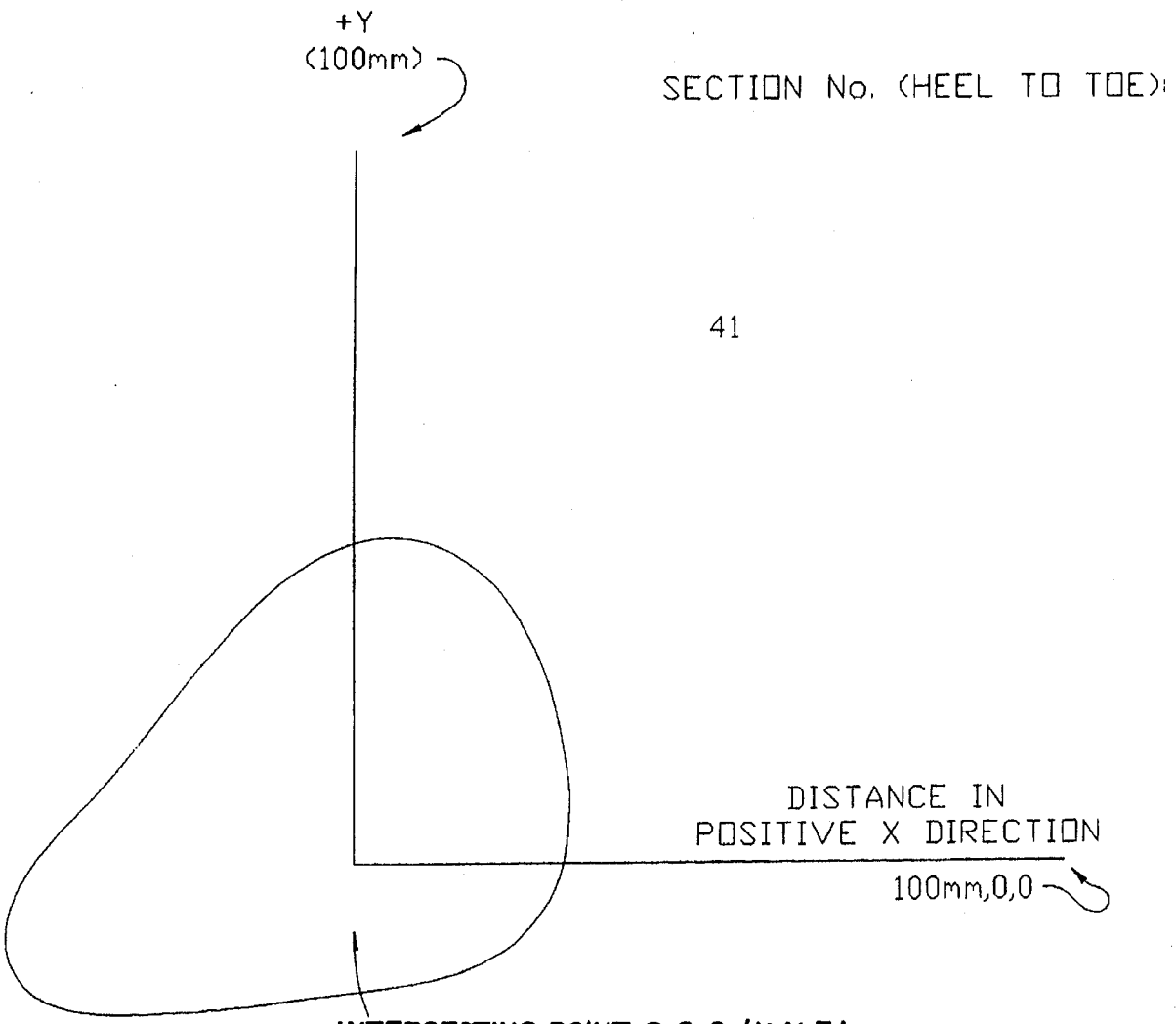
Figure 54:
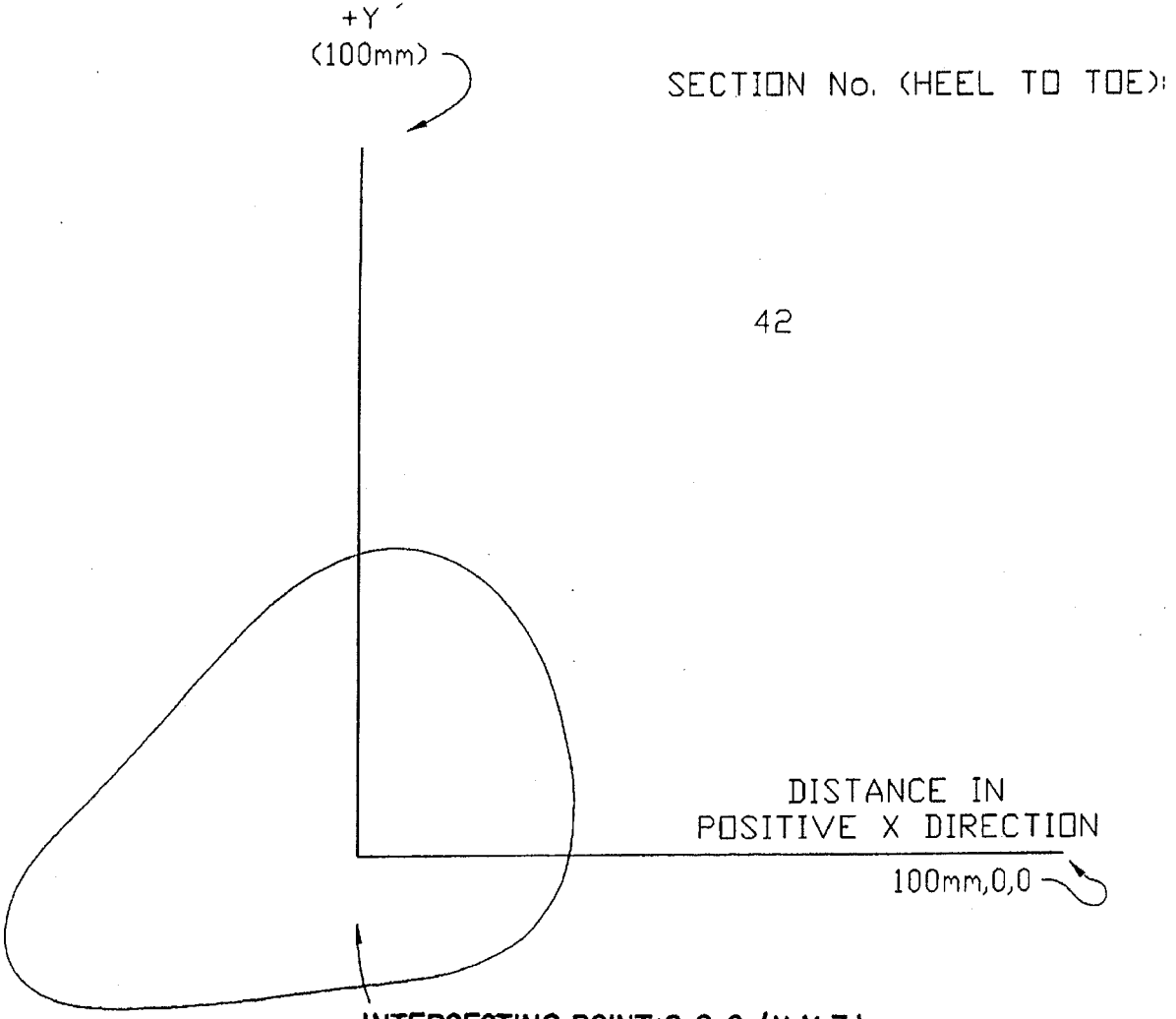
Figure 55:
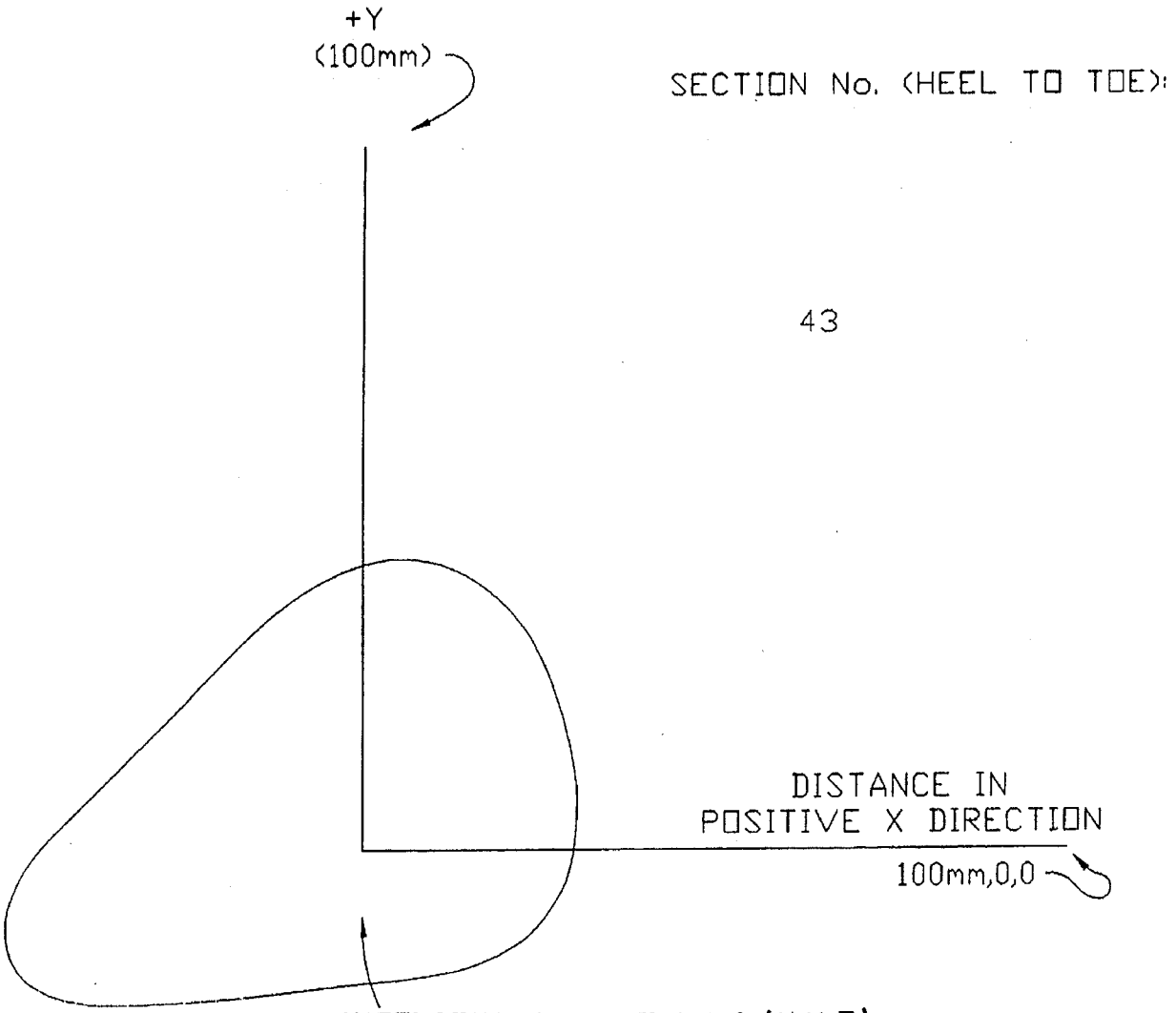
Figure 56:
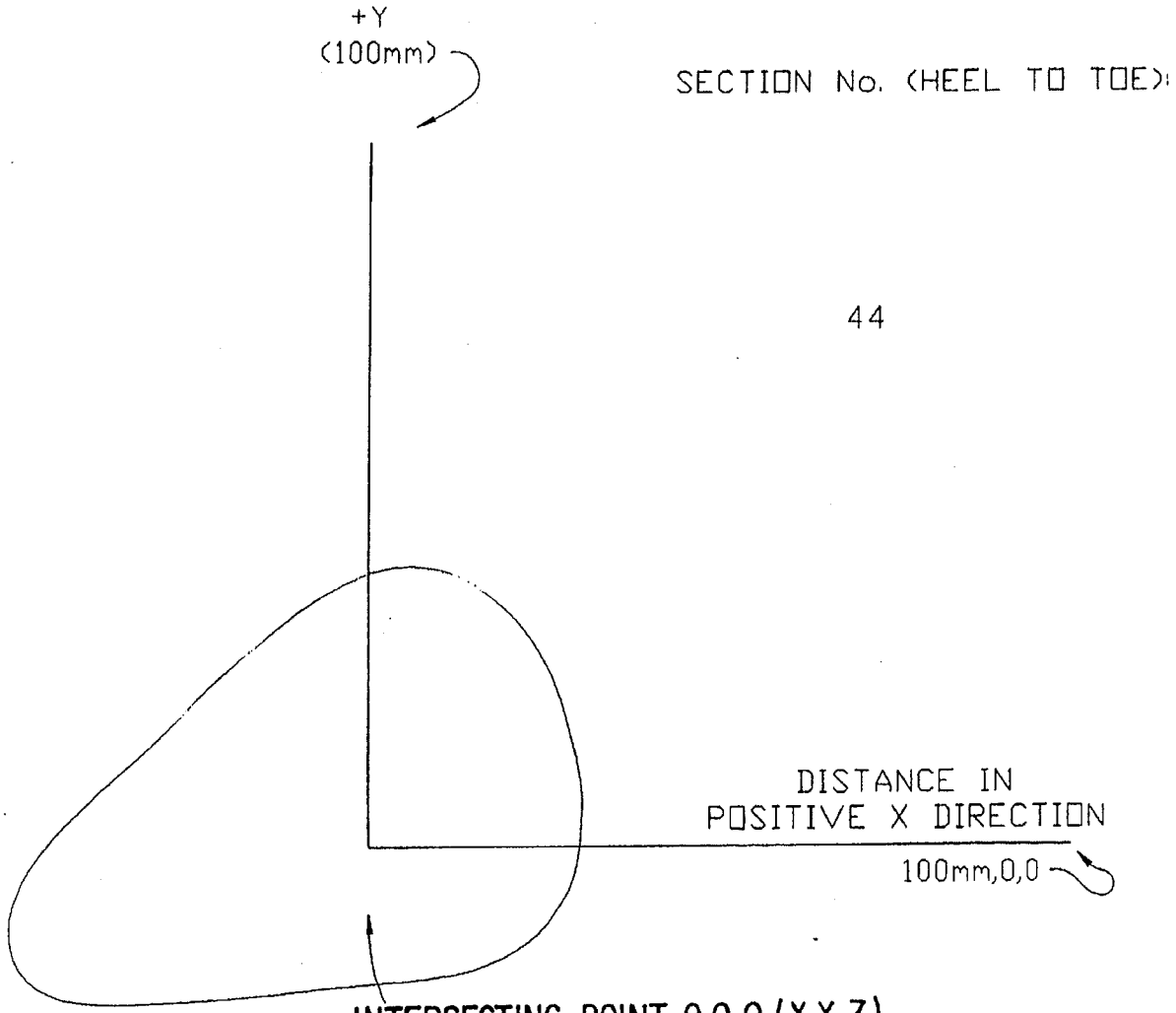
Figure 57:
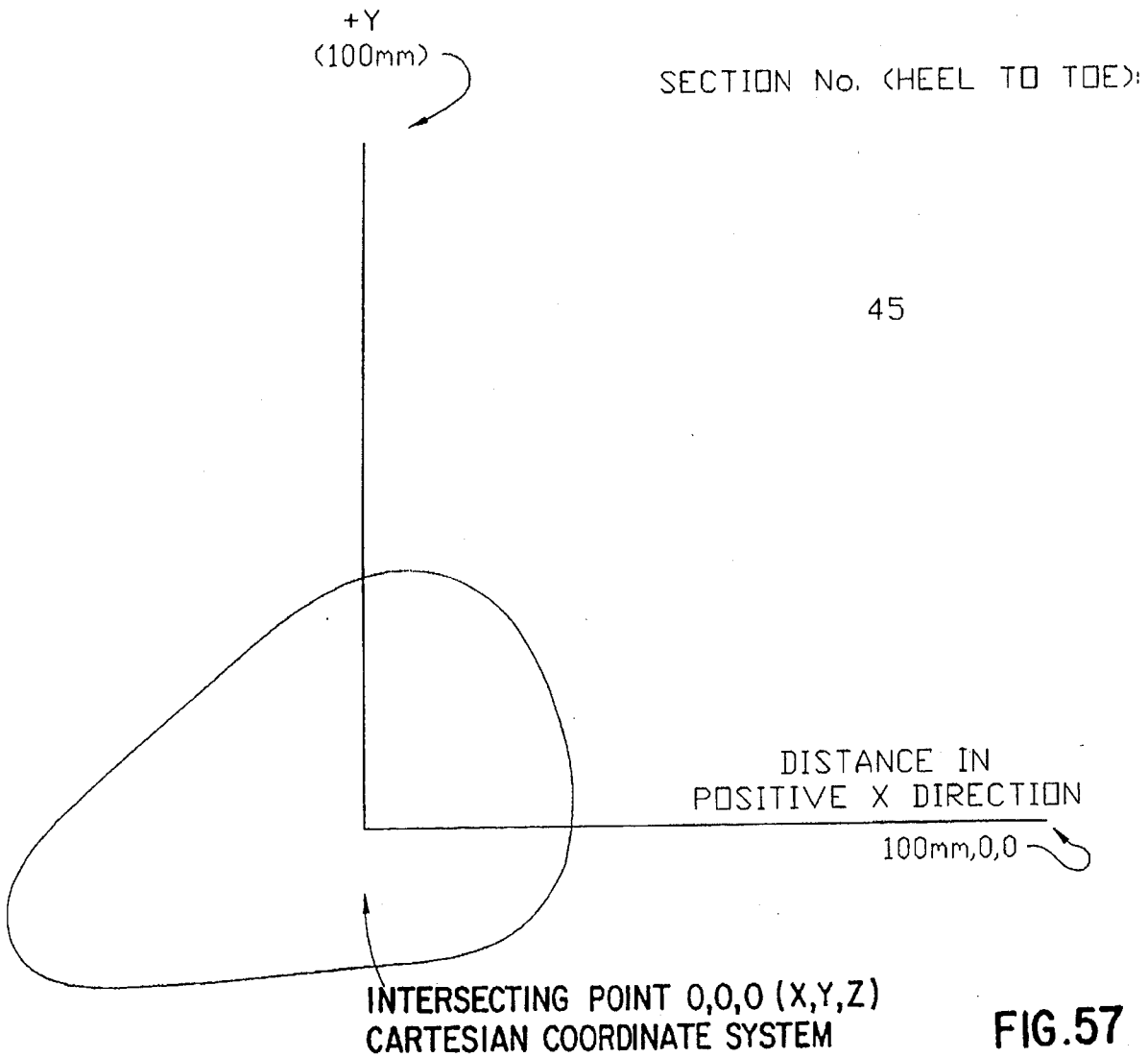
Figure 58:
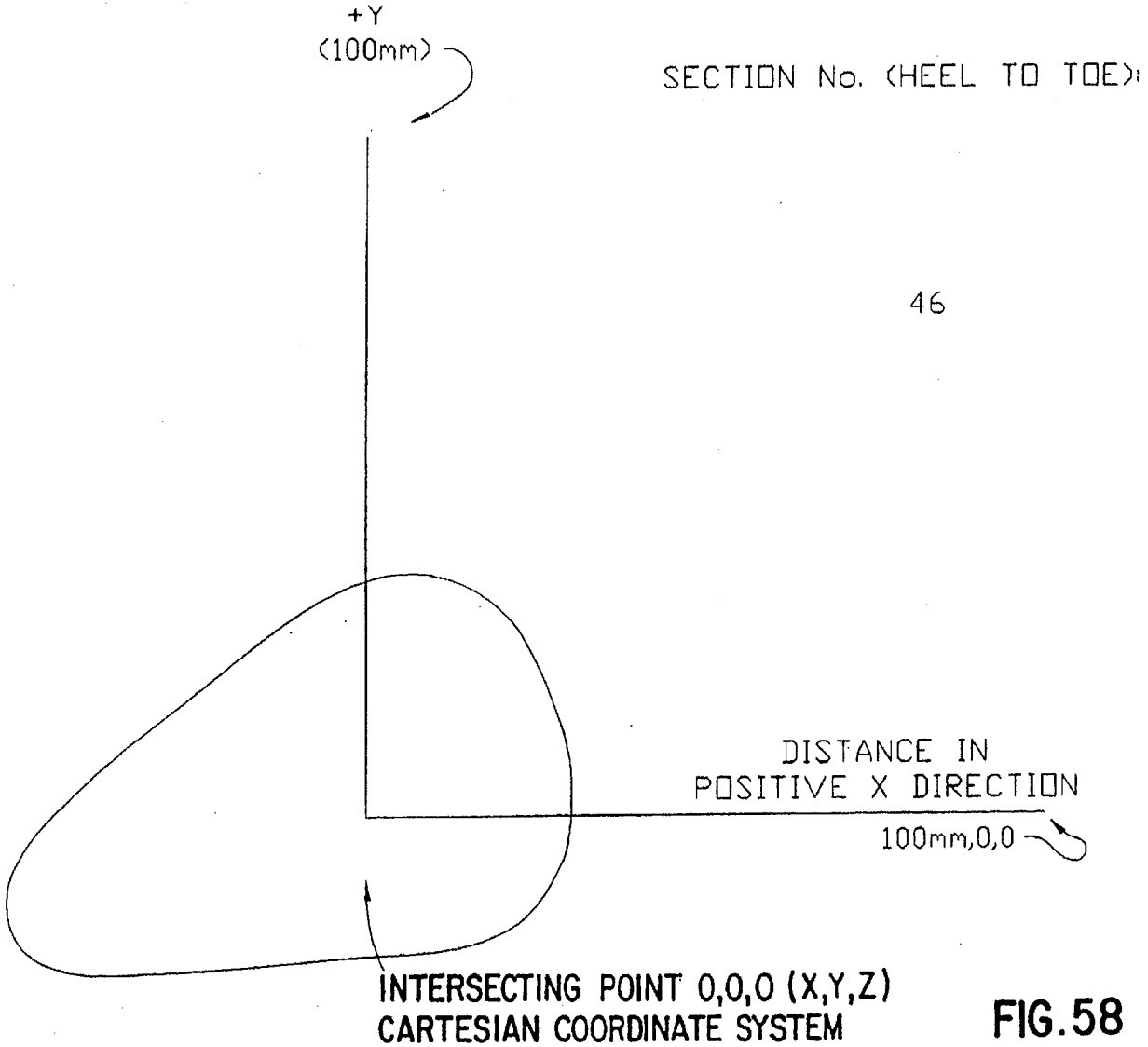
Figure 59:
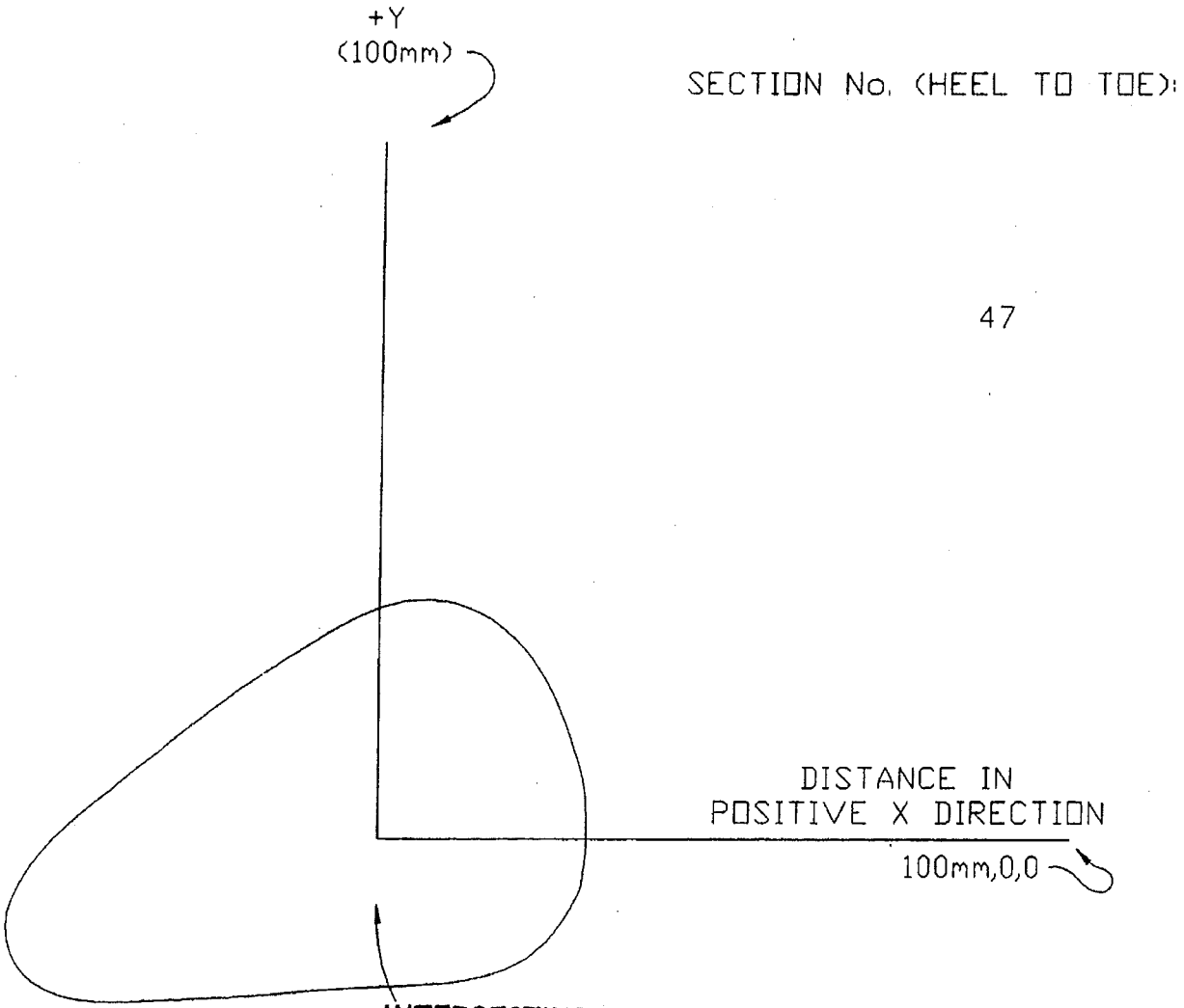
Figure 60:
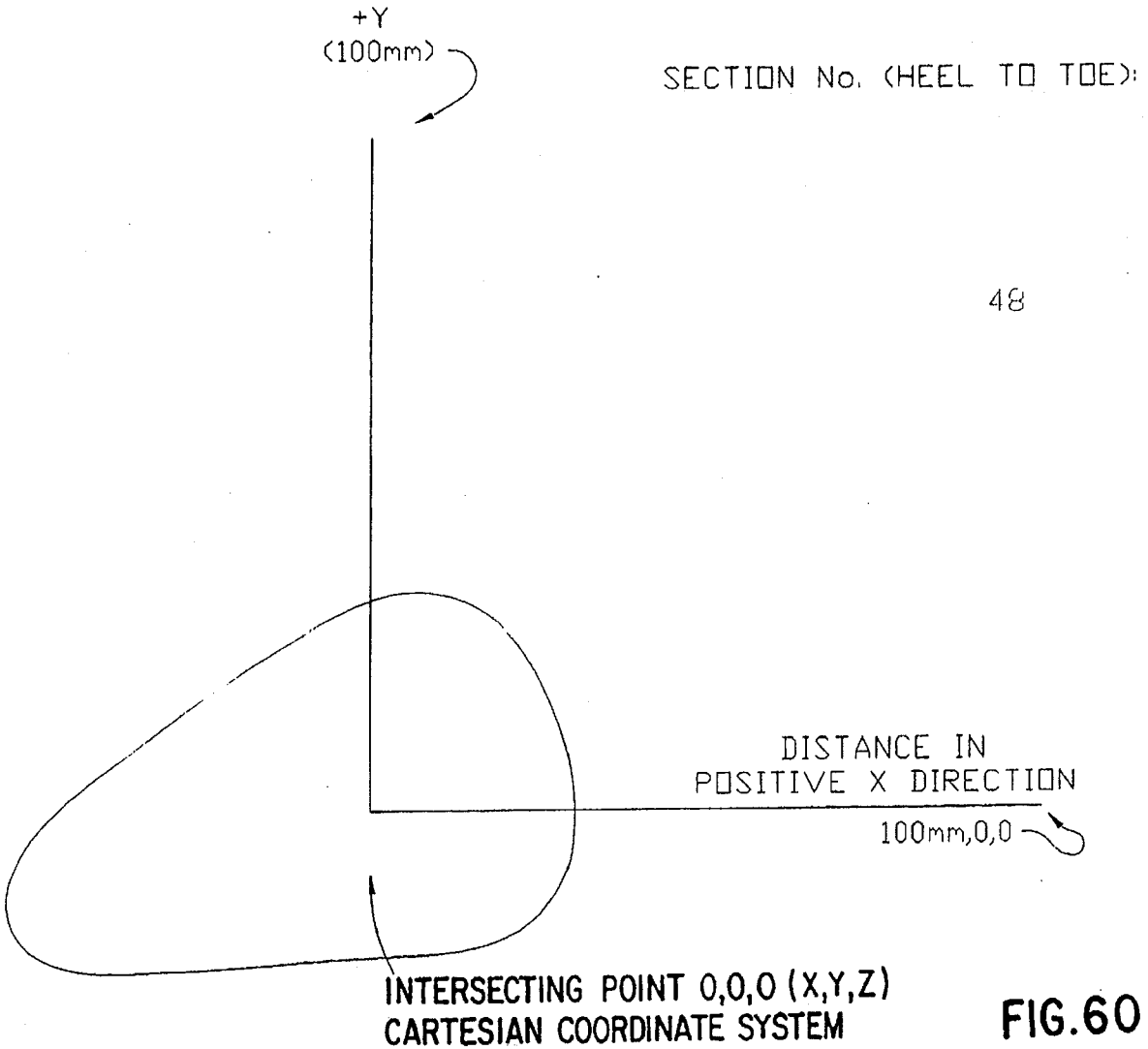
Figure 61:
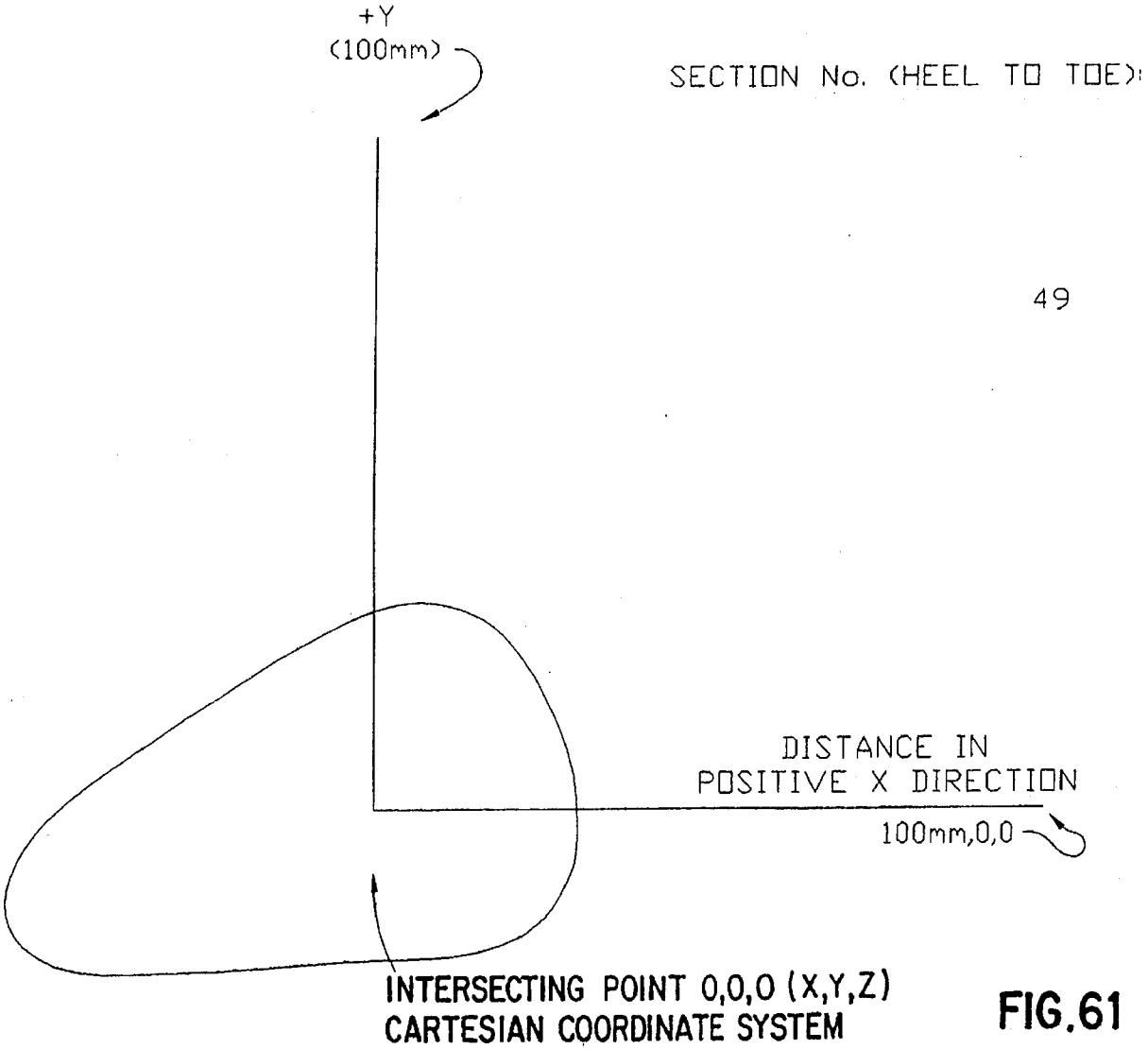
Figure 62:
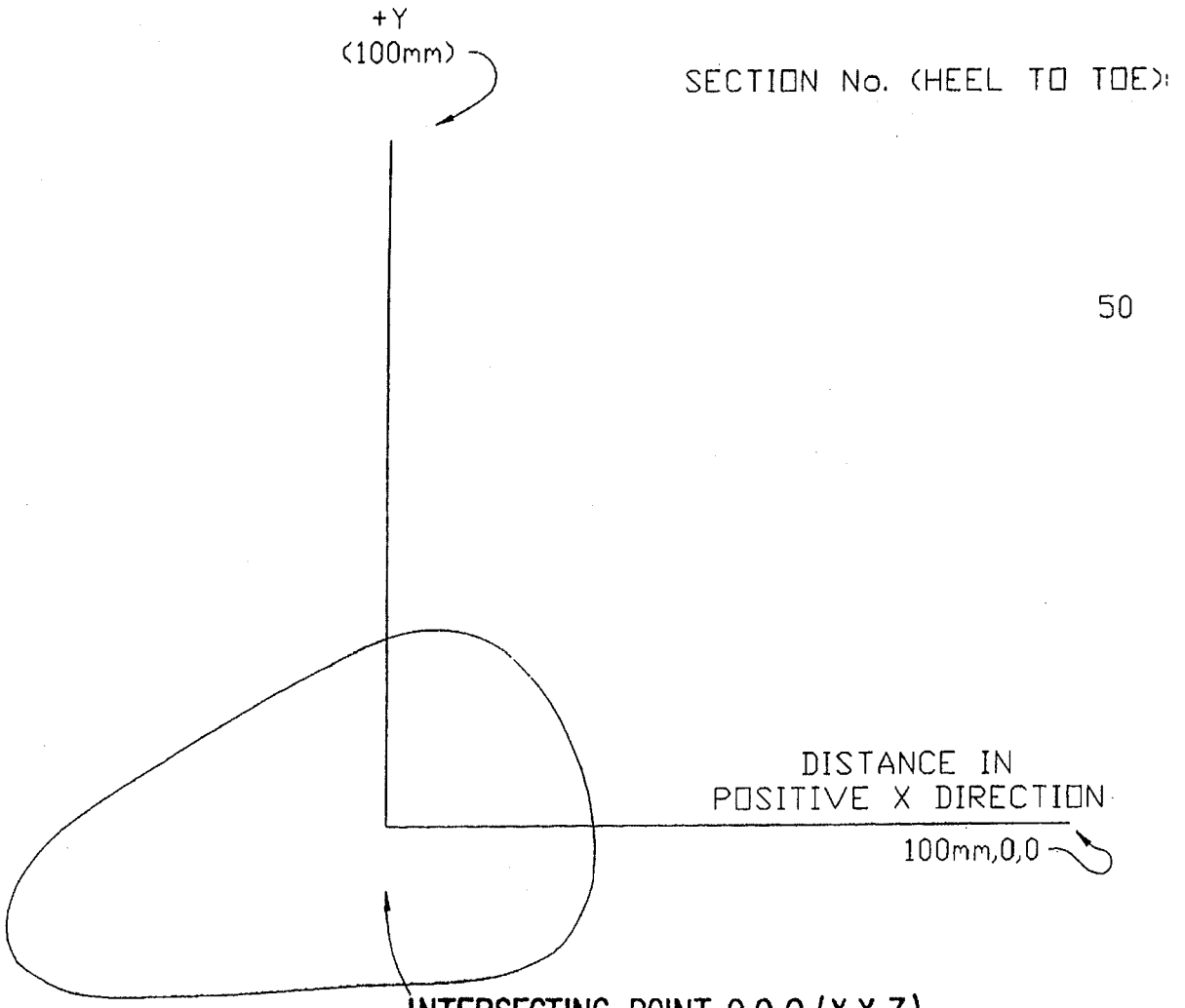
Figure 63:
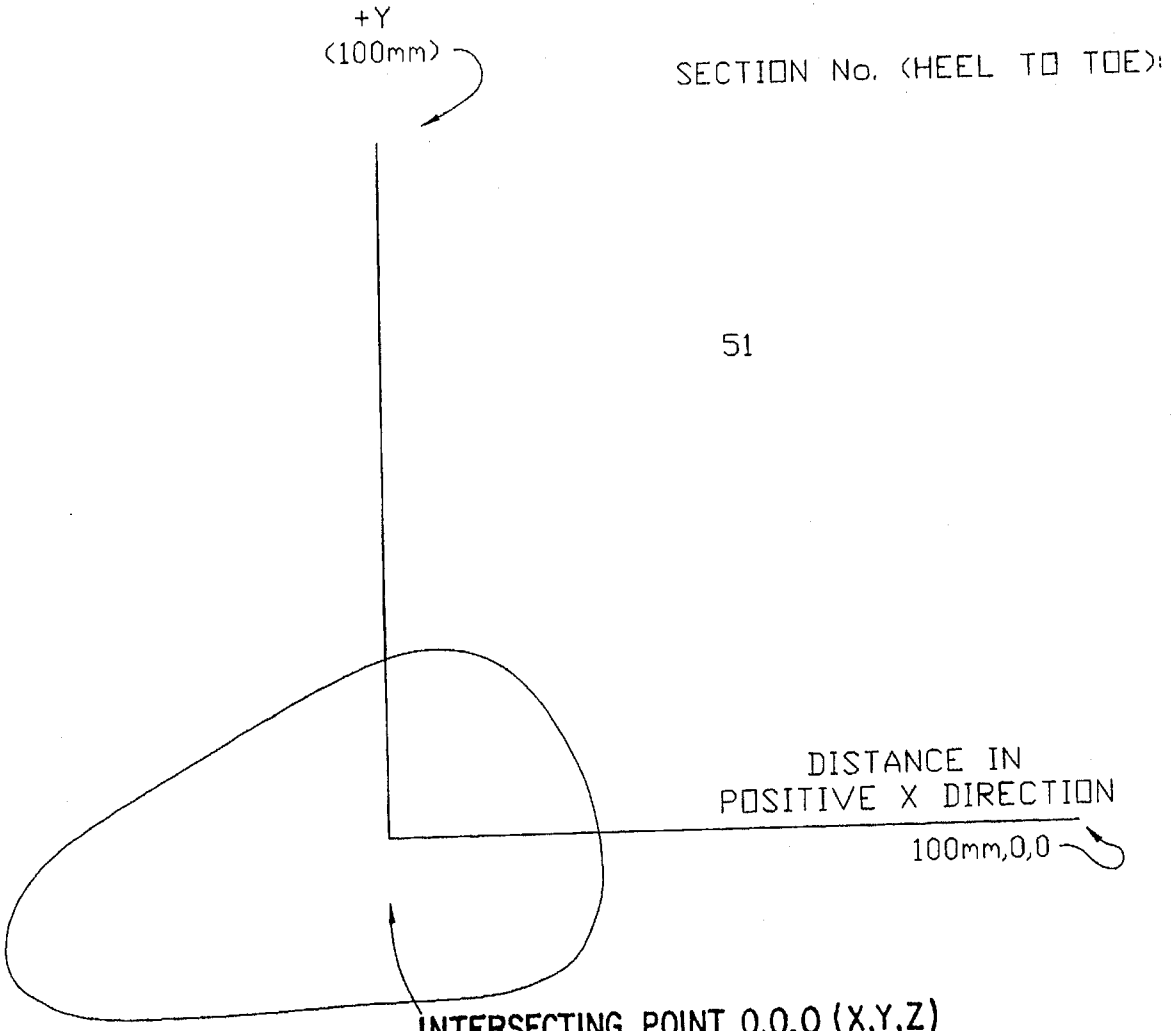
Figure 64:
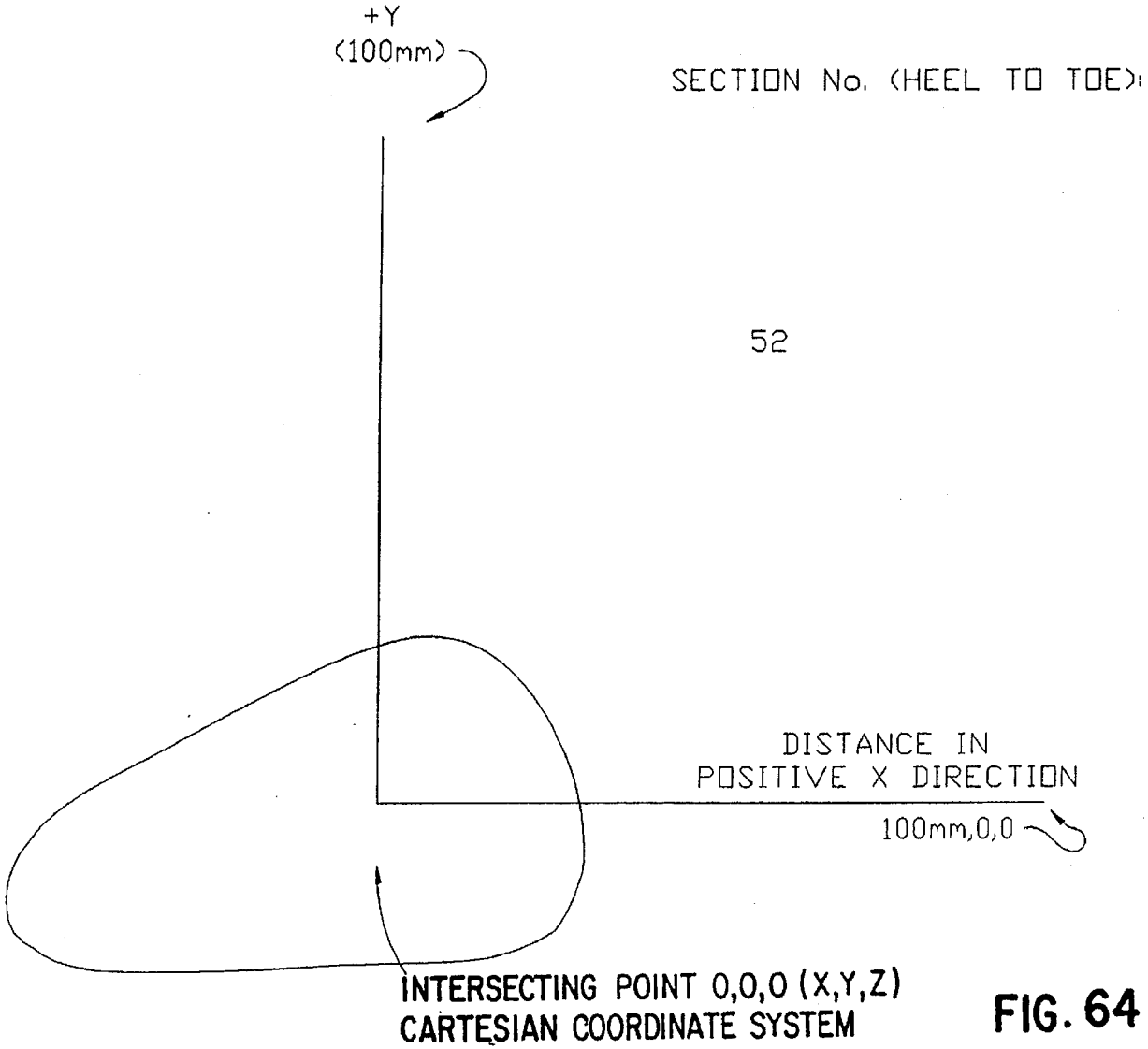
Figure 65:
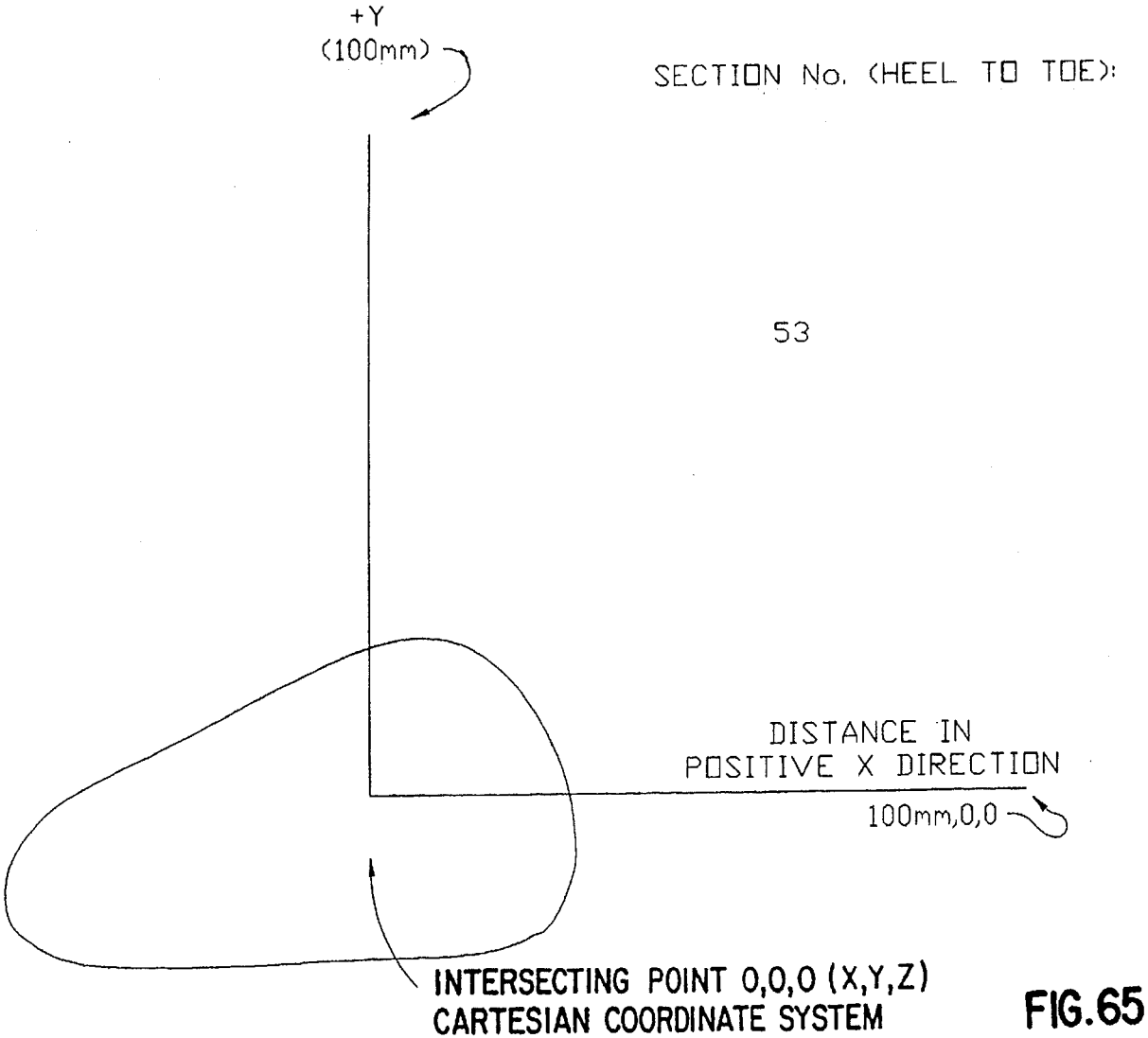
Figure 66:
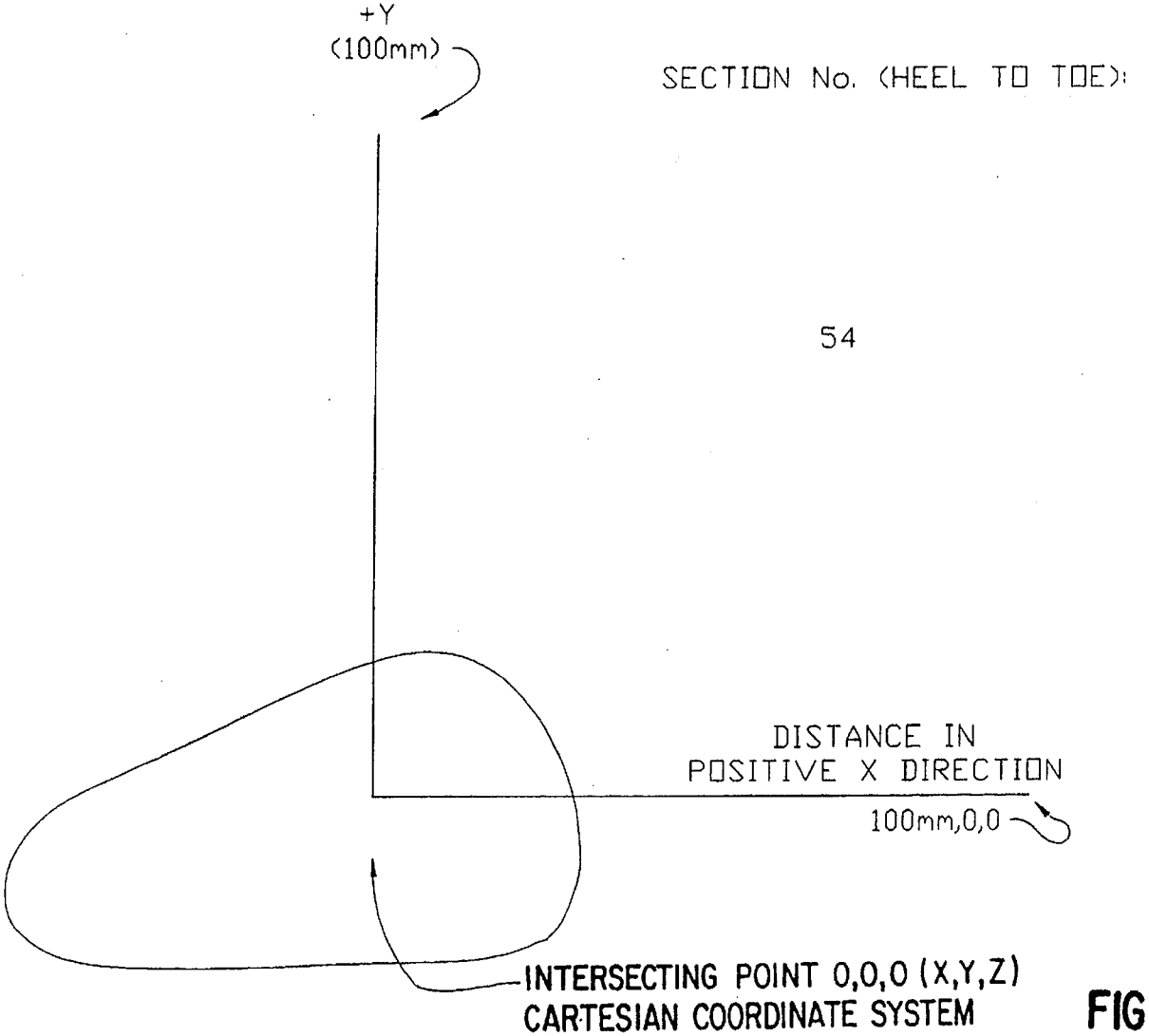
Figure 67:
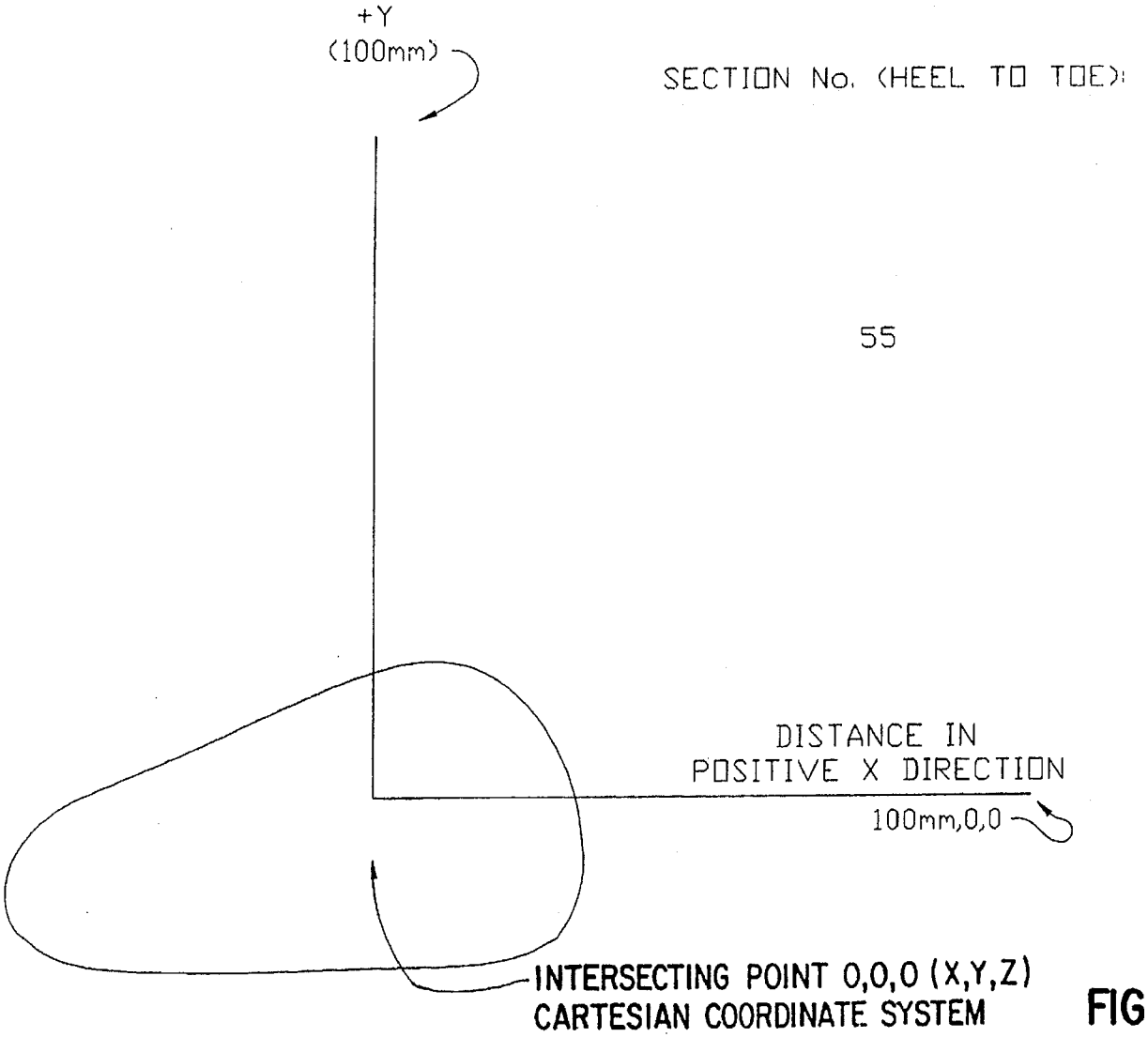
Figure 68:
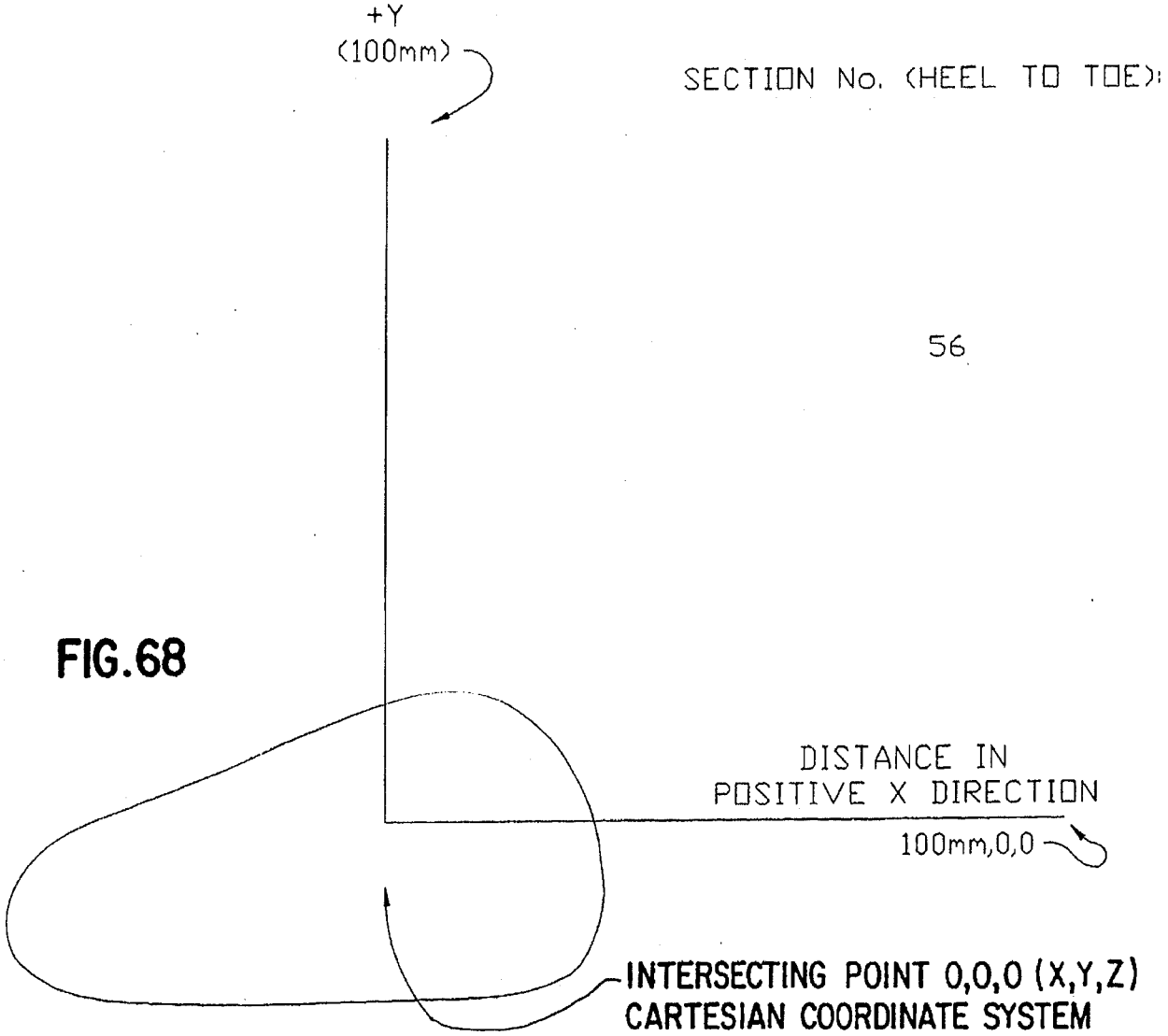
Figure 69:
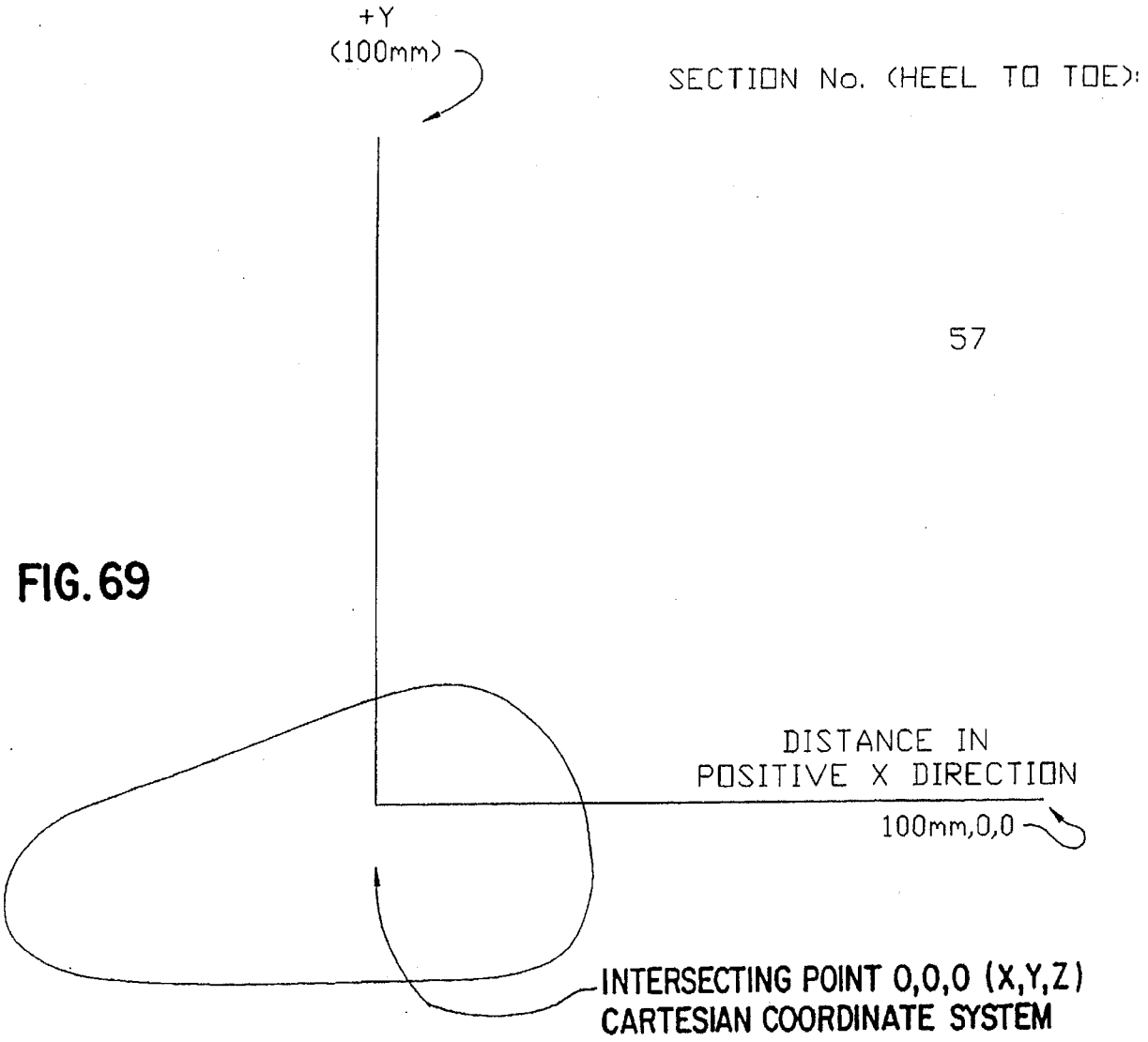
Figure 70:
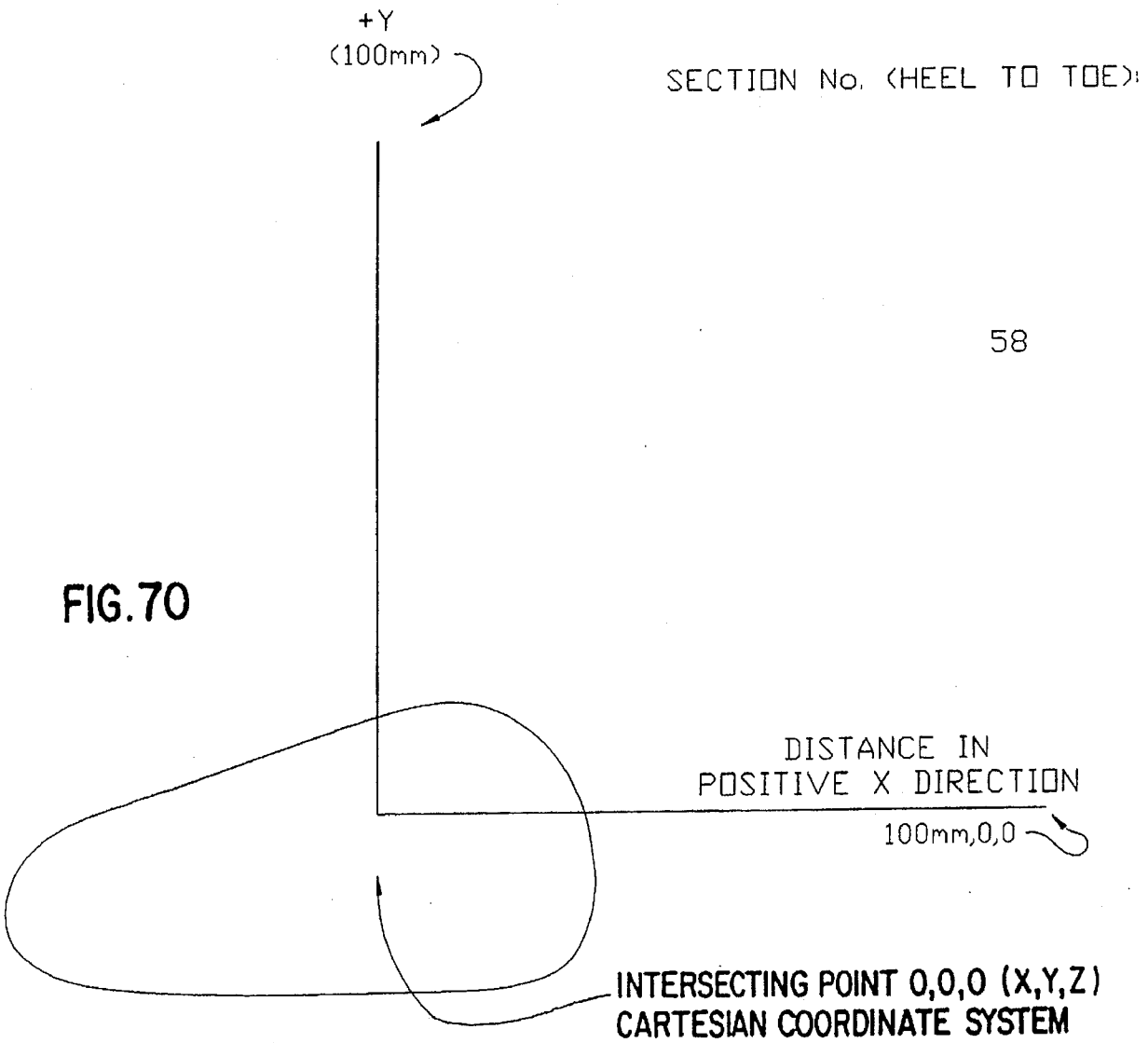
Figure 71:
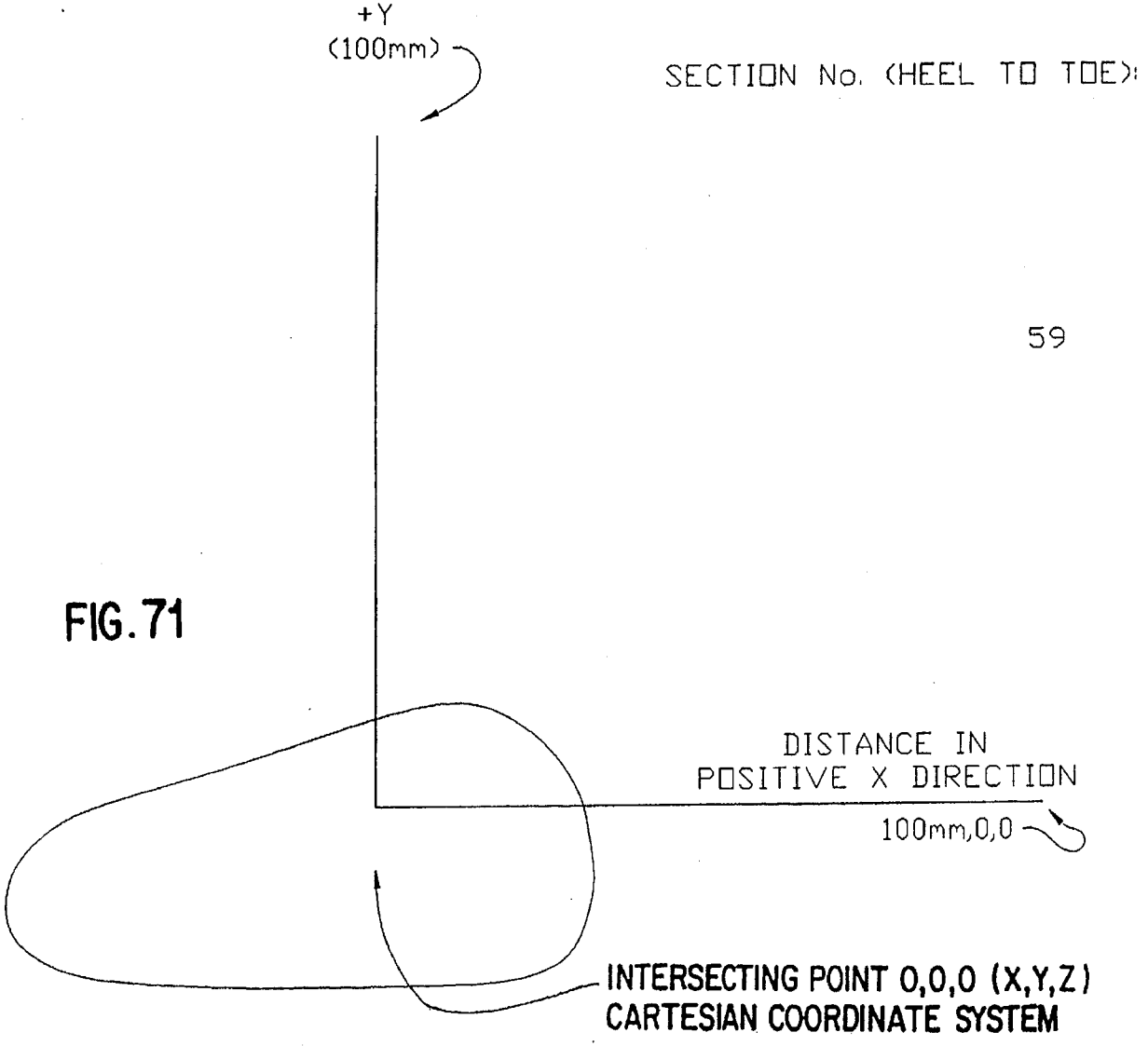
Figure 72:
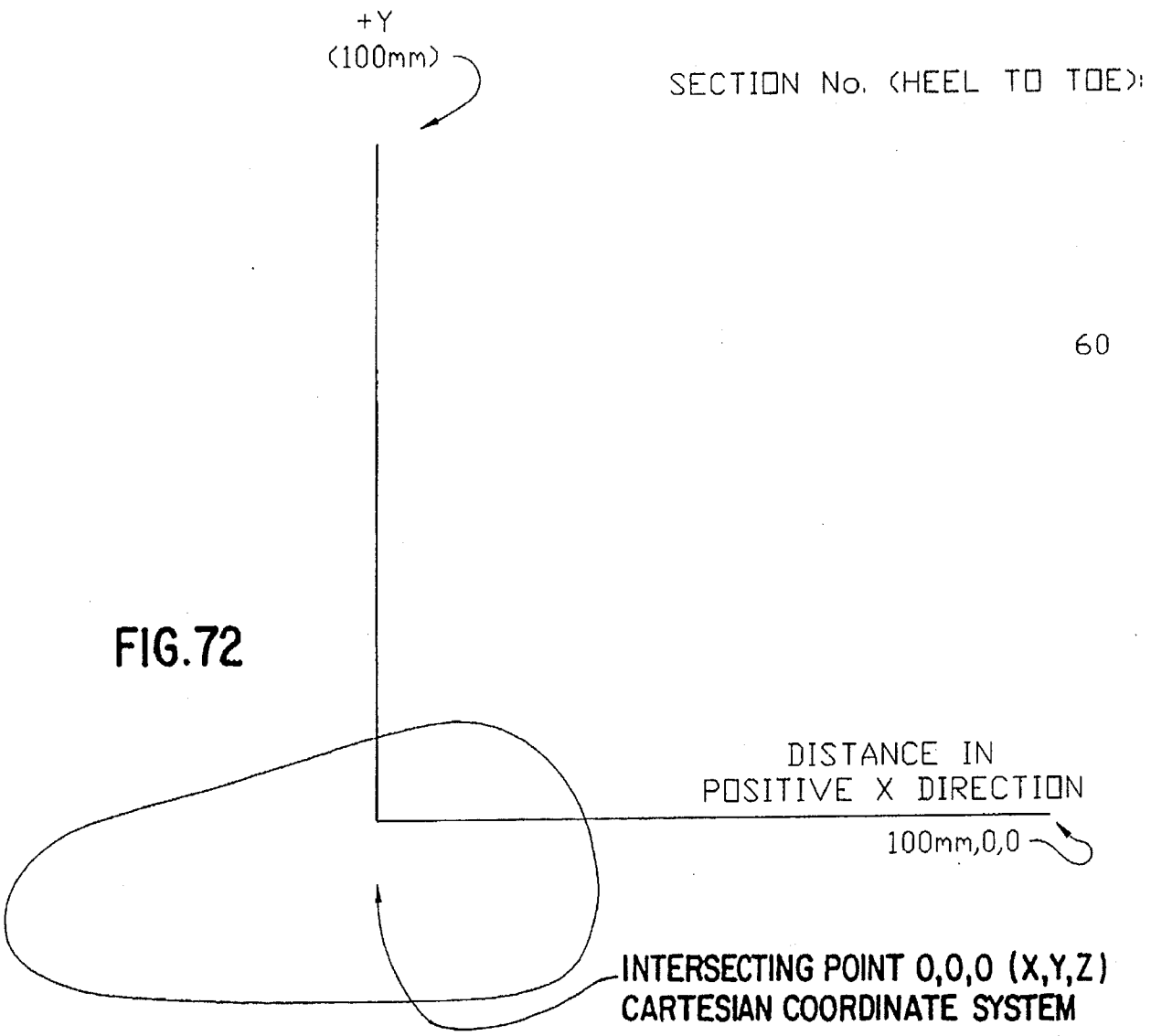
Figure 73:
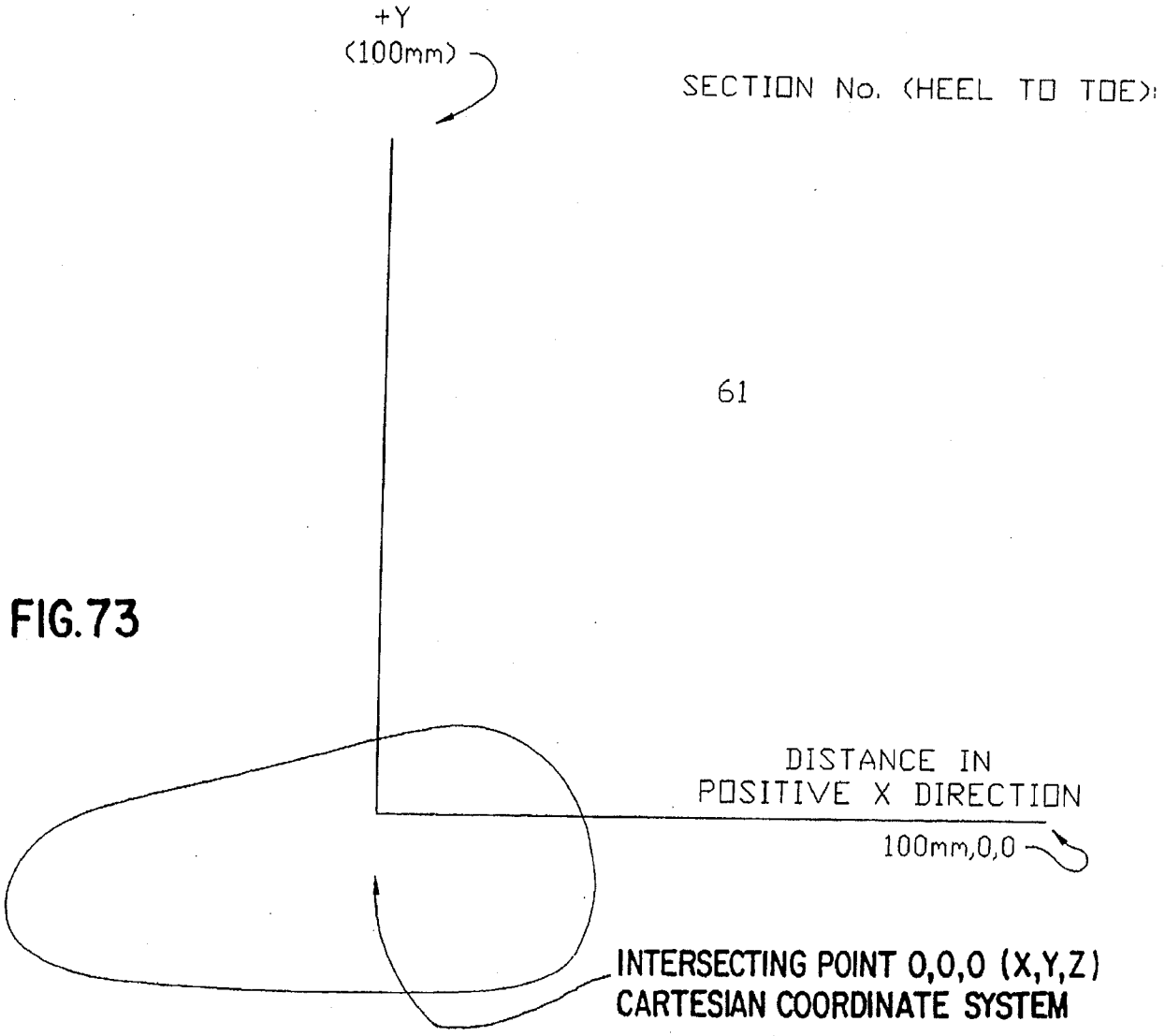
Figure 74:
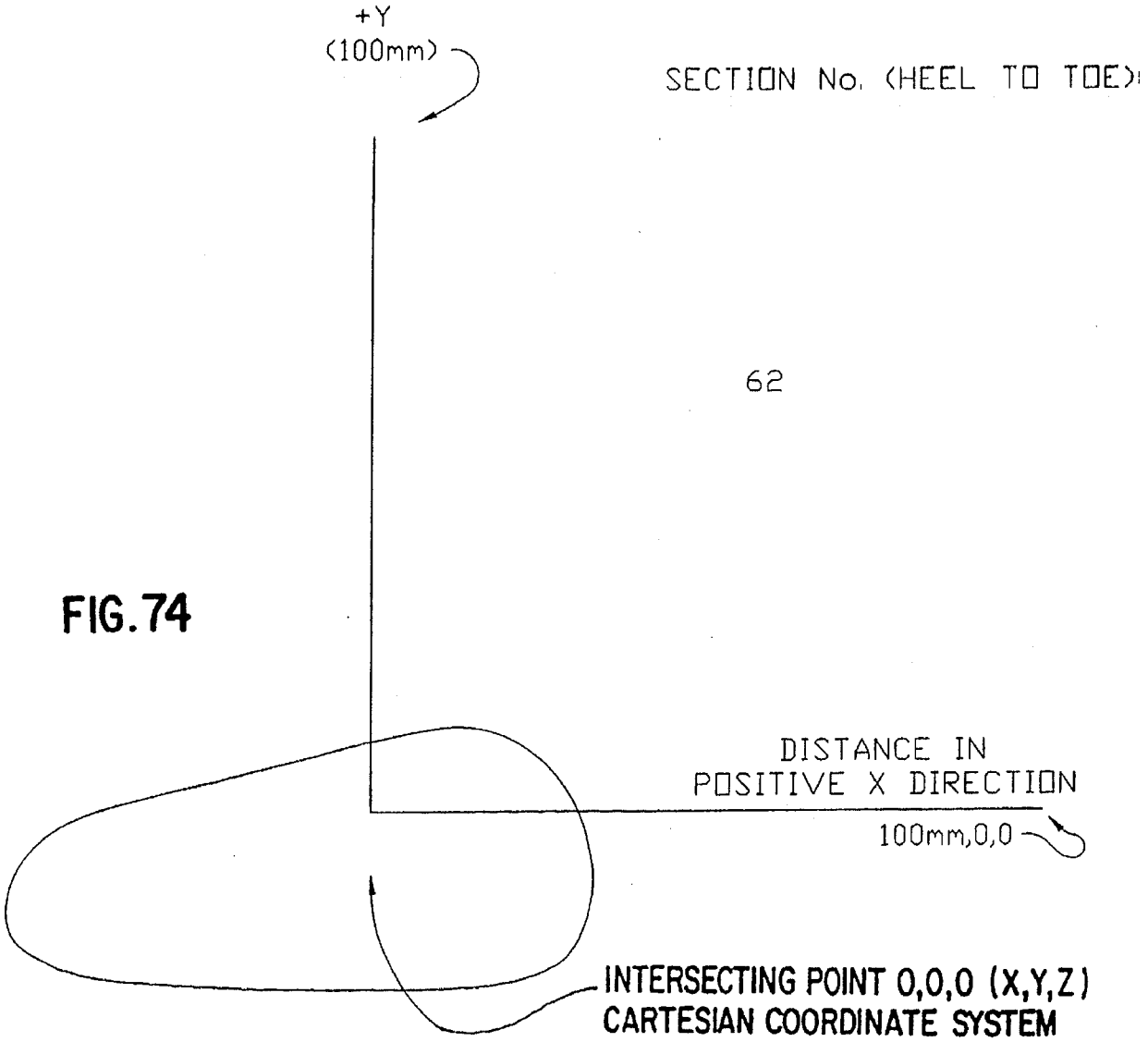
Figure 75:
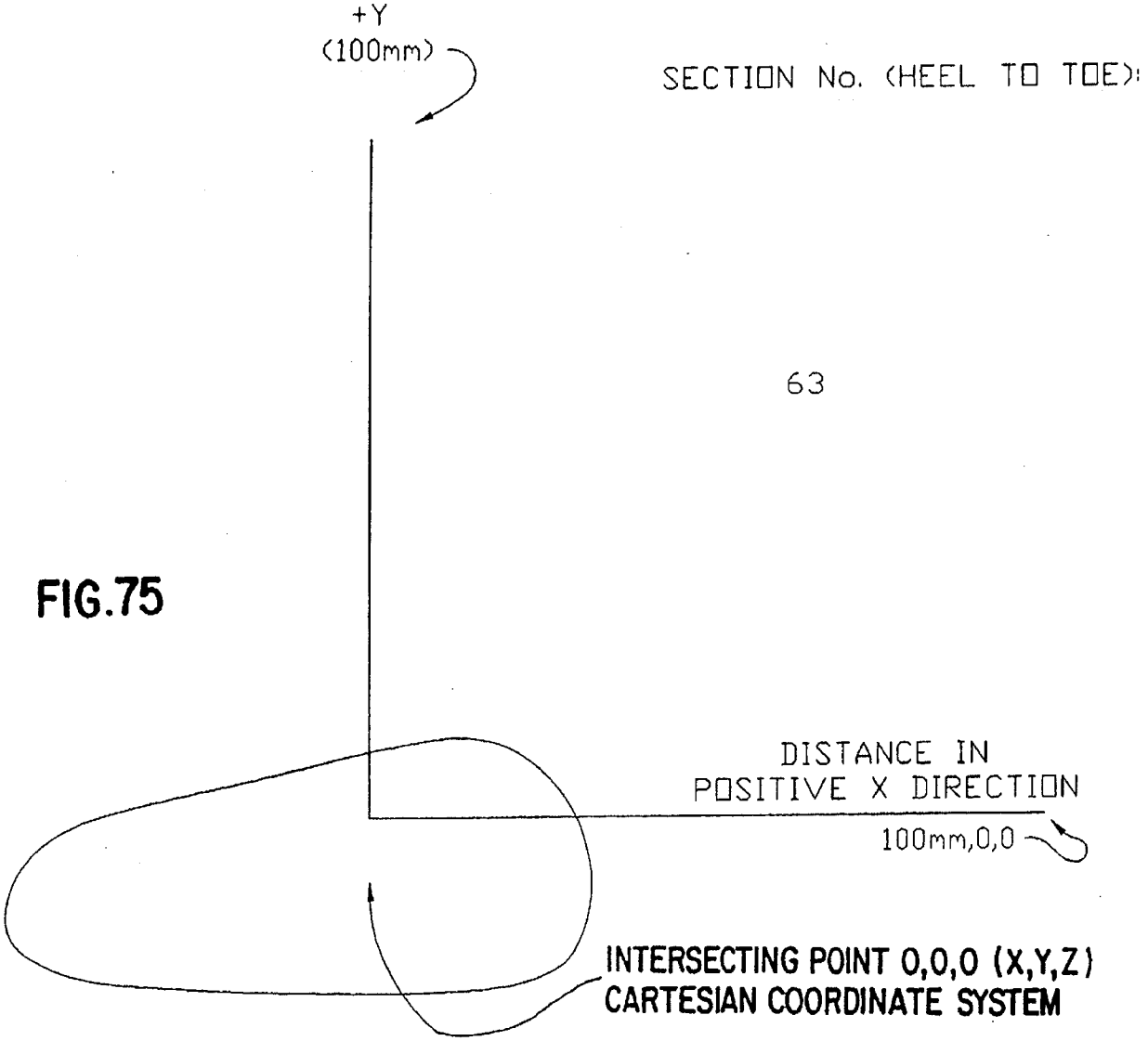
Figure 76:
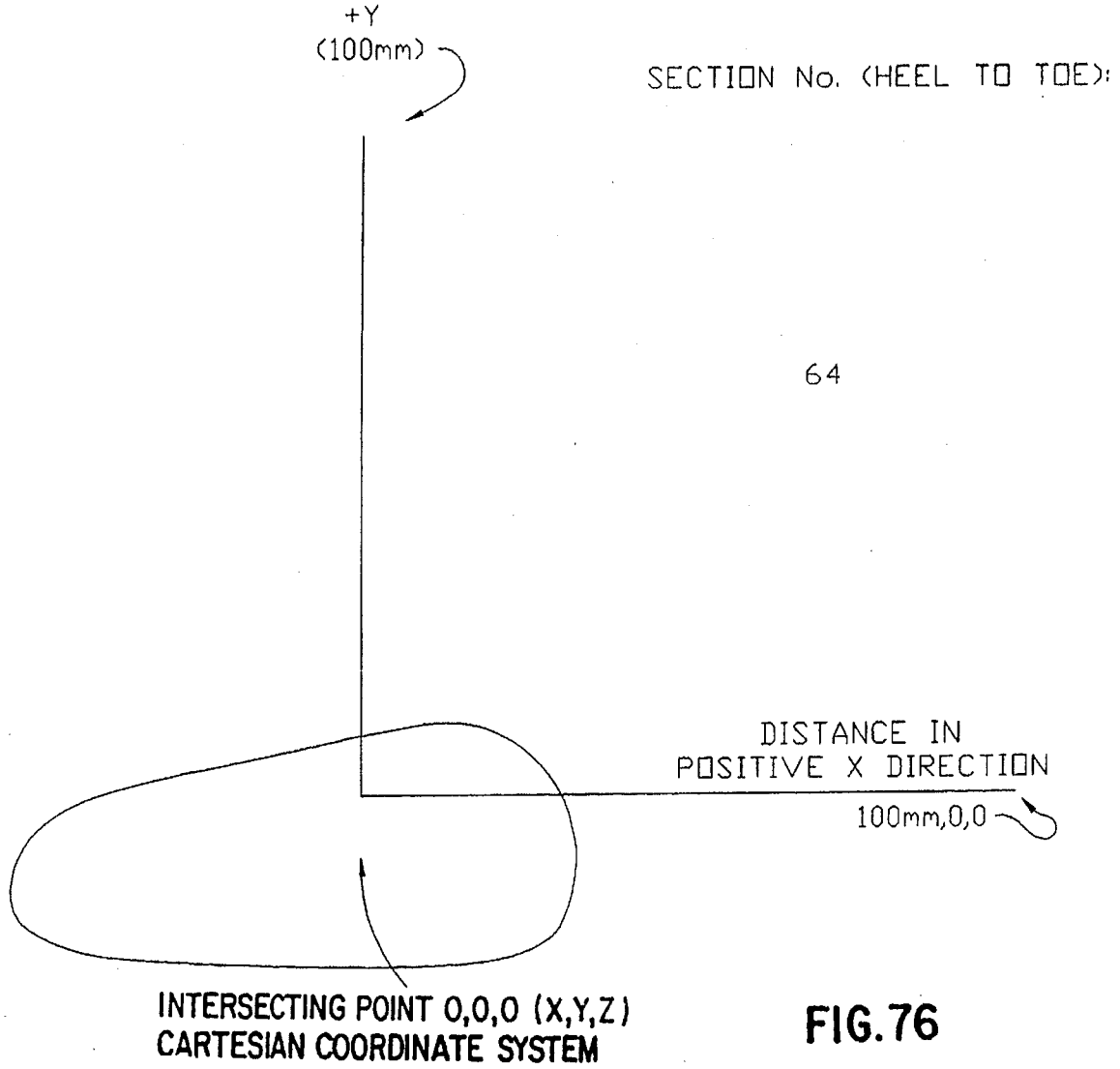
Figure 77:
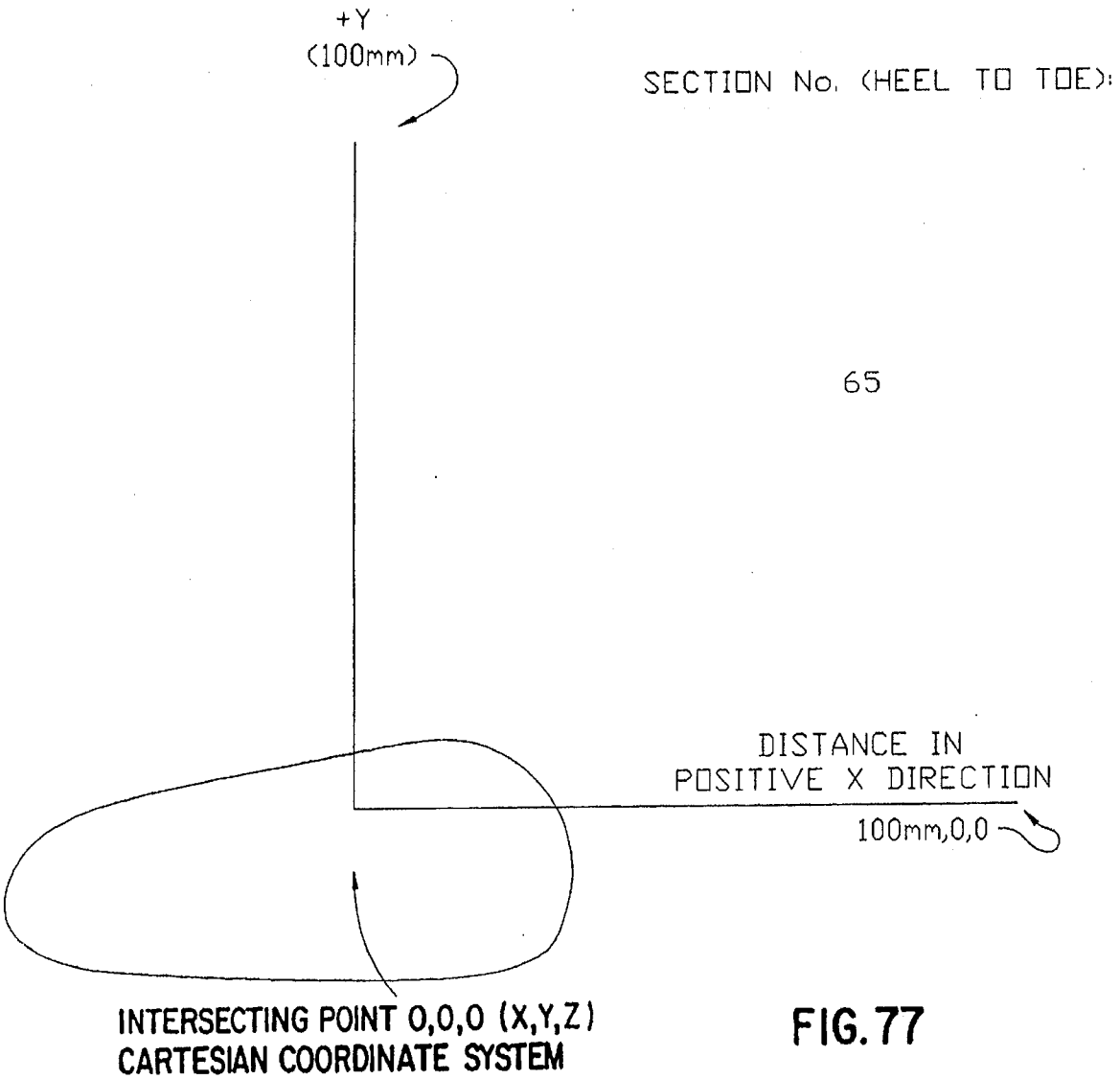
Figure 78:
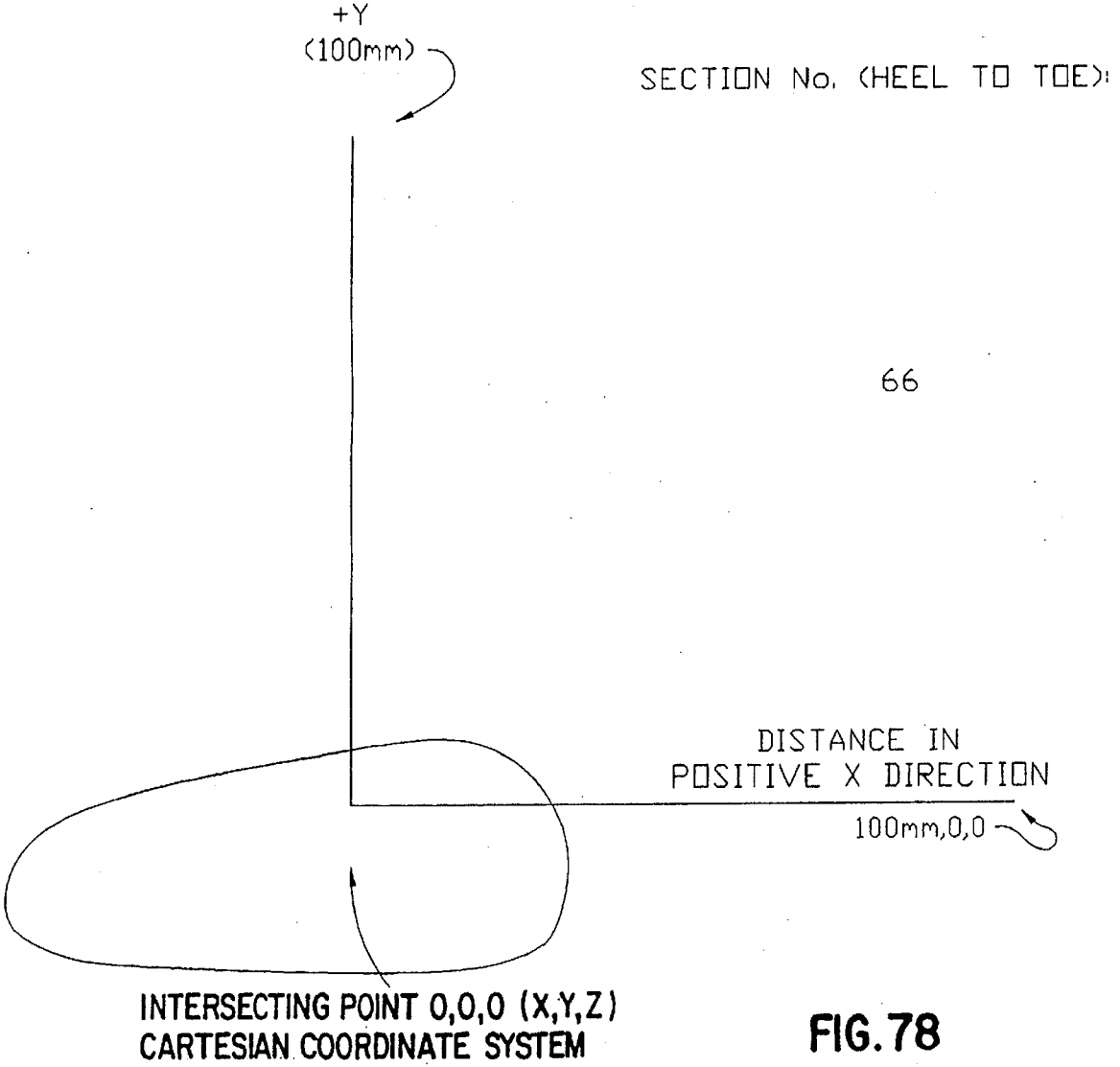
Figure 79:
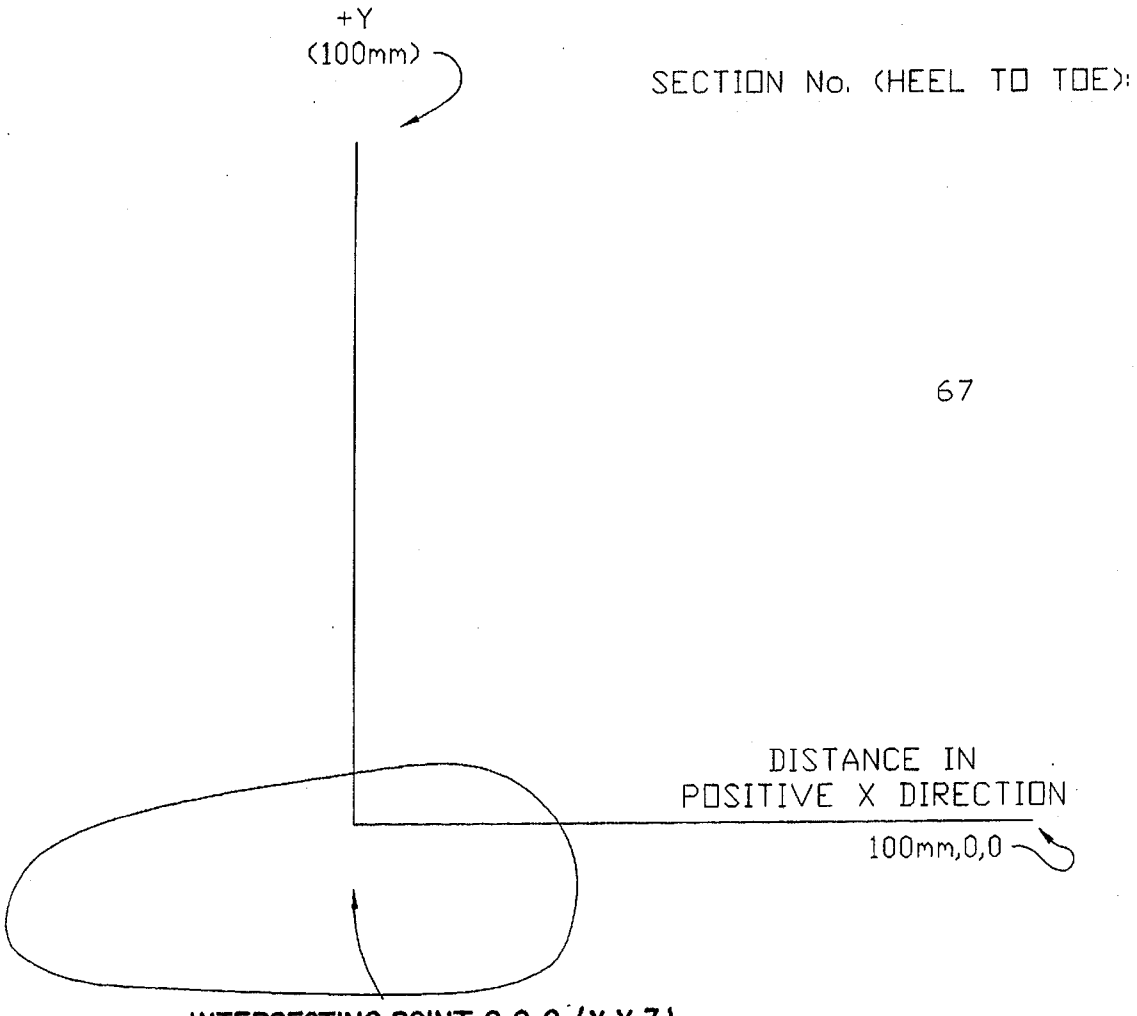
Figure 80:
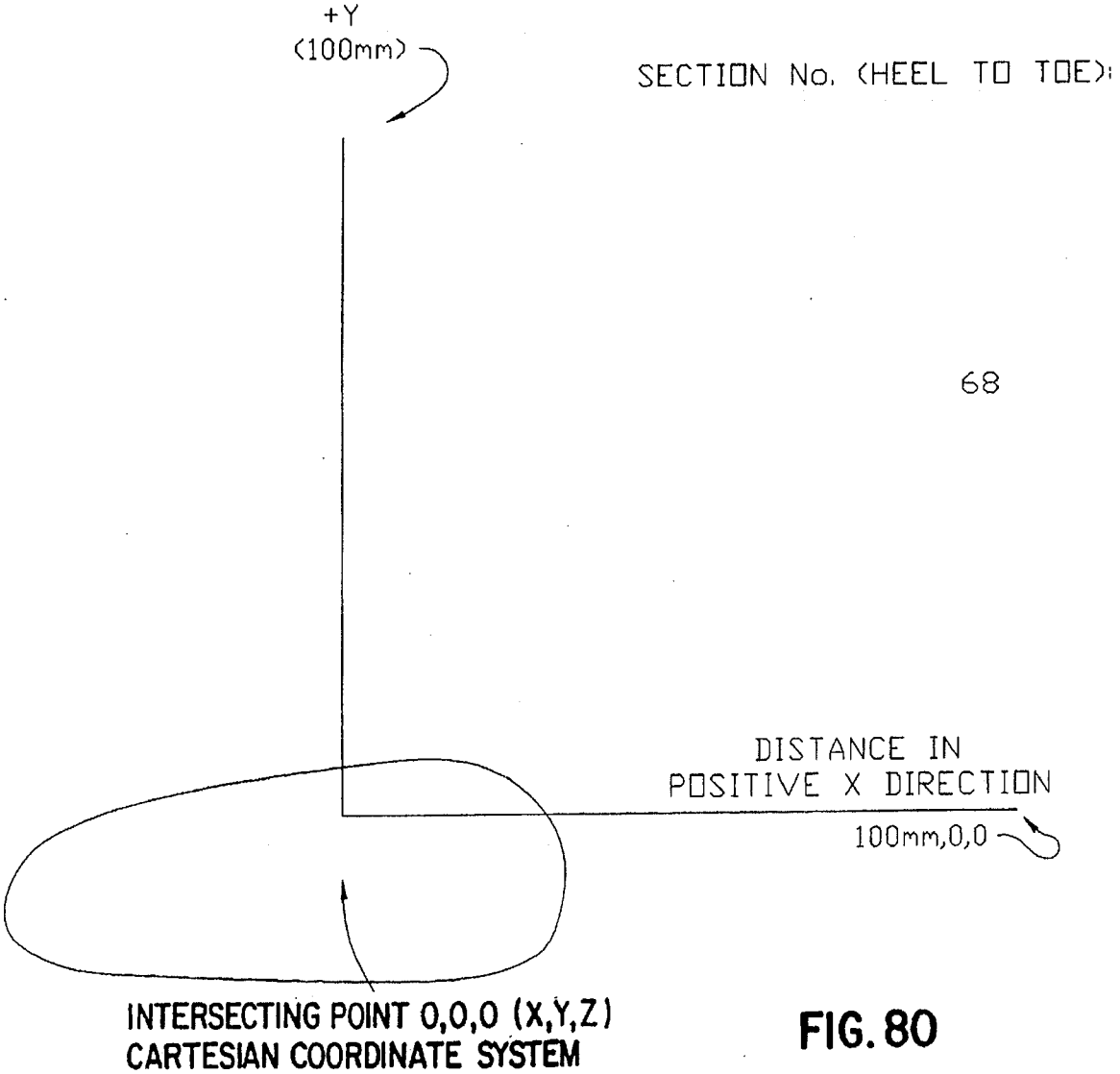
Figure 81:
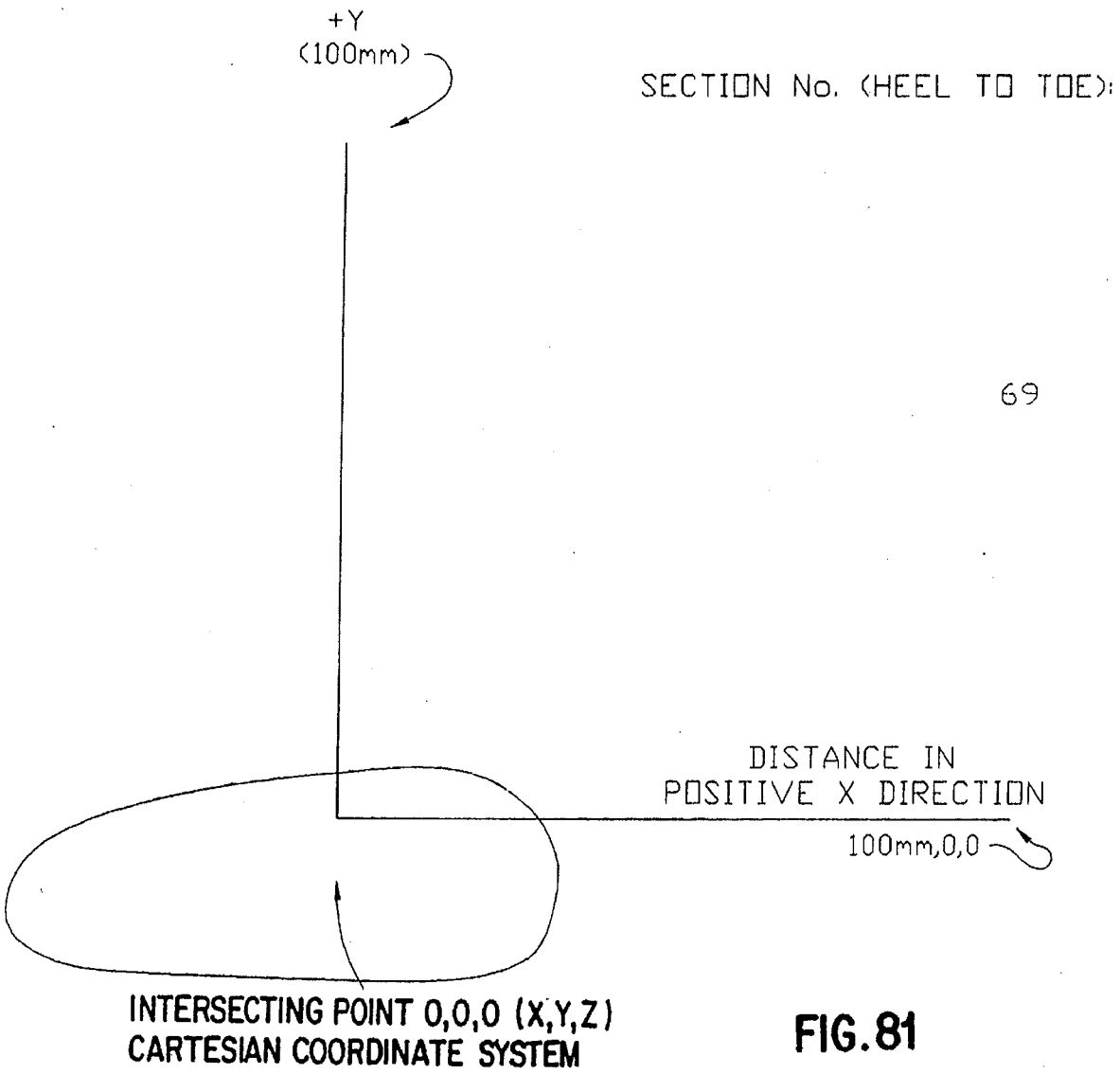
Figure 82:
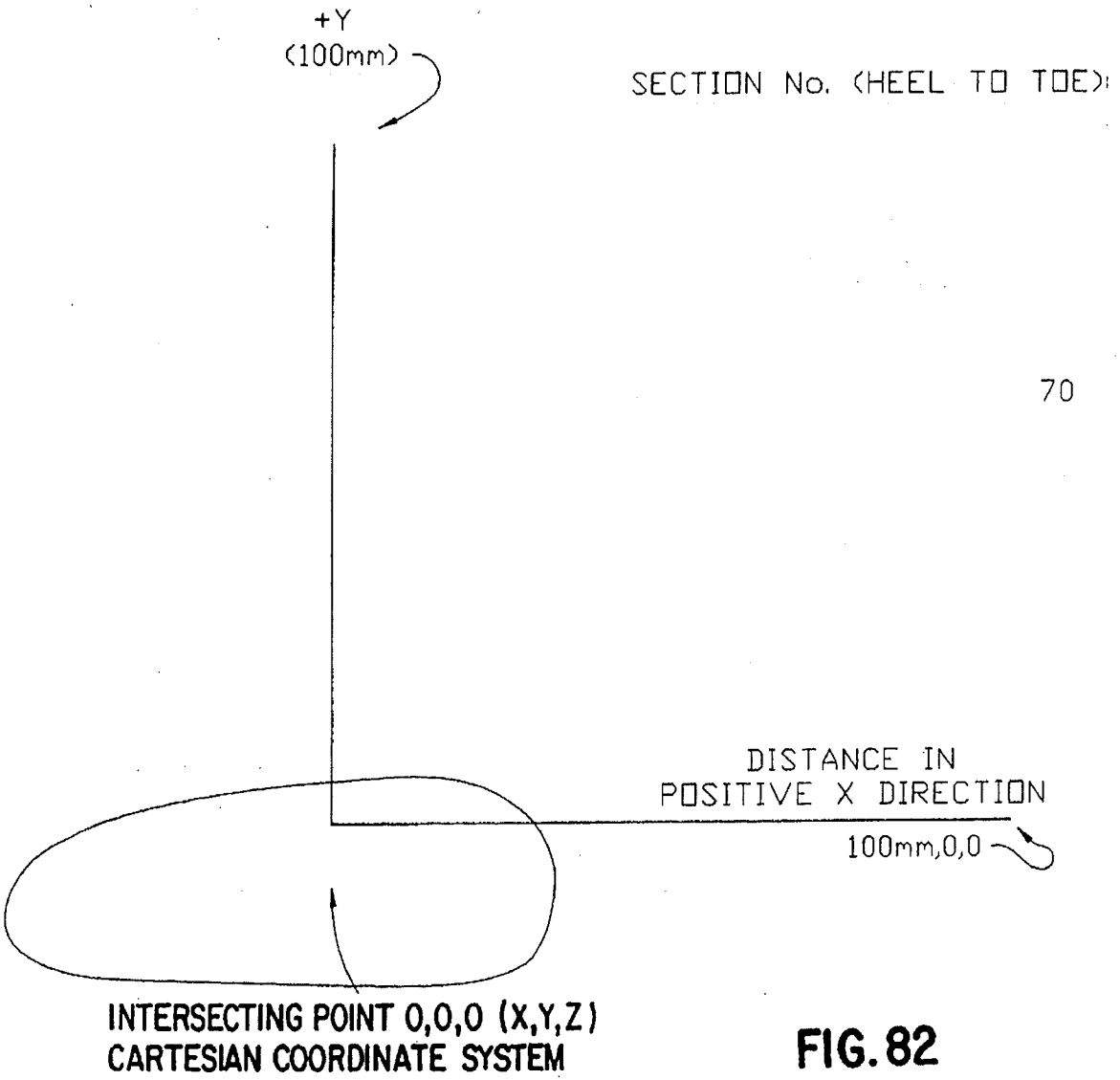
Figure 83:
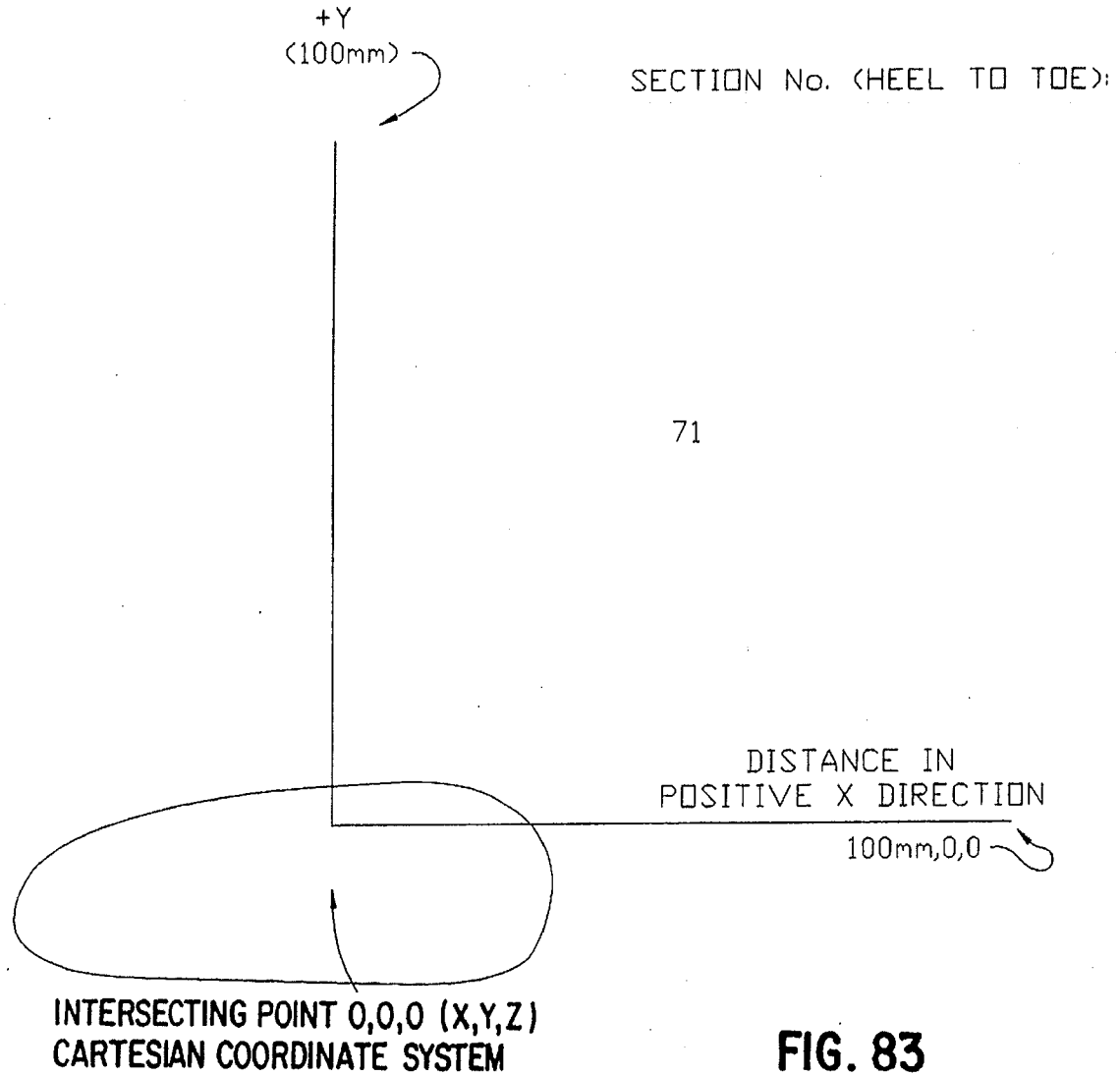
Figure 84:
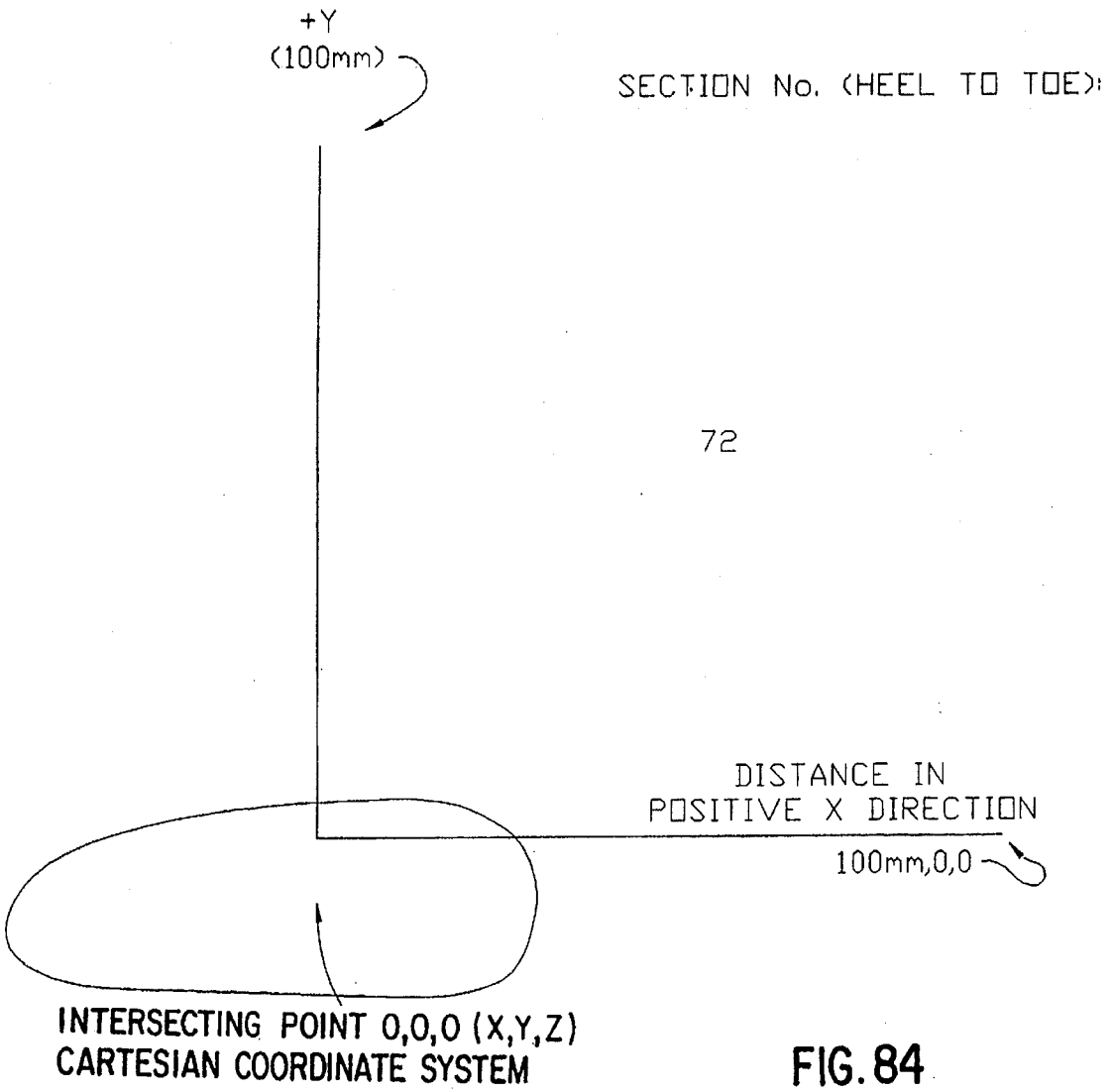
Figure 85:
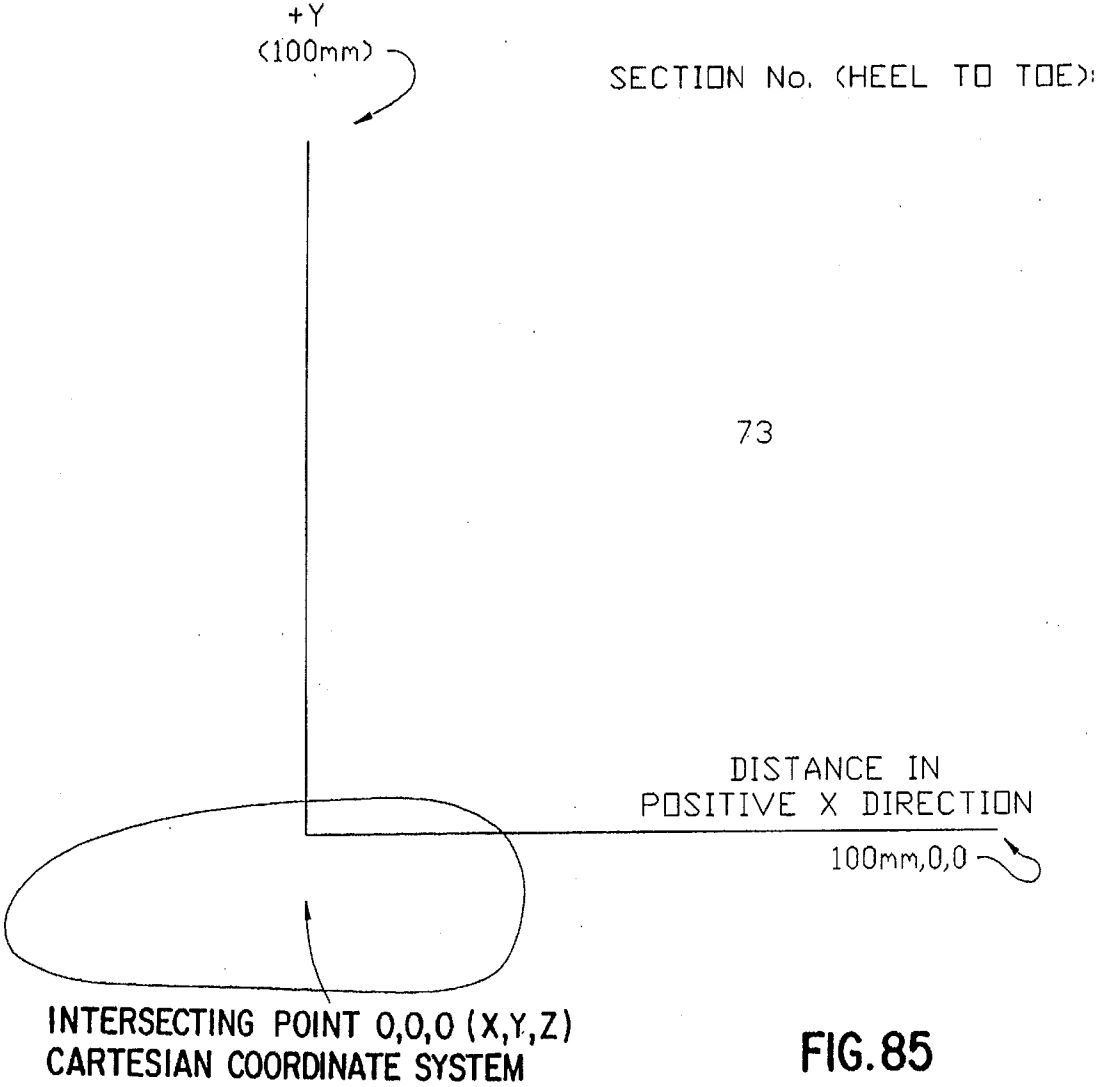
Figure 86:
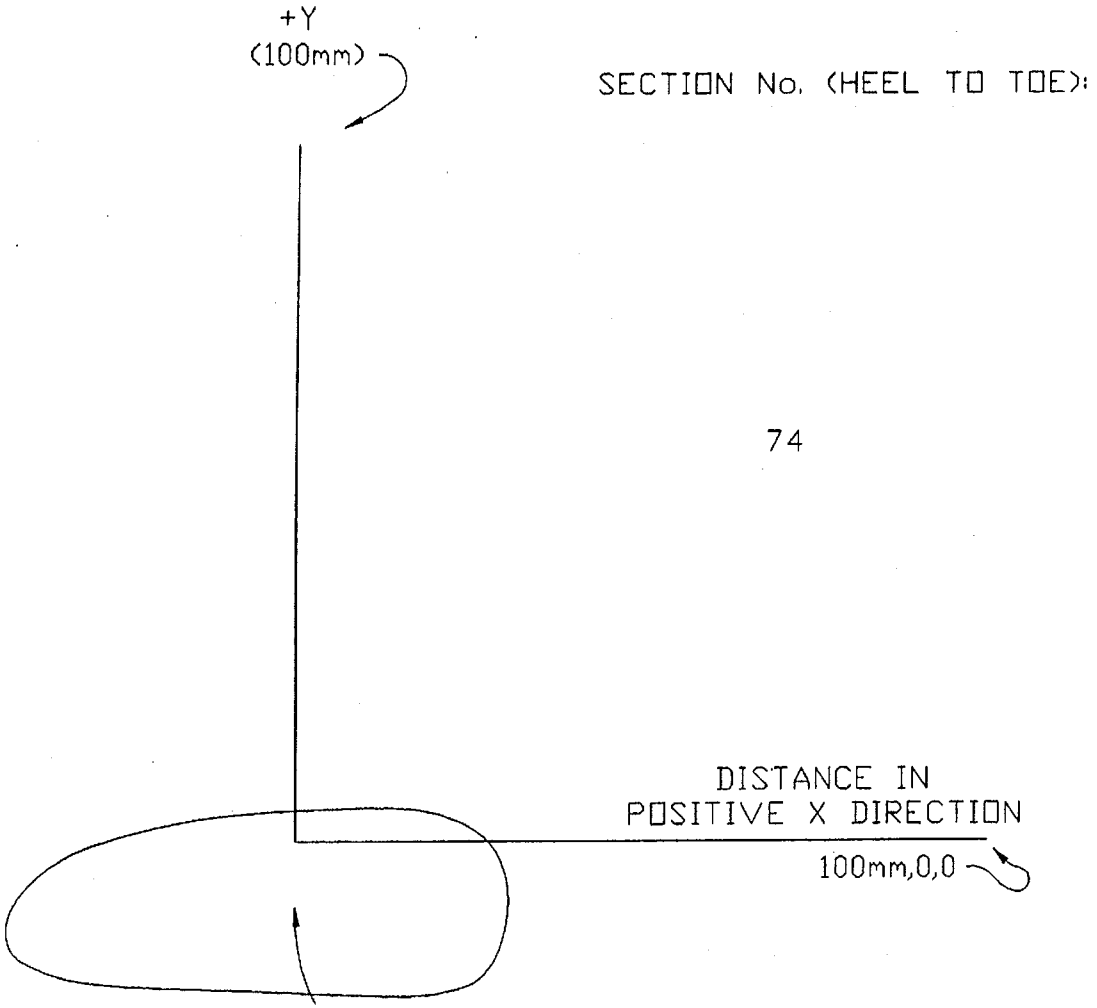
Figure 87:
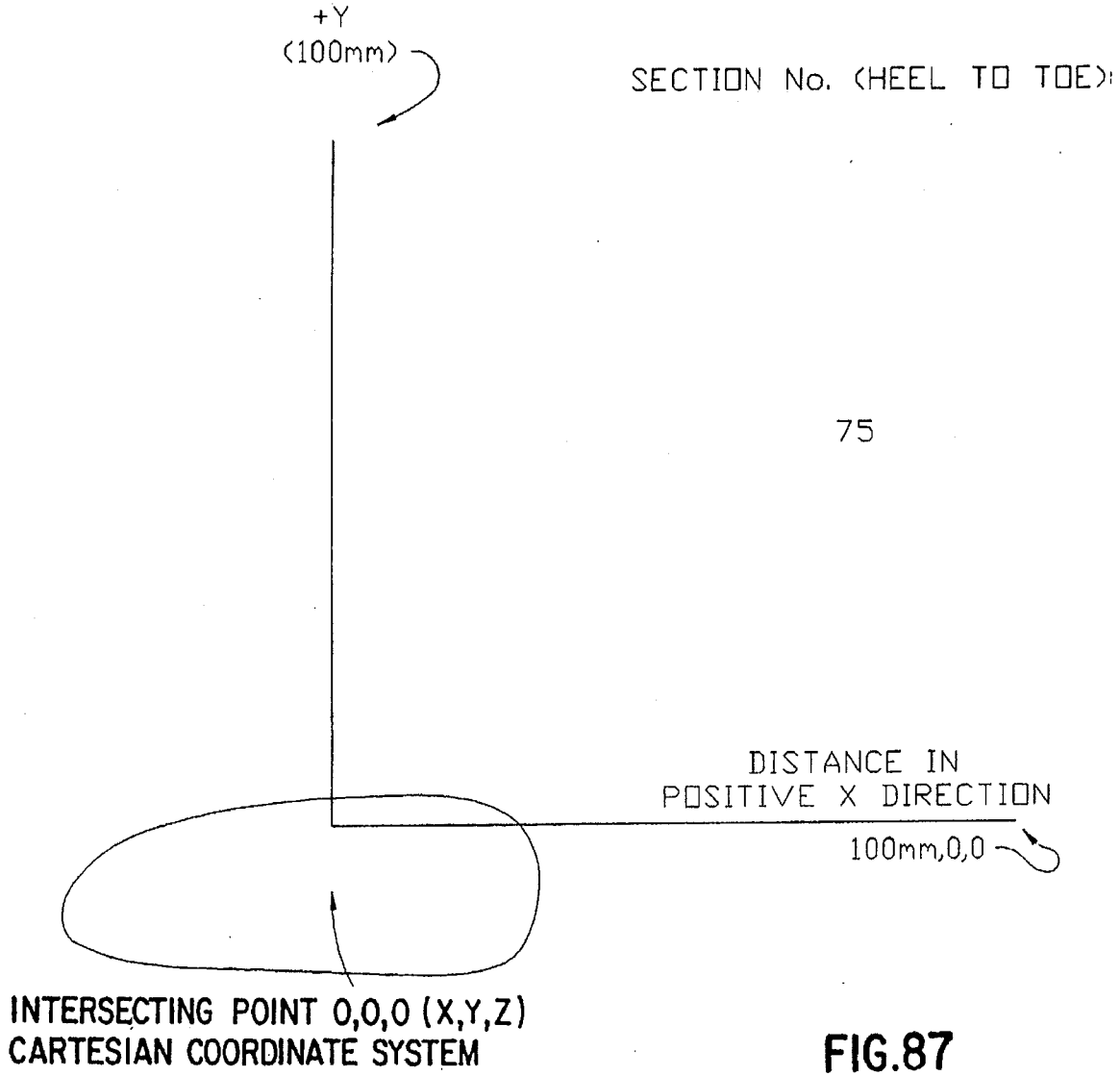
Figure 88:
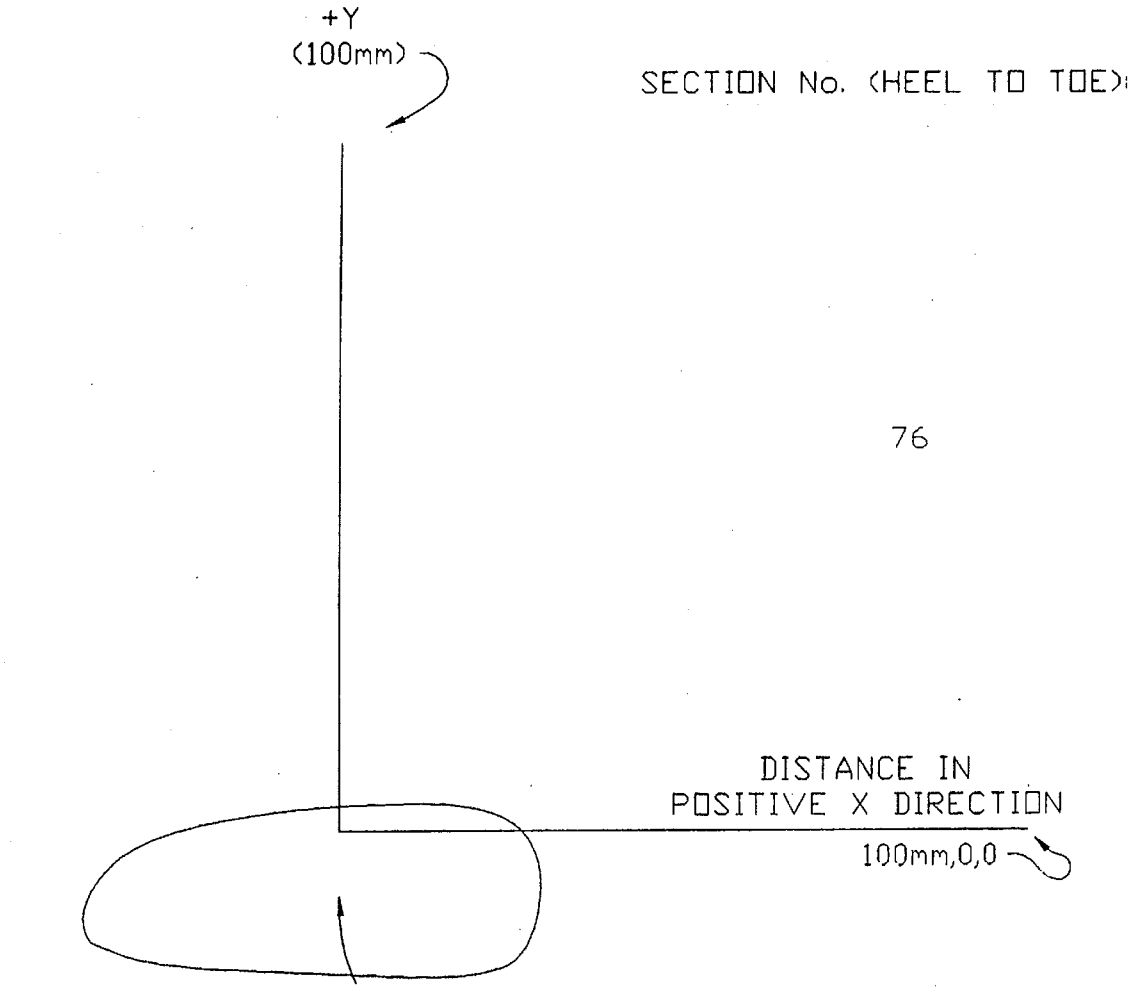
Figure 89:
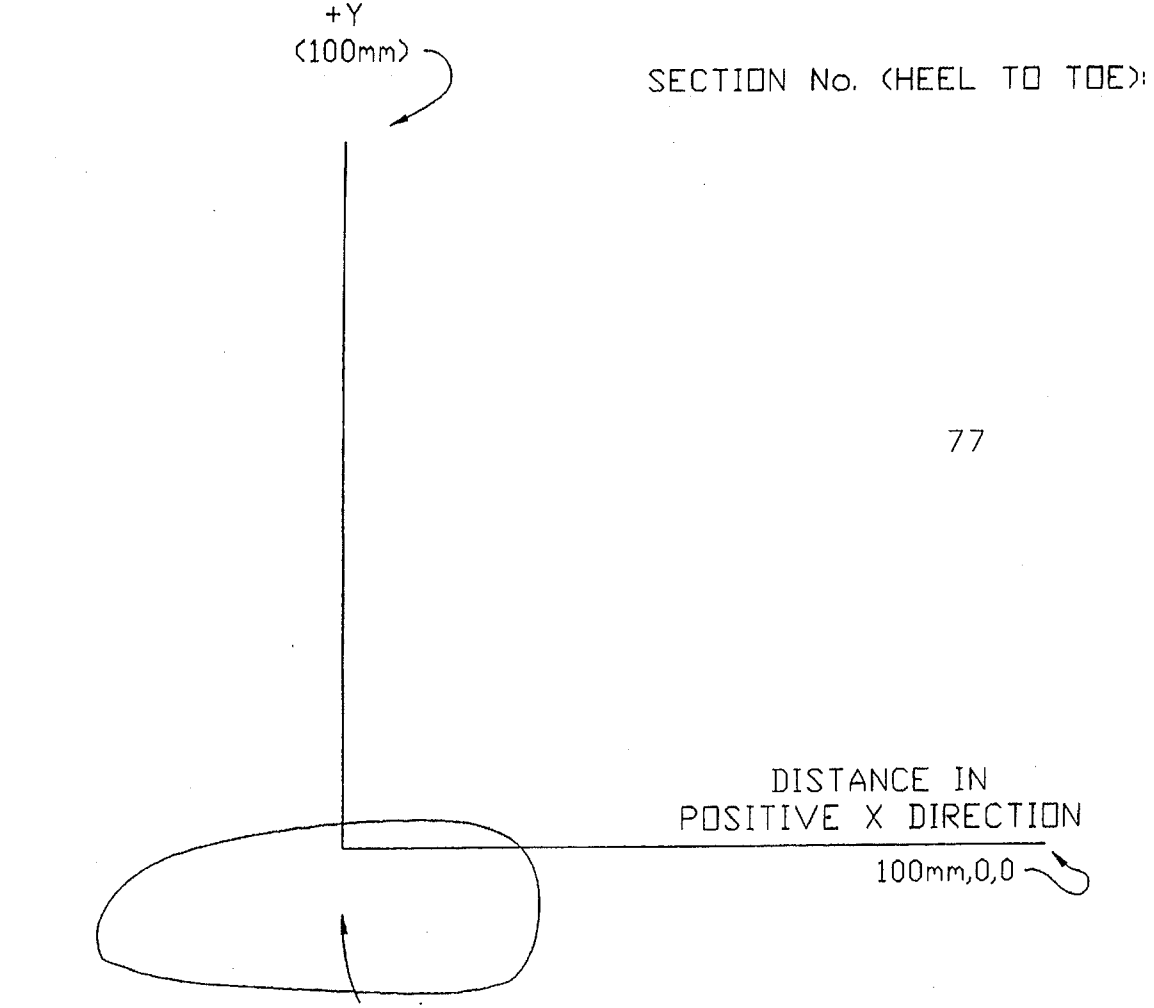
Figure 90:
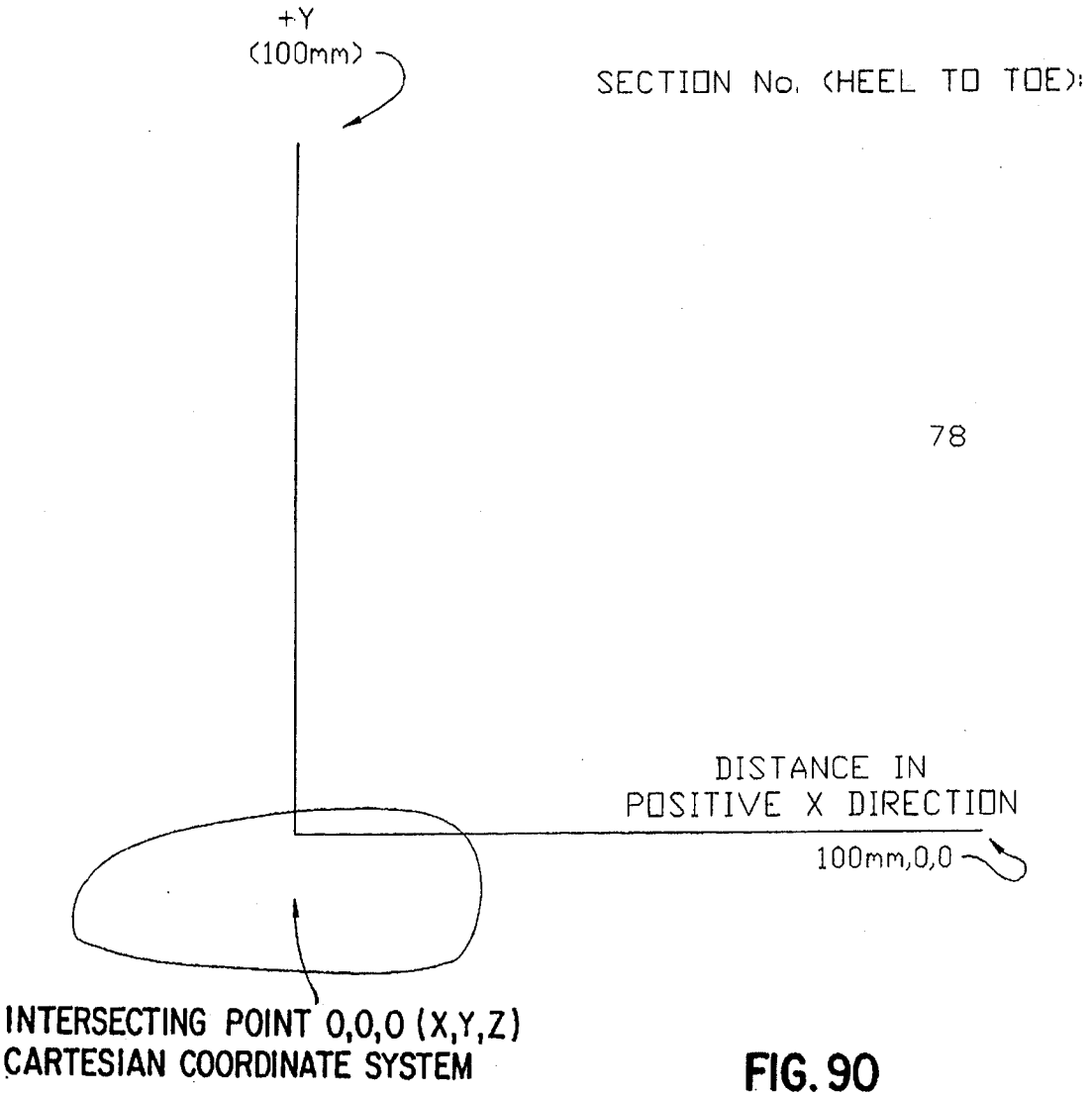
Figure 91:
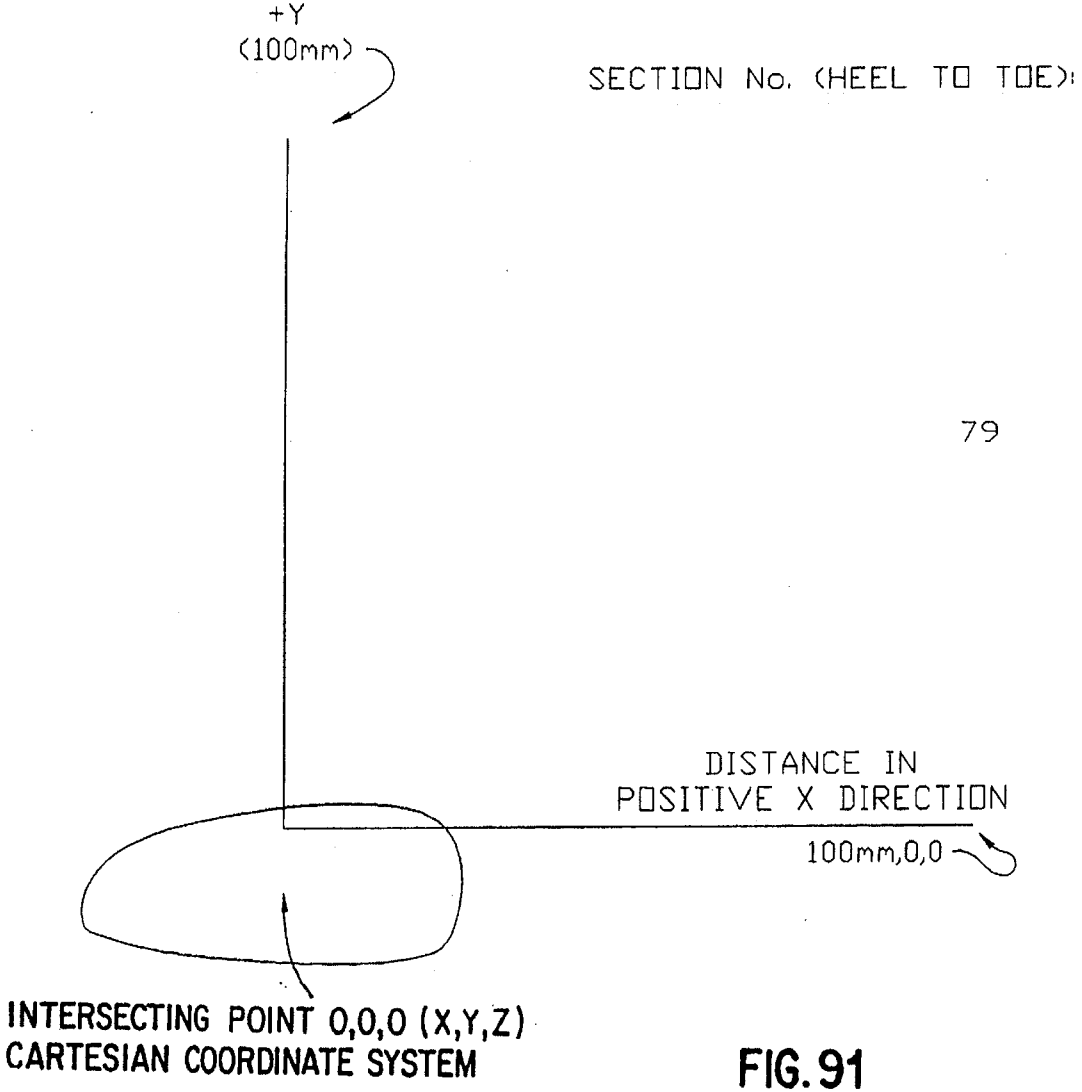
Figure 92:
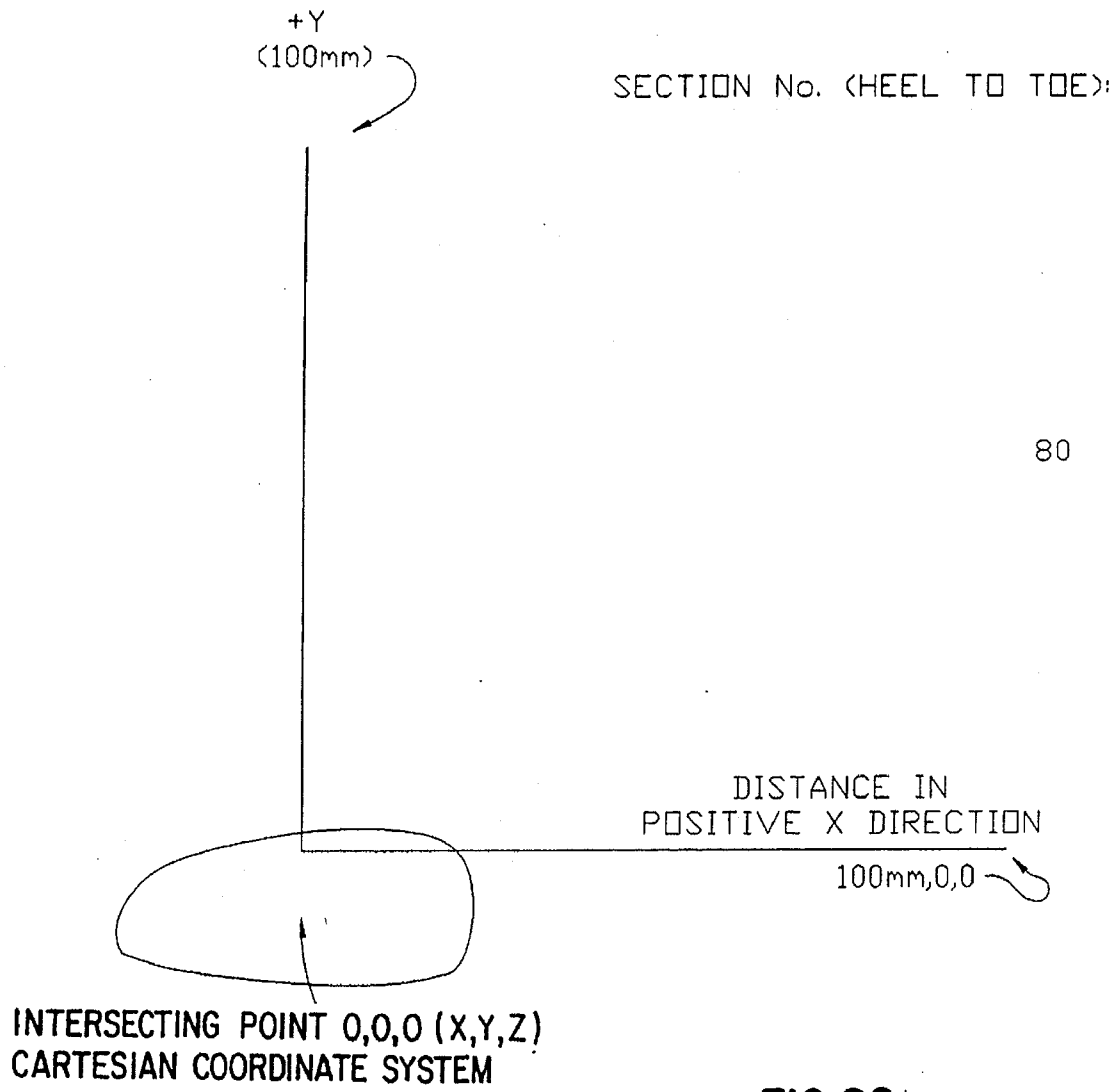
Figure 93:
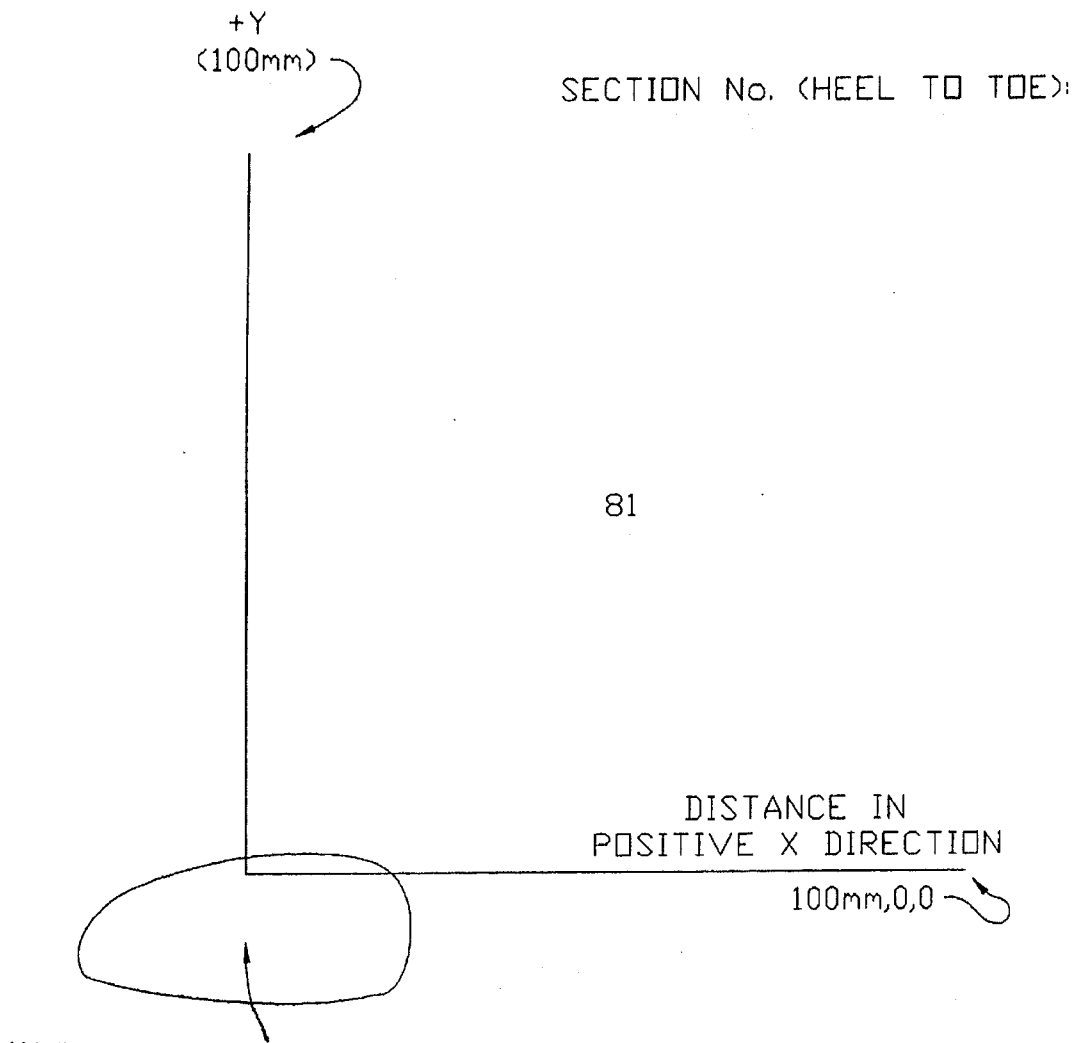
Figure 94:
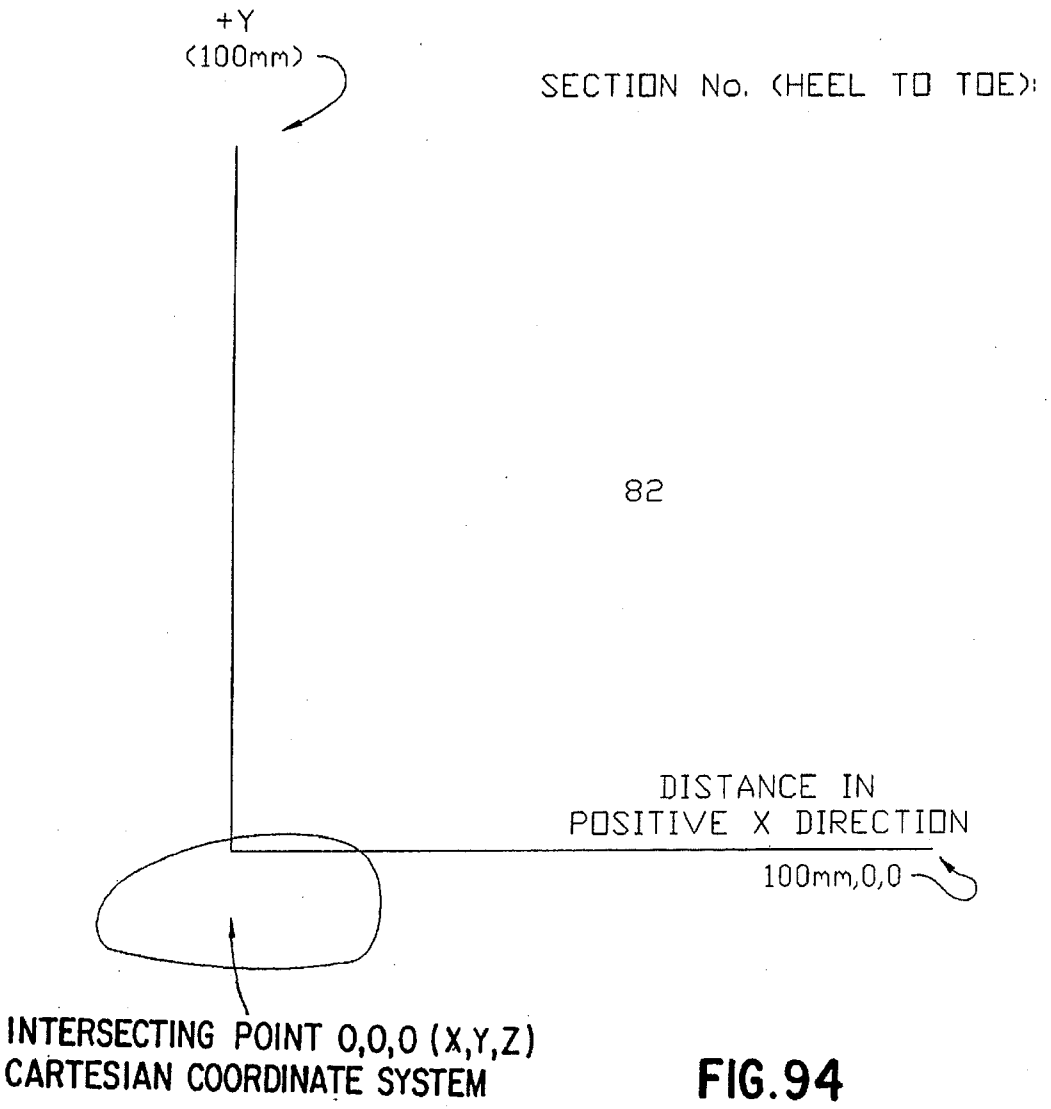
Figure 95:
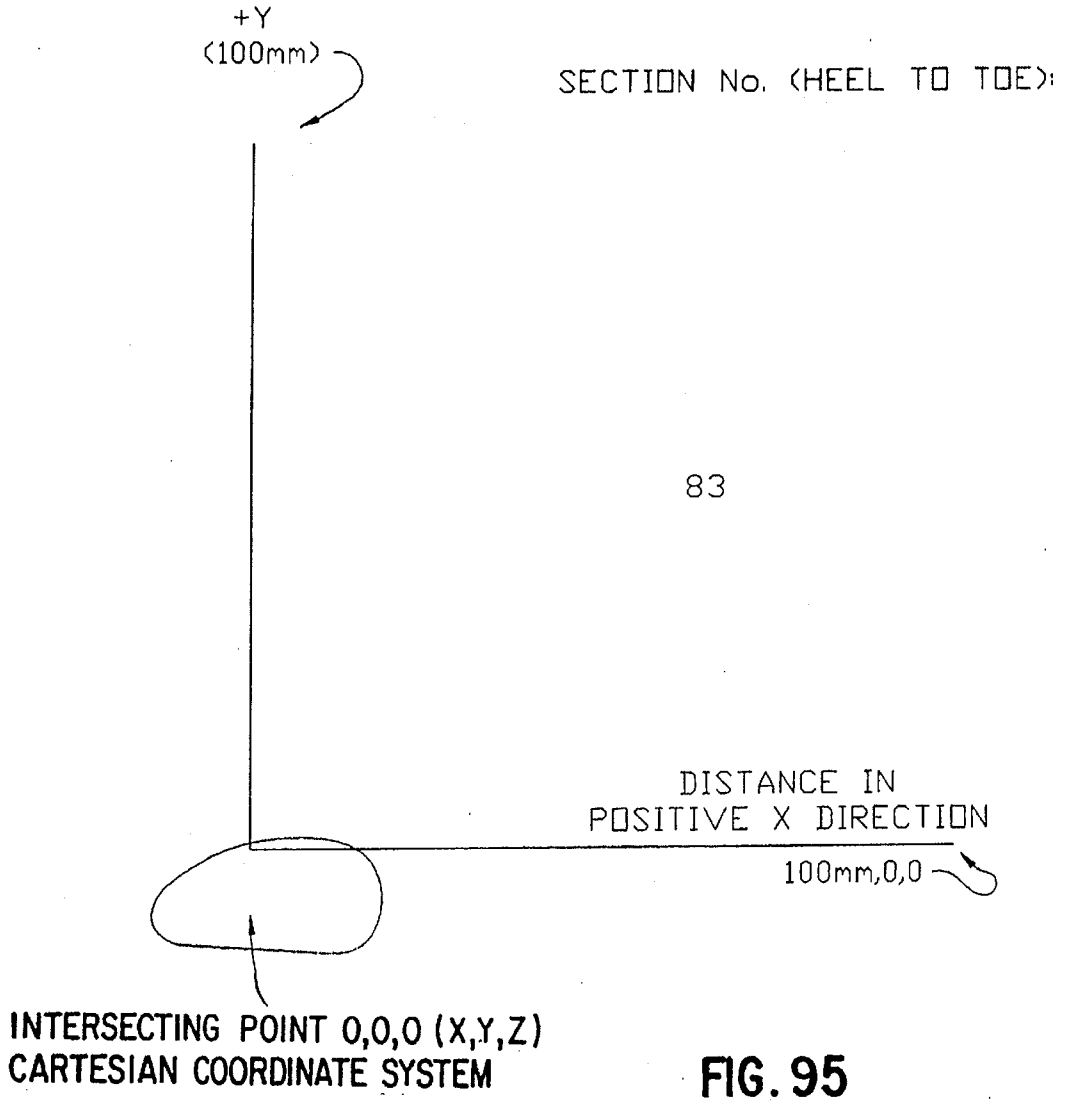
Figure 96:
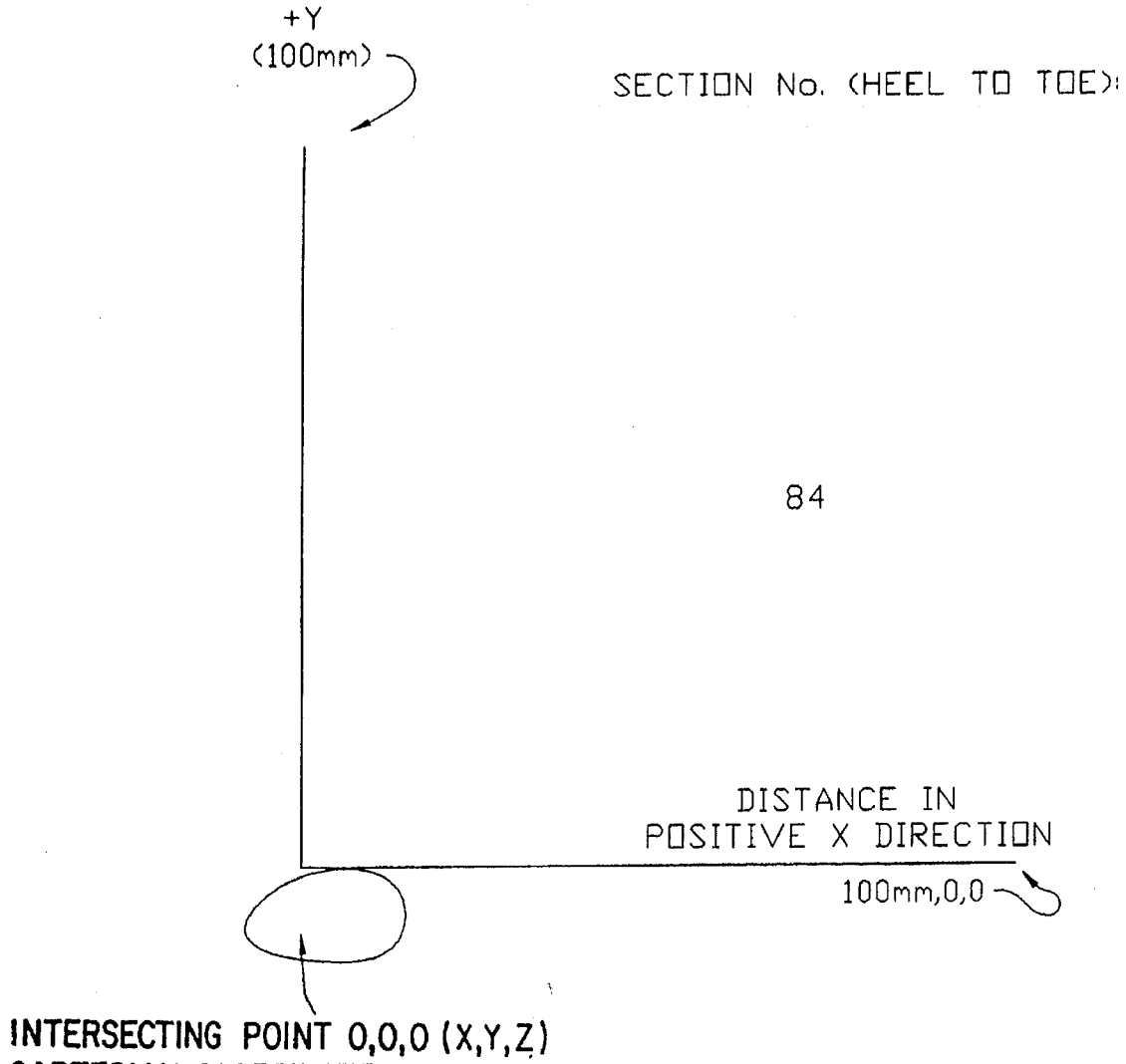
Figure 97:
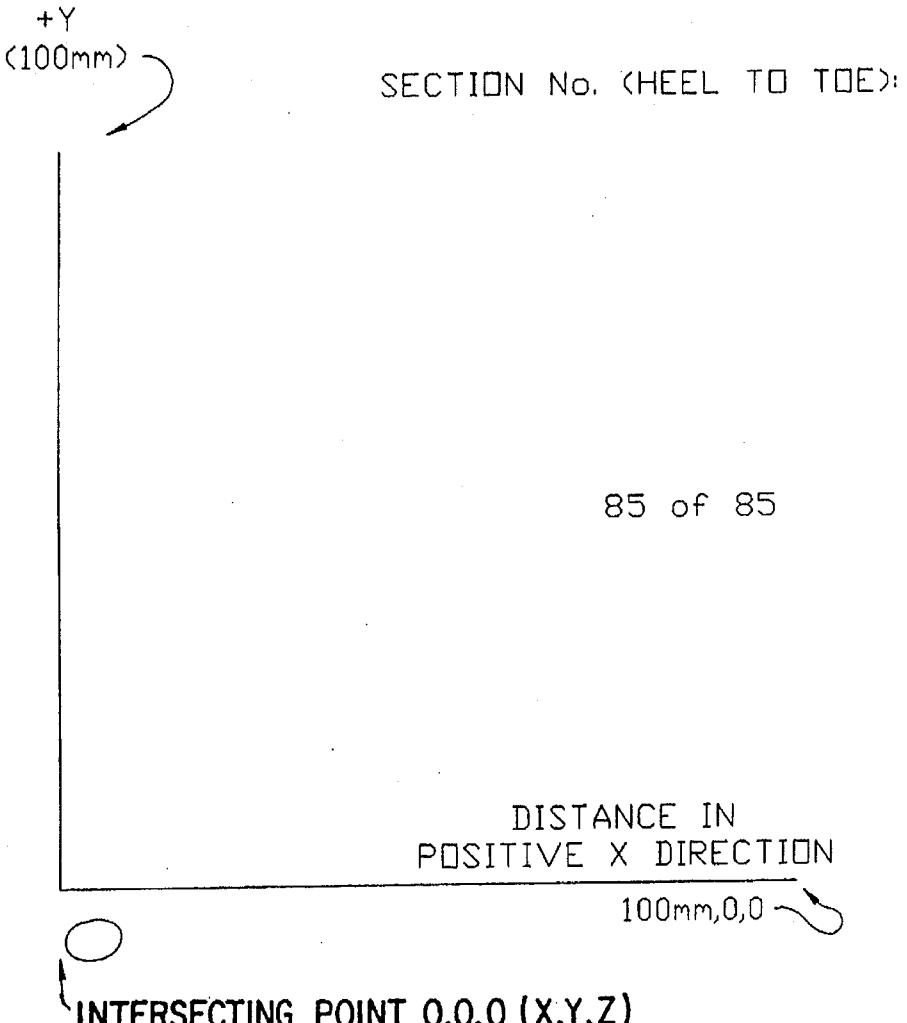

FIGS. 13–97 represent the cross-sectional contours 12 that are derived from cross section 1—1 through 85—85. The orientation of each of the cross-sections is shown with reference to the X and Y axes as the section line is extended along the Z-plane in 3 mm increments. It can be readily understood that the shape of each cross-sectional contour 12 shown in FIGS. 13–97 represents the intersection between consecutive transverse planes parallel to the X-Y reference and the surface 26 of last 10. The X-Y reference plane is defined when Z=0.0. More specifically, a heel portion 28 of last 10 is dimensioned generally in accordance with the cross-sectional contours 1—1 through 34—34 as illustrated in FIGS. 13–46. The cone portion 30 of last 10 is dimensioned generally in accordance with the cross-sectional contours 35—35 through 58—58 as illustrated in FIGS. 47–70. Similarly, the forefoot portion 32 is dimensioned generally in accordance with the cross-sectional contours 59—59 through 85—85 as illustrated in FIGS. 71–97.

Figure 4:
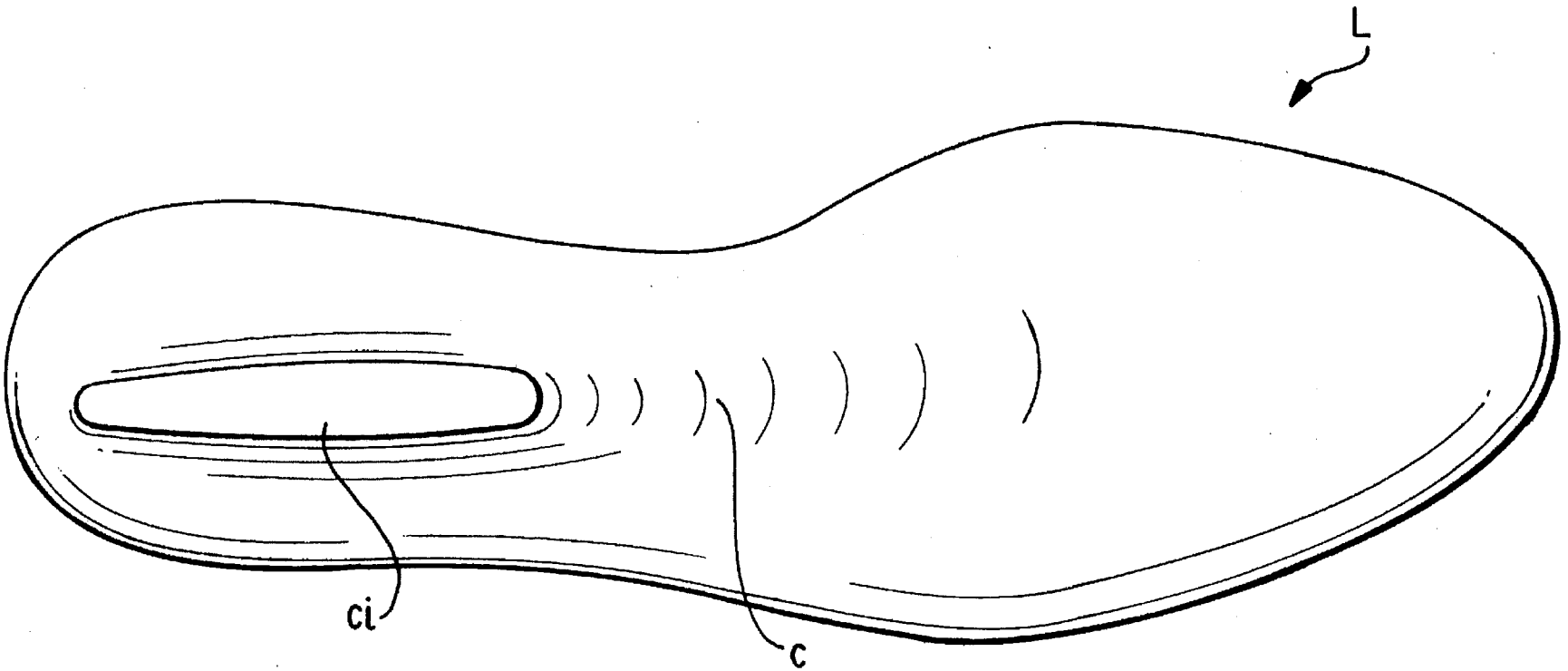
FIG. 4 PRIOR ART
FIG. 4 is a top view of a prior art last showing the top of the cone or island, cone and front cone areas.
Figure 9:
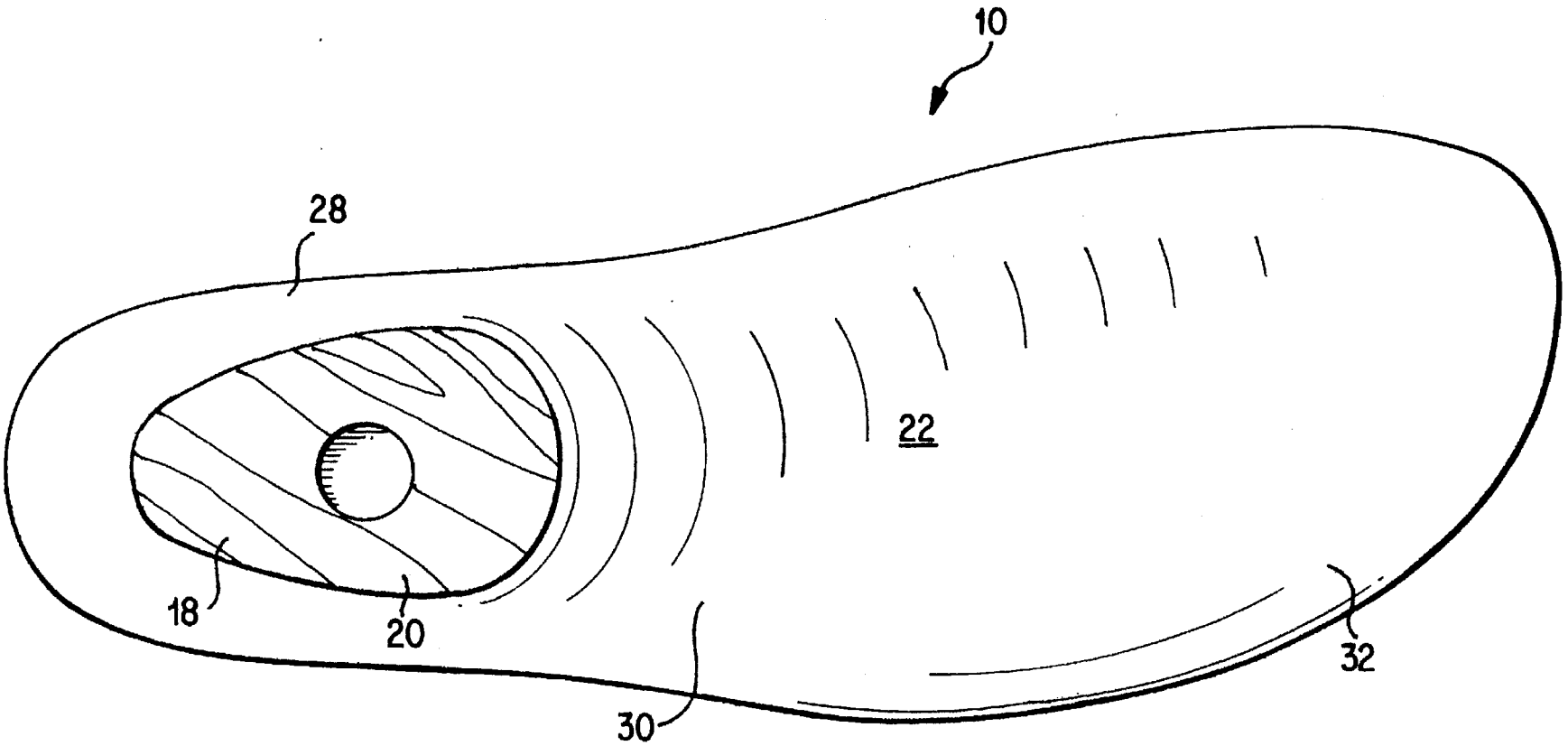
FIG. 9 is a top view of the last representation of FIG. 5.
Figure 11A:
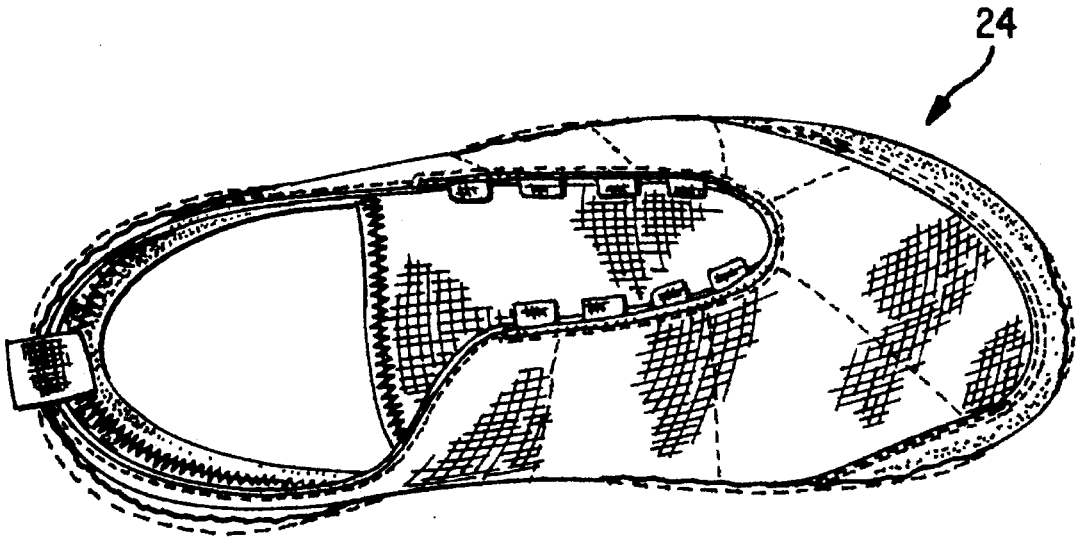
FIGS. 11 (*a*) and (*b*) are top and front views of an article of footwear for a left foot of a wearer made on the last according to the present invention.
Figure 11B:
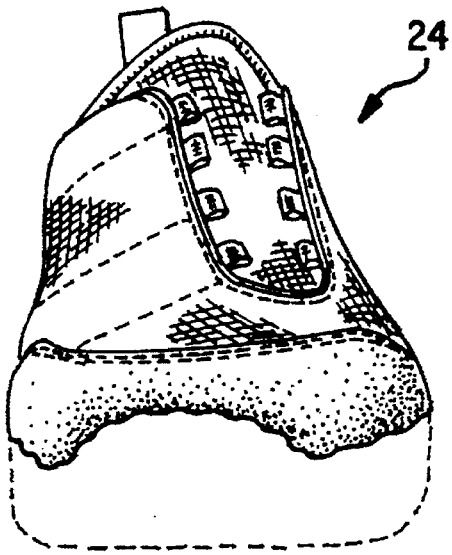

Referring to FIG. 9, a top view of the last 10 showing the cone portion 30, the top of the cone or cone island 20 disposed at an upper surface of the heel portion 28, and the front cone area 22. A distinctive feature of last 10 of the present invention is its naturally shaped cone island 20 and front cone area 22, as compared with prior art lasts, such as shown in FIG. 4. This contributes to the article of footwear 24 shown in FIG. 11 having an improved fit and comfort level perceived by the user. Changes could of course be made to the height of the cone 18, i.e., the point along the Y axis at which the last is terminated to form the top of the cone or cone island 20 without departing from the essential teachings of the present invention. In this regard, the height of cone 18 could be changed to facilitate the manufacture of middle or high top articles of footwear. As further shown in FIG. 9, the forefoot portion 32 of last 10 includes an enlarged toe box area in order to comfortably accommodate the first toe or hallux. Further improved comfort and fit is obtained in article of footwear 24, as shown in FIGS. 11(*a*) and (*b*), by preferably including a lacing system extending along the lateral side of the shoe upper. While advantageous, articles of footwear made from last 10 need not incorporate this closure feature.

The model of last 10 illustrated for the present invention is sized for a women's size 7C running shoe. Therefore, in order to fabricate lasts for other sizes, the dimensions of last 10 must be graded accordingly. Referring to FIG. 10, the table gives the stick length, toe spring, ball or ball girth, waist or waist girth, heel height, and short heel measurements of the last 10 of the present invention as graded for women's sizes 4 through 12 based upon the size 7 model. Common grading of a size 7 women's last is generally consistent with a ⅙ inch or 4.23 mm change per one half size in the length dimension, and ⅛ inch or 3.175 mm change per one half size in the girth dimension, as well as in the ball and waist dimensions.

Figure 12A:
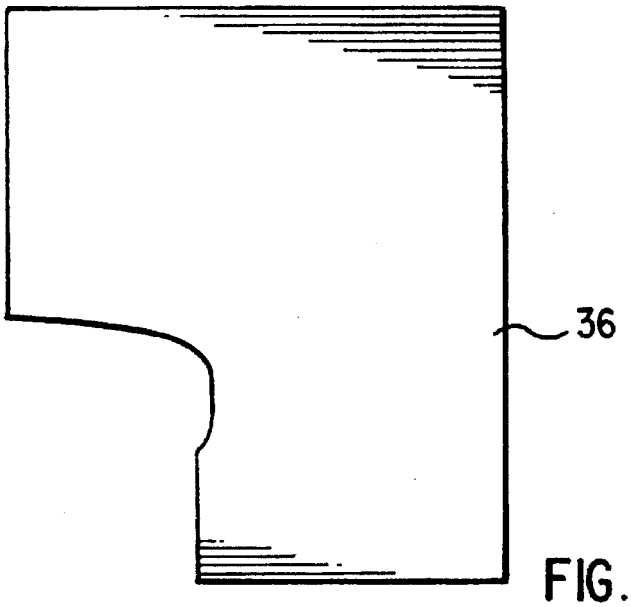
FIGS. 12(*a*), (*b*) and (*e*) illustrate templates for final finishing of the toe, heel and bottom portions of the last according to the present invention.
Figure 12B:
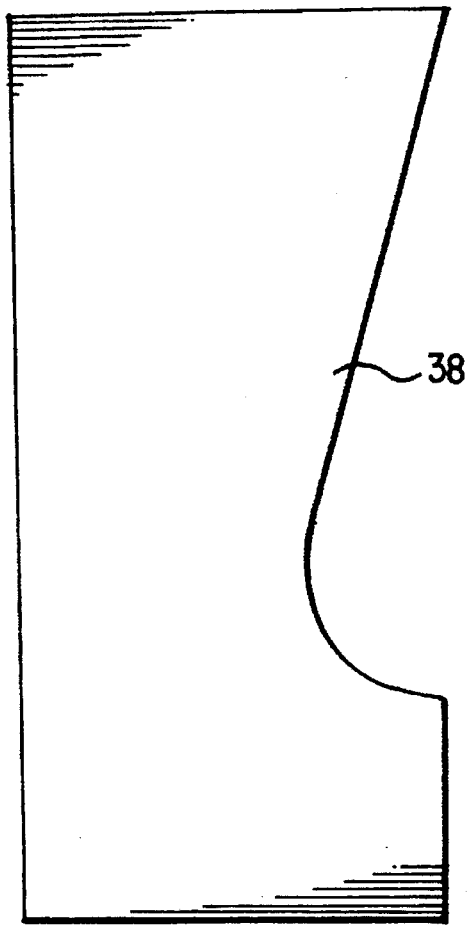
Figure 12C:
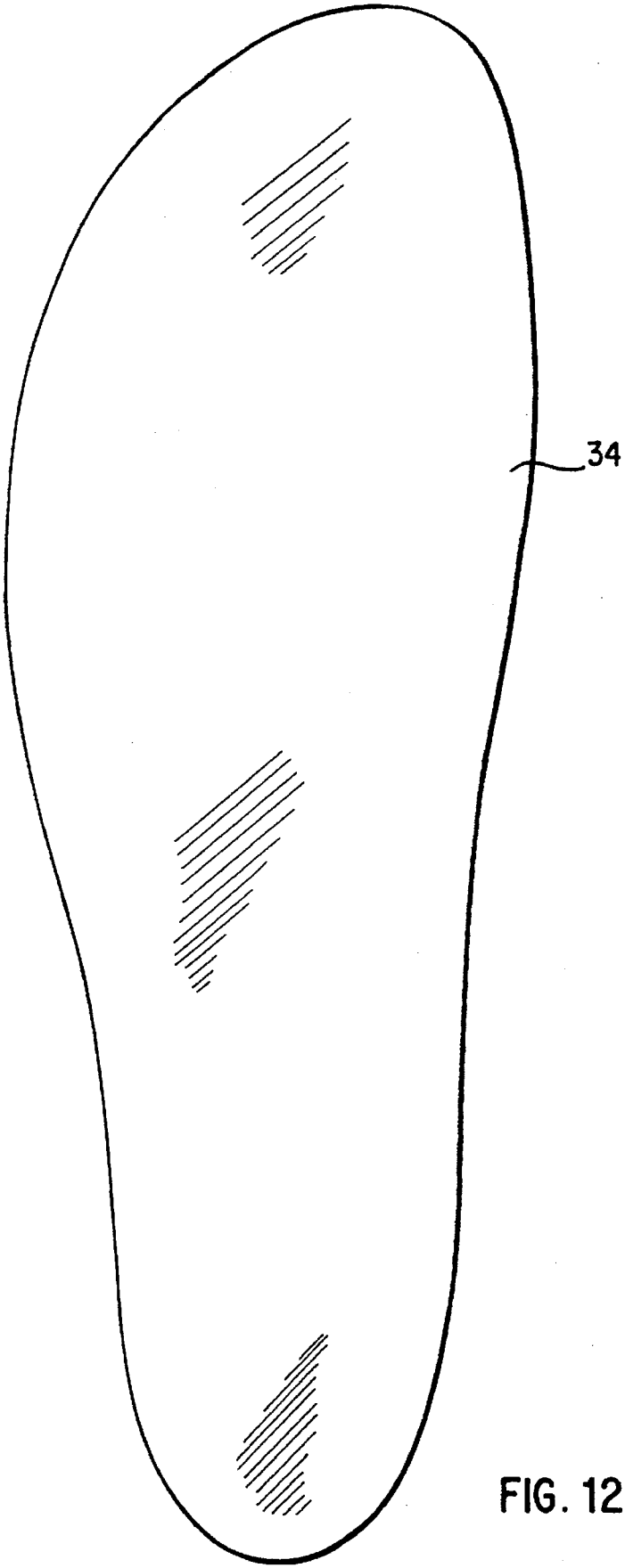

Utilizing FIGS. 13–97, corresponding to cross-sectional contours 1—1 to 85—85 thus obtained for the last 10 of the present invention, one skilled in the art can duplicate last 10 through the use of conventional computer assisted design software capable of scanning FIGS. 13–97. For example, a computer-aided-design (CAD) module 801 is a three-dimensional graphics software program for generating an geometrical model definition. Such a geometrical model definition includes coordinate points precisely locating the object design in a three-dimensional coordinate system. This may be provided by a graphics software package using, for example, X, Y, and Z coordinate points and appropriate locating vectors where necessary. The three-dimensional graphics software package utilizes appropriate data structures for defining particular points in the data base of the graphics program. By utilizing algorithms in the graphics program, other points in the object can be defined and generated. The graphics program preferably utilizes appropriate vector and matrix routines whereby an object can be rotated or otherwise moved in computer memory and can be dimensioned whereby the coordinates for any one point are known with respect to other points. As noted above, suitable CAD software packages include I-DEAS (available from SDRC, Inc. of Milford, Ohio), CATIA (available from IBM), and ANVIL-5000 (available from Manufacturing Consulting Services). Alternatively, last 10 of the present invention may be duplicated by manually or mechanically forming shaped components corresponding in dimension to each of the cross-sectional contours shown in FIGS. 13–97, and by then aligning the shaped components in the proper orientation and the correct spacing of 3 mm and forming a molded surface around the shaped components. Due to the limitations of mathematics, CAD systems, and manual manipulation, there is generally a relatively small amount of variation or uncertainty obtained regarding the information for the distance between the rearmost portion of the heel 14 and the first cross section 1—1, such distance being generally less than or equal to 3 mm, and in the distance from the last cross section 85—85 to the anteriormost portion of the toe 16, such distance also being generally less than or equal to 3 mm. Accordingly, these portions of the last may be shaped by hand utilizing the templates 34, 36, 38 shown in FIG. 12 for final shaping of the bottom, toe and heel, respectively, of the model women's size 7 shoe.

Although unnecessary for making last 10 in accordance with the present invention, the methodology used to initially fabricate last 10 and thereafter generate the cross-sectional contours of FIGS. 13–97 is described as follows.

The last 10 of the present invention was created by casting in a plaster the feet of a number of subjects during weight bearing, such as would occur when one is running. The casts were then scanned or digitized into three dimensions using a scanner. The data was then filtered, orientated and averaged using appropriate software. The data was then used to drive a computer numerically controlled (CNC) milling machine and thus, a prototype last was created. Articles of footwear were made from this prototype last and were then wear tested to determine any necessary revisions. The feedback provided from these wear tests resulted in numerous modifications to the prototype last. The modified last and resulting articles of footwear were then in turn wear tested and additional changes were then made to the prototype last. This process was repeated until results were optimized with respect to the target population. The result of this repeated and painstaking process is the preferred embodiment of last 10 of the present invention and the articles of footwear 24 made therefrom.

It can be readily understood that a variety of alternate or equivalent software, hardware, methods, processes and manufacturers could be used to derive the last of the present invention. Although not specifically shown, last 10 may also include a hinge as in the prior art lasts in order to simplify removal of the article of footwear. It will also be obvious to those of ordinary skill in the art that numerous modifications may be made without departing from the true spirit and scope of the present invention, which is to be limited only by the appended claims.

We claim:

1. A last for making an article of footwear, said last comprising:

a forefoot portion;

a cone portion rearward of said forefoot portion; and a heel portion rearward of said cone portion;

wherein said last has dimensions defined by a plurality of cross-sectional contours extending from proximate a proximal end of said heel portion to proximate a distal end of said forefoot portion;

wherein said last dimensions are in accordance with or proportional to said plurality of cross-sectional contours shown in FIGS. 13–97.

2. The last of claim 1 wherein said cross-sectional contours are taken along consecutive parallel planes to a reference X-Y plane defined as Z being equal to 0.0.

3. The last of claim 2 wherein said cross-sectional contours are derived from eighty-five cross sections taken through said last, a first said cross section being located proximate said proximal end of said heel portion and an eighty-fifth said cross section being located proximate said distal end of said forefoot portion, each said cross-sectional contour corresponding to each said respective cross section through said last.

4. The last of claim 3 wherein said first said cross section is spaced 3 mm or less from said proximal end of said heel portion, said eighty-fifth cross section is spaced 3 mm or less from said distal end of said forefoot portion, and each said cross-sectional contour is spaced 3 mm from an adjacent said cross-sectional contour.

5. The last of claim 1 wherein said cross-sectional contours of said forefoot portion define an enlarged toe box to comfortably accommodate a first toe.

6. The last of claim 1 wherein said cross-sectional contours of said forefoot portion, said cone portion and said heel portion define a bottom edge having a rounded periphery in order to accommodate a natural shape of a bottom surface of a human foot.

7. The last of claim 1 wherein said cross-sectional contours of said heel portion include a cone island defined by an upper surface of said heel portion, said cone island having a generally circular shape to accommodate a natural shape of a human ankle.

8. The last of claim 1 wherein said cross-sectional contours define a women's size 7 last, wherein said size 7 is graded in accordance with or proportional to the stick length, toe spring height, ball, and waist measurements represented in FIG. 10.

9. An article of footwear having a shape complimentary to the last of claim 1.

10. An article of footwear comprising:

a shoe upper formed around a shoe last; and a shoe sole;

wherein said shoe upper includes a heel area, an instep area and a forefoot area; and wherein said last has dimensions defined by a plurality of cross-sectional pg,16 contours extending from proximate a proximal end of a heel portion of said last to proximate a distal end of a forefoot portion of said last;

wherein said last dimensions are in accordance with or proportional to said plurality of cross-sectional contours shown in FIGS. 13–97.

11. The article of footwear of claim 10 wherein said cross-sectional contours are taken along consecutive parallel planes to a reference X-Y plane defined as Z being equal to 0.0.

12. The article of footwear of claim 11 wherein said cross-sectional contours are derived from eighty-five cross sections taken through said last, a first said cross section being located proximate said proximal end of said heel portion and an eighty-fifth said cross section being located proximate said distal end of said forefoot portion, each said cross-sectional contour corresponding to each said respective cross section through said last.

13. The article of footwear of claim 12 wherein first cross section is spaced 3 mm or less from said proximal end of said heel portion, said eight-fifth cross section is spaced 3 mm or less from said distal end of said forefoot portion, and each said cross-sectional contour is spaced 3 mm from an adjacent said cross-sectional contour.

* * * * *